US009268263B2

(12) United States Patent
Ariizumi et al.

(10) Patent No.: US 9,268,263 B2
(45) Date of Patent: Feb. 23, 2016

(54) DEVELOPMENT APPARATUS AND IMAGE FORMING APPARATUS

(71) Applicant: CANON KABUSHIKI KAISHA, Tokyo (JP)

(72) Inventors: Osamu Ariizumi, Matsudo (JP); Takanori Iida, Noda (JP); Shinya Suzuki, Abiko (JP); Ryohei Terada, Nagareyama (JP); Ichiro Katsuie, Takasaki (JP); Shoji Naruge, Kashiwa (JP); Masahiro Ootsuka, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/702,011

(22) Filed: May 1, 2015

(65) Prior Publication Data

US 2015/0331365 A1 Nov. 19, 2015

(30) Foreign Application Priority Data

May 13, 2014 (JP) ..... 2014-099428
May 13, 2014 (JP) ..... 2014-099429
May 13, 2014 (JP) ..... 2014-099430
May 13, 2014 (JP) ..... 2014-099432

(51) Int. Cl.
*G03G 15/00* (2006.01)
*G03G 15/09* (2006.01)
*G03G 15/08* (2006.01)

(52) U.S. Cl.
CPC ..... *G03G 15/0942* (2013.01); *G03G 15/0889* (2013.01); *G03G 15/0907* (2013.01)

(58) Field of Classification Search
CPC ..... G03G 15/0812; G03G 15/0889; G03G 15/0907; G03G 15/0921; G03G 15/0942
USPC ..... 399/119, 258, 260, 264–267, 270, 271
See application file for complete search history.

(56) References Cited

U.S. PATENT DOCUMENTS

| | | | | |
|---|---|---|---|---|
| 6,449,442 | B1 | 9/2002 | Shida et al. | |
| 8,934,819 | B2 | 1/2015 | Sakamaki et al. | |
| 2002/0028091 | A1 * | 3/2002 | Hibino | G03G 15/0291 399/267 |
| 2007/0025776 | A1 * | 2/2007 | Suzuki | G03G 15/0815 399/272 |
| 2007/0127952 | A1 * | 6/2007 | Terashima | G03G 15/0921 399/277 |

(Continued)

FOREIGN PATENT DOCUMENTS

| | | | |
|---|---|---|---|
| JP | H02-262171 | A | 10/1990 |
| JP | 2701162 | B2 | 1/1998 |

(Continued)

*Primary Examiner* — Walter L Lindsay, Jr.
*Assistant Examiner* — Jessica L Eley
(74) *Attorney, Agent, or Firm* — Fitzpatrick, Cella, Harper & Scinto

(57) ABSTRACT

A development device wherein a magnetic force distribution of a developer bearing member in a longitudinal direction at positions at which a magnetic flux density of a low magnetic field area is minimal in the peripheral direction of the developer bearing member is set such that a difference between a maximum magnetic flux density in a range from a maximum position at which an attenuation rate of the magnetic flux density is maximal to a 30 mm distant position toward the center of the developer bearing member and a magnetic flux density on a further center side of the developer bearing member than the range is 3 mT or less, and an absolute value of the magnetic flux density of a further outer side in the longitudinal direction of the developer bearing member than the maximum position is set to 3 mT or less.

27 Claims, 54 Drawing Sheets

(56) References Cited

U.S. PATENT DOCUMENTS

| | | | | |
|---|---|---|---|---|
| 2010/0202805 | A1* | 8/2010 | Miyoshi | G03G 15/0921 399/277 |
| 2013/0195515 | A1* | 8/2013 | Tanaka | G03G 15/0896 399/269 |
| 2015/0139699 | A1 | 5/2015 | Sakamaki et al. | |

FOREIGN PATENT DOCUMENTS

| | | | |
|---|---|---|---|
| JP | H10-091002 | A | 4/1998 |
| JP | H11-007189 | A | 1/1999 |
| JP | 2872145 | B2 | 3/1999 |
| JP | 2002-050515 | A | 2/2002 |
| JP | 4430798 | B2 | 3/2010 |

* cited by examiner

DEVELOPMENT APPARATUS AND IMAGE FORMING APPARATUS

BACKGROUND OF THE INVENTION

1. Field of the Invention

The present invention relates to a development apparatus in which a magnet roller is arranged on the inner side of a developer bearing member and an image forming apparatus using the development apparatus.

2. Description of the Related Art

In development apparatuses of recent years, a two-component development system using a developer acquired by mixing non-magnetic toner and magnetic carrier is widely used. The two-component development system has superior stability of the charging amount of toner and thus is appropriately used by high-speed image forming apparatuses and color image forming apparatuses.

In an image forming apparatus using a two-component developer, a columnar magnet roller in which a predetermined magnetic force pattern is magnetized is arranged to be fixed inside a rotating cylindrical sleeve, and developer is attached to the surface of the sleeve according to the magnetic force pattern and is conveyed. The conveyed developer is made to be a thin layer by a regulation blade located adjacent to a developing sleeve and then, is developed in an opposing portion of a photosensitive drum. Thereafter, the developer remaining on the developing sleeve after the developing process is separated from the developing sleeve and is collected to the inside of a developing container 2.

As the magnet roller, for example, there is a magnet roller that is configured by five poles including a draw-up pole, a conveyance pole, a development pole, a collection pole, and a peel-off pole. In the case of a magnet roller configured by an odd number of poles, the draw-up pole and the peel-off pole have the same polarity, and a repulsive magnetic field is formed between both the poles. However, there are cases where a low magnetic field area attracting the developer is generated between both the poles. As such a low magnetic field area is generated, the collection rate of the developer remaining on the developing sleeve after the developing process decreases, and a history according to the developer, which has not been collected, is left after one circulation of the sleeve, whereby there is a concern that an image defection may occur.

In order to prevent this, it is necessary to control the low magnetic field area to have 10 mT or less on the surface of the sleeve, and it is necessary to form this area having 10 mT or less to be flat. In this way, the collection rate of developer is improved.

In Japanese Patent Laid-Open No. 2002-50515, the arrangement of a magnet piece that has magnetic poles of the same polarity, which have a bar shape and a cross-section having an approximate linear shape, on the side face between poles, which have the same polarity, of a magnet roller 4 (in an area in which a low magnetic field area is generated) and has an inner peripheral face having polarity opposite to that of the side face has been disclosed.

However, in the method disclosed in Japanese Patent Laid-Open No. 2002-50515, when the magnet piece is arranged for controlling the low magnetic field area, the magnetic characteristics of both end portions of the magnet roller in the longitudinal direction tend to be elevated. Thus, in both end portions of the low magnetic field area, the developer is not collected but wraps around to the outer side, whereby a stay of the developer occurs. Thus, on the surface of the developing sleeve at a position corresponding to an end face of the magnet roller in the longitudinal direction, locally, more developer than that present at a position corresponding to the circumferential face of the magnet roller is carried.

The developer staying in this way may leak to the outside of the developing container, and there is concern that the inside of the main body of the image forming apparatus is contaminated. Thus, as a measure for the leakage of the developer from the end portion of the developing sleeve, a configuration has been employed in which a magnetic plate or a magnet seal is arranged at the end portion of the developing sleeve, and a magnetic brush is brought into contact with the sleeve so as to perform magnetic sealing (see Japanese Patent Laid-Open No. 2-262171).

However, in Japanese Patent Laid-Open No. 2-262171, since the magnetic seal is necessary, the cost increases as that much. Thus, a configuration may be considered in which, by improving the magnetic characteristics of the end portion of the developing sleeve, the leakage of the developer is suppressed without using the magnetic seal.

However, in a case where the configuration not requiring the magnetic seal is employed, while the leakage of developer due to the stay of the developer in the end portion of the developing sleeve can be suppressed, there is concern about toner scattering in which toner sprouts from a gap between the developing sleeve and the developing container in the area of the end portion of the developing sleeve. The reason for this is that there is an area in which developer is scarcely present in the low magnetic field area over the entire rectangular area of the developing sleeve. In addition, since a magnetic seal is not arranged in the end portion, in the end portion of the developing sleeve, a gap, from which scattering toner leaks, is generated between the developing container and the developing sleeve.

As a measure for this, in a case where a clearance between the developing container and the developing sleeve is extremely decreased so as to fill up the gap, there is a possibility that the developing container and the developing sleeve are brought into contact with each other. In addition, as a result of the contact, there is concern that deformation of the developing sleeve according to the contact, aggregation of toner due to frictional heat generated at the time of the contact, or the like may occur.

In addition, in a conventional development apparatus, there are problems as below.

The configuration of a conventional development apparatus using two-component developer will now be described. FIG. 28 is a top view of the inside of the conventional development apparatus.

As illustrated in FIG. 28, the development apparatus 900 includes: a developing chamber 940 that supplies developer to a developing sleeve 941; and a stirring chamber 950 that is arranged to be aligned in the horizontal direction with respect to the developing chamber 940. The developing chamber 940 and the stirring chamber 950 are partitioned by a partition wall 946 having both ends open. In addition, in the developing chamber 940 and the stirring chamber 950, a conveyance screw 944 and a conveyance screw 945 that are conveyance members are respectively arranged.

By employing the configuration described above, as denoted by arrows in the figure, developer is supplied to the developing sleeve 941 while the developer is circulated between the developing chamber 940 and the stirring chamber 950 by using the conveyance screws. The developer that is carried in the developing sleeve 941 and passes through a developing area of a photosensitive body is peeled off from the developing sleeve 941 and, as denoted by broken-line arrows in the figure, is collected into the developing chamber 940.

Accordingly, in the developing chamber 940, the developer is supplied to the developing sleeve 941 while being conveyed by the conveyance screw 944, and the developer peeled off from the developing sleeve 941 is collected. For this reason, the developer disposed inside the developing chamber 940 has a more number of times of being carried in the developing sleeve 941 toward the downstream side in the conveyance direction according to the conveyance screw 944. In other words, toward the downstream side of the developing chamber 940, the developer has a more number of times of the consumption of toner by passing through the developing area.

As a result, the toner density of the developer disposed inside the developing chamber 940 decreases toward the downstream side in the conveyance direction, and non-uniformity of the toner density of the developer supplied to the developing sleeve 941 occurs. Then, when an image is formed in such a state, density non-uniformity occurs in an output object.

Meanwhile, as a development apparatus, a development apparatus has been proposed which has a configuration in which a developing chamber and a stirring chamber are arranged to be aligned in the horizontal direction, a partition wall is extended up to a position located close to a developing sleeve, and two-component developer carried on the developing sleeve is sent to the stirring chamber (see U.S. Pat. No. 6,449,442).

In the case of such a structure, developer that is peeled off from the developing sleeve after passing a developing area opposing a photosensitive body that is an image bearing member is collected into the stirring chamber. For this reason, after developer having a low toner density is sufficiently stirred in the stirring chamber, the developer is conveyed to the developing chamber and is supplied to the developing sleeve. Accordingly, it is difficult for density non-uniformity to occur in an output object.

In addition, in each of both end portions of the developing sleeve in the longitudinal direction, a developer leakage prevention member such as a magnetic plate or a magnetic sheet formed by a magnetic member having a predetermined space from a part of the circumferential face of the developing sleeve may be arranged. In such a case, two-component developer is prevented from leaking from both end portions of the developing sleeve in the longitudinal direction. In addition, a technology for preventing leakage of a magnetic carrier or non-magnetic toner by forming a magnetic brush of the two-component developer in the developer leakage prevention members has been proposed (see Japanese Patent Laid-Open No. 2-262171).

However, in the case of the development apparatus using the developer leakage prevention configuration disposed on both end portions of the developing sleeve in the longitudinal direction as disclosed in Japanese Patent Laid-Open No. 2-262171, there are problems as described below.

FIG. 29 is a diagram that illustrates an example of a development apparatus using two-component developer for describing conventional problems. In the development apparatus 1, a developing sleeve 941 that is configured using a non-magnetic material is arranged. In addition, on the inside of the developing sleeve 941, a fixed magnet 942 that is a magnetic field generation member is arranged.

When the developing sleeve 941 rotates in a direction (counterclockwise direction) denoted by an arrow X at the time of performing a developing operation, two-component developer included inside a developing container 910 is carried in the developing sleeve 941 and is conveyed in the direction X.

The magnet 942 includes five peak positions of magnetic poles. In the development apparatus of the two-component developing system, a magnet having peak positions of odd numbers is frequently used. The two-component developer included inside the developing container 910 is carried by a draw-up pole S3 to the developing sleeve 941 from the developing chamber 940.

As the developing sleeve 941 is driven to rotate in the direction X, the two-component developer is carried and conveyed and is formed in a thin layer by a regulation blade 943 arranged near a cutting pole N1. Then, a developing operation is performed for an image bearing member not illustrated in the figure near a development pole S1, and, according to a repulsive magnetic field formed by a peel-off pole S2 and the draw-up pole S3, the two-component developer is peeled off from the developing sleeve 941 and is returned to the developing chamber 940.

Between the peel-off pole S2 and the draw-up pole S3, which are the same S poles, a low magnetic force zone is generated. For this reason, while the two-component developer can be peeled off from the developing sleeve 941, in both end portions of the developing sleeve 941 in the longitudinal direction, a regulation force according to the magnetic field is weak in the low magnetic force zone between the peel-off pole S2 and the draw-up pole S3. Accordingly, the two-component developer may easily leak to the outer side of the developing sleeve in the longitudinal direction.

Thus, in Japanese Patent Laid-Open No. 2-262171, a developer leakage prevention member 949 such as a magnetic plate or a magnet sheet formed by using a magnetic member is arranged so as to at least cover the repulsive magnetic field formed by the same poles. In this way, the two-component developer is prevented from leaking from both end portions of the developing sleeve 941 in the longitudinal direction.

However, in a case where the developer leakage prevention member 949 such as the magnetic plate or the magnetic sheet is arranged in a repulsive magnetic field, the cost increases by arranging the developer leakage prevention member 949. In addition, in order to improve the sealing property, a higher-priced developer leakage prevention member is required, and there is concern that the cost further increases. Particularly, in the case of a configuration in which developer is circulated between the developing chamber and the stirring chamber, the developer is configured to leak from the end portion more easily on the downstream side in the developer conveyance direction than on the upstream side according to the relation of developer pressure.

This problem similarly occurs also in a development apparatus having the configuration, as illustrated in U.S. Pat. No. 6,449,442, in which the developing chamber and the stirring chamber are arranged to be aligned in the horizontal direction, the partition wall is extended up to a position located close to the developing sleeve, and two-component developer carried on the developing sleeve is sent to the stirring chamber.

In addition, in the conventional development apparatus, there are problems as below.

As a development apparatus using an electrophotographic system, there are development apparatuses each using two-component developer including non-magnetic toner particles (toner) as developer and magnetic carrier particles (carriers). In such development apparatuses, when developer leaks from an end portion of a developing sleeve, there is concern that a bearing as a bearing member of the developing sleeve is clogged, and defective rotation of the developing sleeve occurs.

Thus, it is known that a magnetic member is used so as to surround a developer bearing member in the peripheral direction except for an area corresponding to an opening portion of a developing container in an end portion of the developing sleeve in the direction of a rotation shaft of the developing sleeve as a developer seal (see Japanese Patent Laid-Open No. 2-262171).

In Japanese Patent Laid-Open No. 2-262171, as illustrated in FIG. 1, the magnetic member 21 covers an end portion of an area other than a developing area in which the developing sleeve is exposed from the development apparatus so as to face an image bearing member. In other words, the magnetic member 21 covers an end portion of an area other than a developer area including portions in which a pole N2 taking in the developer and a pole N3 peeling off the developer are present. Accordingly, the two-component developer is prevented from leaking from both end portions of the developing sleeve in the longitudinal direction.

In the magnetic member, since the pole taking in the developer and the pole N3 peeling off the developer have the same polarity, between the poles having the same polarity, a low magnetic field area is formed. Then, in an end portion of the low magnetic field area, there is a high possibility of the occurrence of developer leakage, and accordingly, it is necessary to cover all the areas other than the developing area with the magnetic member as in Japanese Patent Laid-Open No. 2-262171.

However, in the configuration disclosed in Japanese Patent Laid-Open No. 2-262171, there is a disadvantage that, when the developer after the developing process is put into the inside of the developing container from a developer taking portion, the developer seal disposed in the end portion of the developer bearing member hinders the flow of the developer in the developer taking portion.

The hindrance of the flow of the developer causes the developer to stay in the end portion of the developer taking portion. Then, there is concern that toner included in the developer disposed in the stay portion is separated, and toner scattering occurs inside an image formation apparatus. In addition, there is concern that the developer overflown from the stay portion falls into the inside of the image forming apparatus. Furthermore, the scattering toner or the fallen developer, finally, may have a bad influence such as contamination on an output image.

In addition, in the conventional development apparatus, there are also problems as below.

In image forming apparatuses of recent years, a two-component developing system using two-component developer acquired by mixing non-magnetic toner and magnetic carriers together is widely used. In the image forming apparatuses using the two-component developer, a columnar magnet roller in which a predetermined magnetic force pattern is magnetized is arranged to be fixed inside a rotating cylindrical sleeve. Then, developer is attached to the surface of the developing sleeve according to the magnetic force pattern of the magnet roller and is conveyed.

As the magnet roller, for example, there is a magnet roller that is configured by five poles including a draw-up pole, a conveyance pole, a development pole, a collection pole, and a peel-off pole. In the case of a magnet roller configured by an odd number of poles, the draw-up pole and the peel-off pole have the same polarity, and, by forming a low magnetic field area between both the poles, the developer after the developing process is peeled off from the developing sleeve.

However, generally, the magnetic characteristics of both end portions of the magnet roller in the longitudinal direction tend to be elevated. Thus, there are cases where, in both end portions of the sleeve, the developer is not collected but wraps around to the outer side, and a stay of the developer occurs. In other words, on the surface of the sleeve at a position corresponding to an end face of the magnet roller in the longitudinal direction, locally, more developer than that present at a position corresponding to the circumferential face of the magnet roller is carried.

As a result, in the portion in which more developer is carried, there is concern that the applied pressure of the regulation blade increases, and deterioration of the developer due to sliding friction progresses, or linear development non-uniformity on the image face is generated. In addition, there is concern that the staying developer may leak to the outside of the developing container.

Thus, in order to reduce the elevation of the magnetic force on the end face of the magnet roller in the longitudinal direction, chamfering is performed for the end portion of the columnar magnet roller (see Japanese Patent Laid-Open No. 10-091002). In such a configuration, the diameter of the end portion of the magnet roller is gradually decreased toward the outer side in the longitudinal direction, and a distance between the surface of the magnet roller and the surface of the sleeve is gradually increased. In this way, the elevation of the magnetic force at the corner of the end portion of the magnet roller is offset.

However, in the configuration disclosed in Japanese Patent Laid-Open No. 10-091002, while there is an advantage of not requiring a magnetic seal, there is concern that the developer leaks due to vibrations at the time of shipping.

SUMMARY OF THE INVENTION

The present invention provides a development apparatus and an image forming apparatus capable of suppressing inconveniences due to no-presence of a magnetic seal such as scattering of toner, leakage of toner, and a stay of developer while suppressing adverse effects caused by arranging a magnetic seal in an end portion of the sleeve such as cost-up and a decrease in the in-taking property of the developer.

As a representative configuration of the present invention, there is provided a development apparatus including: a developing container which houses two-component developer including toner and a magnetic carrier; a developer bearing member which carries the two-component developer; and a magnetic field generation member which includes a plurality of magnetic poles including first and second magnetic poles having the same polarity and being adjacent to each other in a peripheral direction of the developer bearing member and is arranged inside the developer bearing member, wherein the magnetic field generation member, between the first magnetic pole and the second magnetic pole, includes a low magnetic field area in which a magnetic force measured on a circumferential face approximately coinciding with an outer peripheral face of the developer bearing member is 10 mT or less, and a magnetic force distribution of the developer bearing member in a longitudinal direction at positions at which a magnetic flux density of the low magnetic field area is minimal in the peripheral direction of the developer bearing member is set such that a difference between a maximum magnetic flux density in a range from a maximum position at which an attenuation rate of the magnetic flux density is maximal to a 30 mm distant position toward the center of the developer bearing member and a magnetic flux density on a further center side of the developer bearing member than the range is 3 mT or less, and an absolute value of the magnetic flux density of a further outer side in the longitudinal direction of the developer bearing member than the maximum position is set to 3 mT or less, and, in a space between the developing container and the developer bearing member, an electric field formation member which is arranged in a peripheral area of an end portion of the developer bearing member and can form an electric field repelling normal charged polarity of the toner is included.

Further features of the present invention will become apparent from the following description of exemplary embodiments with reference to the attached drawings.

DESCRIPTION OF THE EMBODIMENTS

First Embodiment

Figure 1:
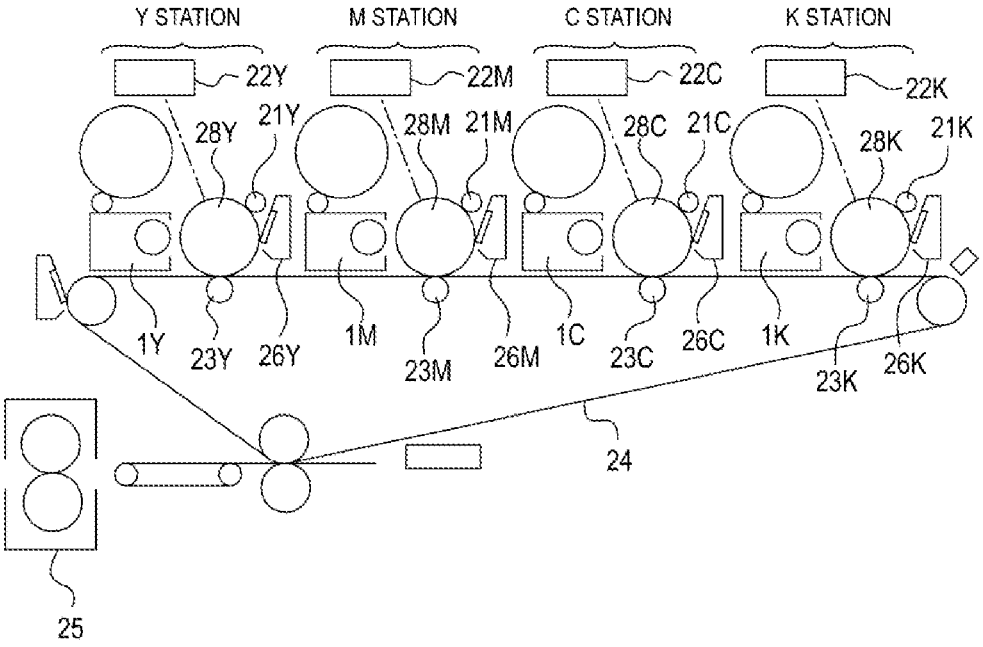
FIG. 1 is a schematic diagram of an image forming apparatus using a development device.

A first embodiment of the present invention will be described. FIG. 1 is a schematic diagram of an image forming apparatus using a development device.

As illustrated in FIG. 1, in this embodiment, in order to form a toner image of each color, a plurality of drum cartridges is arranged in parallel in correspondence with four colors including yellow, magenta, cyan, and black. Each of the drum cartridges includes a photosensitive drum 28 (image bearing member). A station for forming an image of each color, which includes the drum cartridge, is configured.

Toner images formed on the photosensitive drums 28 of the stations are primarily transferred onto an intermediate transfer belt 24 and then, are transferred (secondarily transferred) together onto an intermediate transfer belt such that four colors overlap each other. Thereafter, pressing and heating are performed by a fixing portion 25. In this way, a full-color image is acquired.

In description presented below, each part denoted by using only a numeral with a reference sign Y, M, C, or K being omitted is a part that is common to the drum cartridges of yellow, magenta, cyan, and black illustrated in FIG. 1.

A toner image generating operation performed in each drum cartridge will be described. First, the surface of the photosensitive drum 28 of ϕ30 mm charged by a primary charger 21 is exposed using a laser beam emitted from an exposure portion 22. Accordingly, an electrostatic latent image is formed on the photosensitive drum 28.

Next, the electrostatic latent images are developed by supplying toner from a development device 1 (development apparatus) thereto, whereby toner images are acquired. The toner images are transferred to the intermediate transfer belt 24 in a multiplexed manner by the primary transfer roller 23. In addition, residual toner remaining on the photosensitive drum 28 after the transfer process is removed by cleaning device 26.

Figure 2:
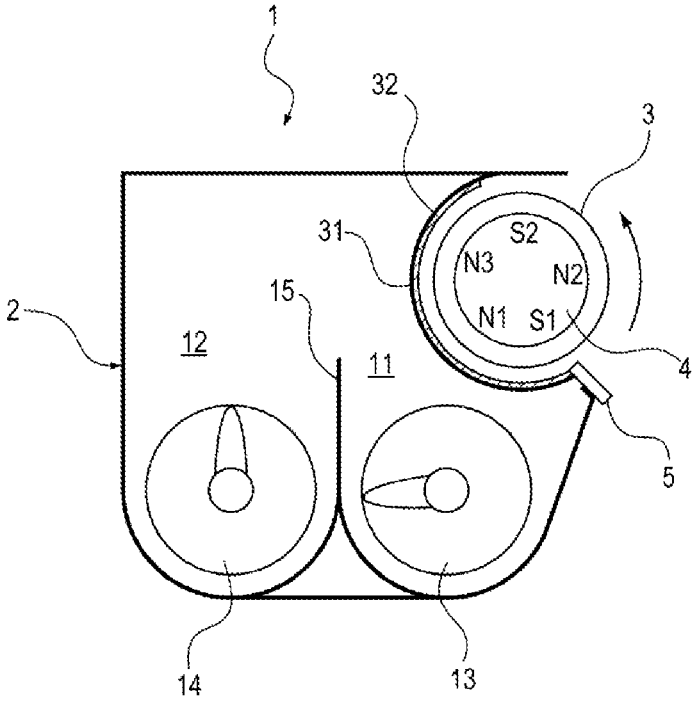
FIG. 2 is a schematic configuration diagram of a development device according to a first embodiment.

FIG. 2 is a schematic configuration diagram of a development device according to a first embodiment. The development device 1 according to the first embodiment will be described in detail with reference to FIG. 2. The development device 1 is used as a full-color image forming apparatus of a so-called tandem system.

As illustrated in FIG. 2, the development device 1 includes: a developing container 2 that houses two-component developer; and a developing sleeve 3 (developer bearing member) of ϕ20 mm in an opening portion thereof.

The developer of this embodiment is used by a two-component developing system as the developing system and a mixture of non-magnetic toner having negative charging polarity and magnetic carriers together. The non-magnetic toner is acquired by including a coloring agent, a wax component, and the like in a resin such as polyester or styrene acryl and forming a resultant resin into powders through a grinding process or a polymerization process. The magnetic carriers are acquired by applying a resin coat to the surface layer of a core formed by resin particles acquired by kneading ferrite particles or magnetic powders. In this embodiment, the toner density (the weight ratio of toner to the developer) of the developer that is in the initial state is 8%.

The developing sleeve 3 is arranged to be rotatable inside the development device 1. A part of the developing container 2 that faces the photosensitive drum 28 is open and is arranged such that the developing sleeve 3 is partly exposed from the opening portion (see FIG. 2).

The developing sleeve 3 is configured using a non-magnetic material and includes a fixed magnet roller 4 (magnetic field generation member) including a plurality of magnetic poles therein. The developing sleeve 3 rotates in a direction denoted by an arrow in the figure and conveys developer adsorbed at the position of the draw-up pole N1 in the direction of a blade 5.

The developer napped by the pole S1 receives a shearing force by the blade 5, and the amount thereof is regulated. When the developer passes through a gap between the developing sleeve 3 and the blade 5, a developer layer having a predetermined thickness is formed on the developing sleeve 3. The developer layer is carried and conveyed in a developing area facing the photosensitive drum 28 and, in the state in which a magnetic brush is formed by the pole N2, is supplied to the electrostatic latent images formed on the surface of the photosensitive drum 28. Accordingly, the electrostatic latent images are developed.

The developer after being supplied to the developing process is peeled off from the developing sleeve 3 by a low magnetic field area arranged between the peel-off pole N3 (first pole) and the draw-up pole N1 (second pole) that have the same polarity and are adjacent to each other.

The developing container 2 is divided into a developing chamber 11 (first developer housing chamber) and a stirring chamber 12 (second developer housing chamber) by the partition wall 15. Each of the developing chamber 11 and the stirring chamber 12 is configured to have an inner diameter of ϕ30 mm and extends along the direction of the rotation shaft of the developing sleeve 3. Both ends of the partition wall 15 are not configured to reach both end-portion side walls of the inside of the developing container 2 in the longitudinal direction, and thus, a communication portion that allows the passage of developer is formed between the developing chamber 11 and the stirring chamber 12.

In the developing chamber 11 and the stirring chamber 12, a first screw 13 (first circulation conveyance member) and a second screw 14 (second circulation conveyance member) that circulate developer between the developing chamber 11 and the stirring chamber 12 are included.

Each of the first screw 13 and the second screw 14 is configured to have a screw shaft diameter of ϕ8 mm, a screw blade diameter of ϕ20 mm, and a gap between blades of 20 mm. Each of the developing sleeve 3, the first screw 13, and the second screw 14 rotates at the speed of 400 rpm. According to the rotation of the first screw 13 and the second screw 14, the developer is mixed and stirred while circulating the inside of the developing container 2.

The developing sleeve 3, the first screw 13, and the second screw 14 are connected and driven by a gear train not illustrated in the figure and rotate by receiving a driving force from a development device driving gear not illustrated in the figure.

The partition wall 15 approaches the developing sleeve 3 near a non-magnetic force zone of the developing sleeve 3. After the developer disposed on the developing sleeve 3 is peeled off by the pole N3, the developer is housed in the developing chamber 11.

Figure 3:
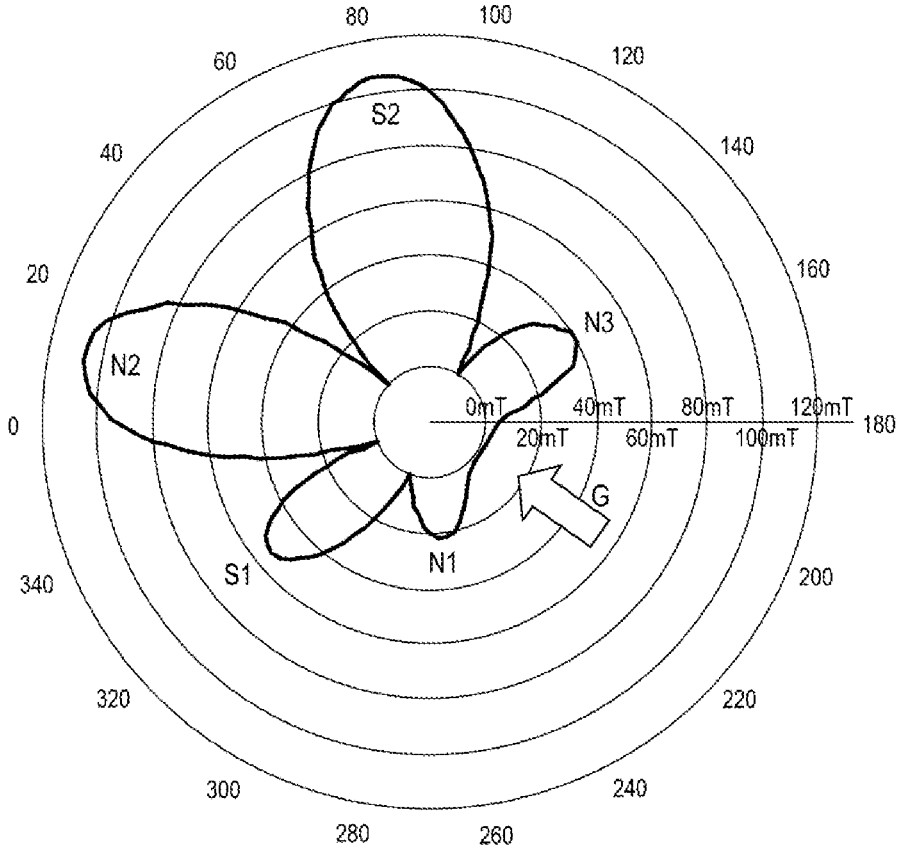
FIG. 3 is a diagram that illustrates a magnetic flux density of a magnetic field generation member according to the first embodiment in the sectional direction.

Next, the characteristics of the magnet roller 4 according to this embodiment will be described with reference to FIGS. 3 and 4. FIG. 3 is a diagram that illustrates the magnetic flux density of the magnetic field generation member according to the first embodiment in the sectional direction.

Generally, in the case of a magnet roller configured by an odd number of magnetic pole peaks, since the peel-off pole N3 (first magnetic pole) and the draw-up pole N1 (second magnetic pole) have the same polarity, a low magnetic field area (minimum area G) of the magnetic force (magnetic flux density) is generated between these both poles. Alternatively, a repulsive magnetic field may be generated according to a repulsive force between both the poles. In addition, in this embodiment, while the peel-off pole N3 and the draw-up pole N1 are poles that have the same polarity and are adjacent to each other, there are cases where an extremely-small unlike pole is generated between the peel-off pole N3 and the draw-up pole N1. In this embodiment, it is assumed that magnetic poles having the same polarity are adjacent to each other, including such a case.

In a case where the low magnetic field area or the magnetic force of the repulsive magnetic field is large, the peeling-off property of the developer carried on the developer bearing member after the developing process is degraded, and there is concern that an image defection such as a density decrease due to the developer that has not been peeled off from the developer bearing member may occur.

Accordingly, in the magnet roller 4 of this embodiment, a low magnetic field area is included in which a magnetic force measured at a circumferential face that approximately coincides with the outer peripheral face of the developer bearing member is 10 mT or less. In addition, the area in which the magnetic force of the low magnetic force zone of 10 mT or less is generated is formed to be flat. Accordingly, the peeling-off property of the developer is improved. In addition, by defining a magnetic force distribution of the magnet roller 4 in the longitudinal direction in the low magnetic field area as below, the wraparound of the developer to the outside of the low magnetic field area is suppressed. As a result, a configuration capable of suppressing the leakage of the developer without using a magnetic seal is formed.

Figure 4A:
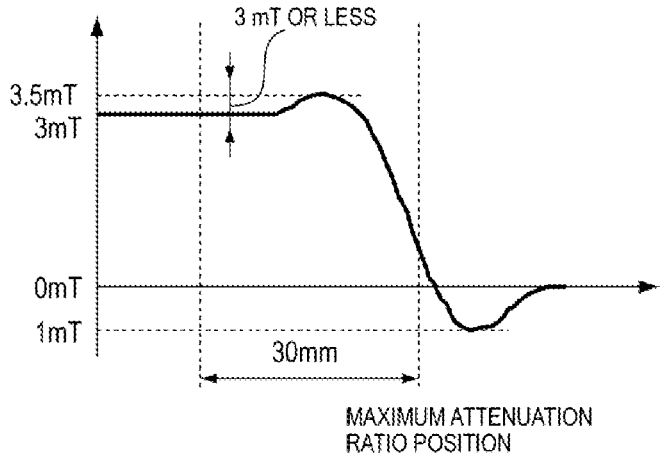
FIGS. 4A and 4B are diagrams that illustrate magnetic flux densities near longitudinal-direction end portions of low magnetic field areas of magnetic field generation members.
Figure 4B:
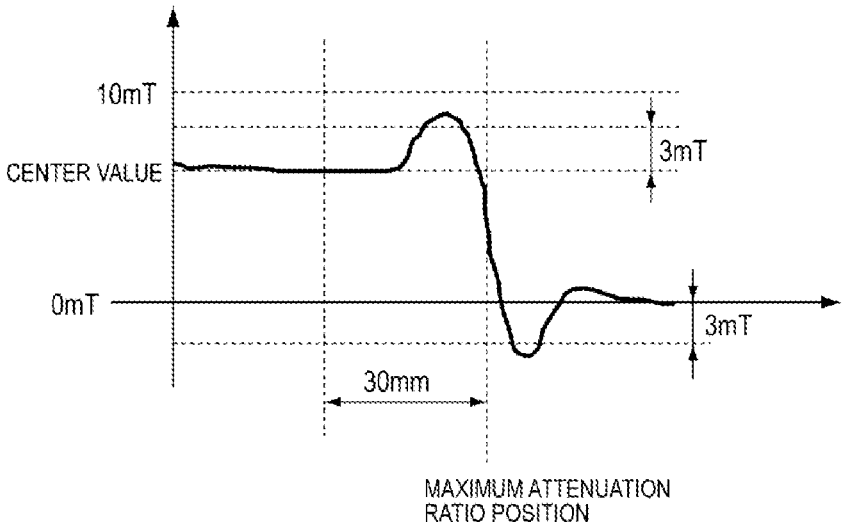

FIGS. 4A and 4B are diagrams that illustrate magnetic flux densities near longitudinal-direction end portions of low magnetic field areas of magnetic field generation members. FIG. 4A is a diagram that illustrates the case of the magnet according to this embodiment, and FIG. 4B is a diagram that illustrates the case of a magnet of a comparative example.

In addition, the magnet roller 4 defines magnetic force characteristics in the longitudinal direction as below. This will now be described. First, in the peripheral direction of the developer bearing member, for a low magnetic field area in which the magnetic flux density is minimal between the peel-off pole and the draw-up pole, a magnetic flux density distribution of the longitudinal direction of the developer bearing member is defined. The elevation of the magnetic force in the end portion of the minimum area of the magnet roller 4 according to this embodiment is defined as follows.

A magnetic force distribution of the longitudinal direction of the developer bearing member at positions at which the magnetic flux density of the low magnetic field area is minimal in the peripheral direction of the developer bearing member is as follows. A difference between a maximal magnetic flux density in a range from a maximum position, at which the attenuation rate of the magnetic flux density is maximal, to a position 30 mm distant therefrom toward the center side of the developer bearing member and a magnetic flux density of the further center side of the developer bearing member than the range is 3 mT or less. In addition, the absolute value of the magnetic flux density of the further outer side than the maximum position in the longitudinal direction of the developer bearing member is 3 mT or less.

In addition, the magnetic force inversion in the end portion of the magnet roller 4 is defined as follows. From a position at which the attenuation rate of the magnetic flux density is maximal in the end portion of the longer side of the magnetic field generation area, in the magnetic field generation area located on a side opposite to the center of the longer side, when the same polarity or the opposite polarity of the magnetic field is generated, the absolute value of the magnetic flux density is within 3 mT. Here, the magnetic flux density of the center portion of the longer side represents an average of the magnetic flux densities of an area located to the inner side than the end portion.

In this way, in a case where the above-described magnetic characteristics are satisfied, the magnetic force distribution of the low magnetic field area (repulsive magnetic field area) that is formed in the longitudinal direction has the same magnetic field characteristics. For this reason, unlike a conventional case, the developer can be suppressed from leaking due to an influence of the magnetic force of the end portion in the longitudinal direction in the low magnetic field area. Meanwhile, in the peripheral direction of the magnet roller 4, in an area other than the area disposed between the peel-off pole and the draw-up pole, basically, the magnetic force of the center side of the developer bearing member is high, and accordingly, a situation is formed in which it is difficult for the developer to leak from the end portion of the developer bearing member.

In the measurement of a magnetic flux density according to this embodiment, a value measured at a position 100 μm distant from the surface of the developing sleeve is represented as a magnetic force. In addition, for the measurement of the peripheral direction, measurement is performed for a total of three positions including the center of the longer side of the magnet roller 4 and positions 2 cm distance from both end portions of the longer side toward the center side. For the measurement of the longitudinal direction, measurement is performed for the entire area of the longer side of the developing sleeve 3.

Figure 5:
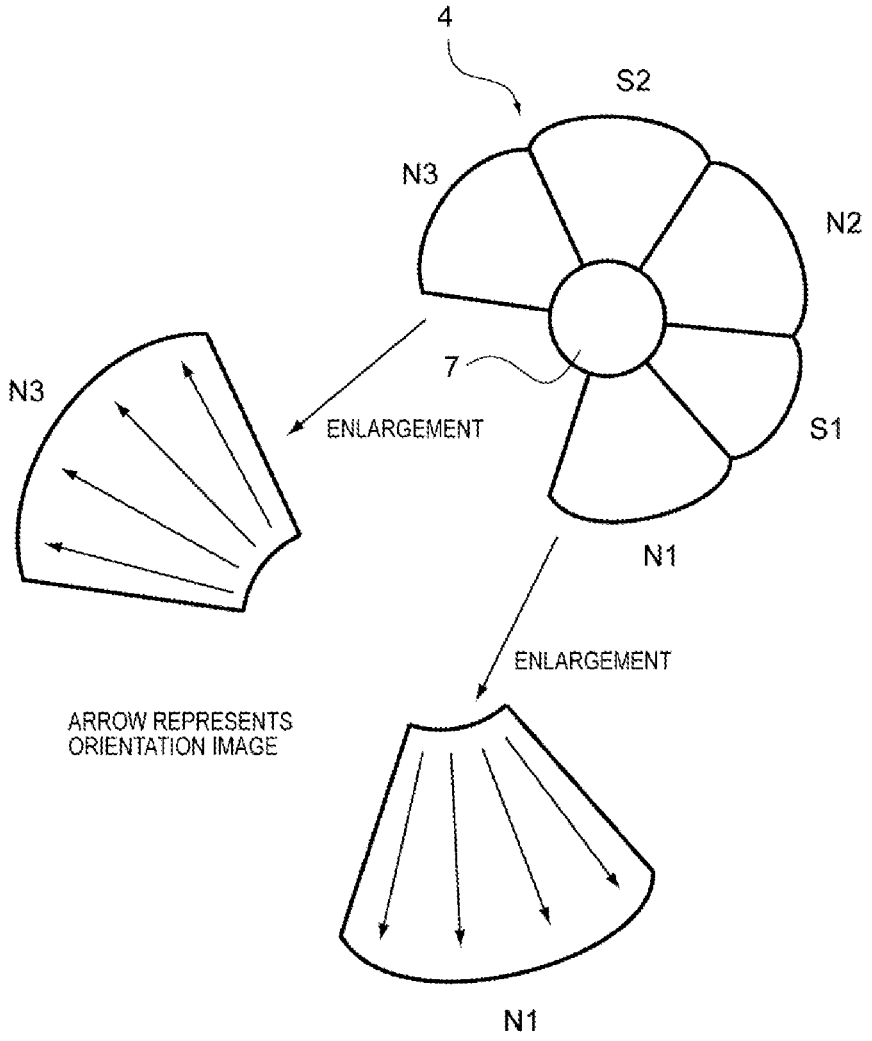
FIG. 5 is a schematic diagram of a magnet roller according to the first embodiment.

Next, the configuration of the magnet roller 4 according to this embodiment and a manufacturing method thereof will be described in detail. FIG. 5 is a schematic diagram of the magnet roller according to the first embodiment. As illustrated in FIG. 5, the magnet roller 4 is configured by five magnet pieces.

When the magnet roller 4 is to be manufactured, first, ferrite powders, NdFeB-based magnetic powders, or the like are used as magnetic powders, and an epoxy resin or a nylon resin as a binder is mixed therewith. The kneaded material thereof is molded into a bar shape having an approximately fan-shaped cross-section and then, is magnetized (formed as a so-called bonded magnet assembly) and is used as magnet pieces configuring magnets other than the draw-up pole N1 and the peel-off pole N3, illustrated in FIG. 5, in other words, the conveyance pole S1, the development pole N2, and the collection pole S2. For each magnet piece, magnetic powders and a binder may be selected appropriately according to the required characteristics.

In addition, as the magnetic powders, magnetic anisotropic ferrite powders (anisotropic Sr ferrite, anisotropic Ba ferrite, or the like) are used, and rubber (nitrile rubber, chloroprene rubber, silicone rubber, or the like) as the binder are mixed therewith. The kneaded material thereof is extruded to be molded into a bar shape having an approximately fan-shaped cross-section in a magnetic field and then, is magnetized and is used as magnet pieces configuring the draw-up pole N1 and the peel-off pole N3 that are located on both sides of the gap.

The orientation of the magnetization of the magnetic powders of this case, as denoted by arrows in FIG. 5, is in the directions of the diameters of the magnet pieces of the draw-up pole N1 and the peel-off pole N3. In other words, the orientation is in a radiation direction from the inner peripheral face to the outer peripheral face. In an area located near a side face facing a gap between the draw-up pole N1 and the peel-off pole N3, the magnetization direction of the magnetic powders follow the side face.

However, the orientation of the magnetization of the magnetic powders may be within an angle range from a direction parallel to the side face of the magnet pieces to a direction parallel to the diameter direction of the center portion of the magnet pieces of the draw-up pole N1 and the peel-off pole N3. Then, each magnet piece is attached to the outer periphery of a shaft 7 such that a gap is arranged between the draw-up pole N1 and the peel-off pole N3. The shaft 7, generally, is a magnetic body such as iron.

Figure 6B:
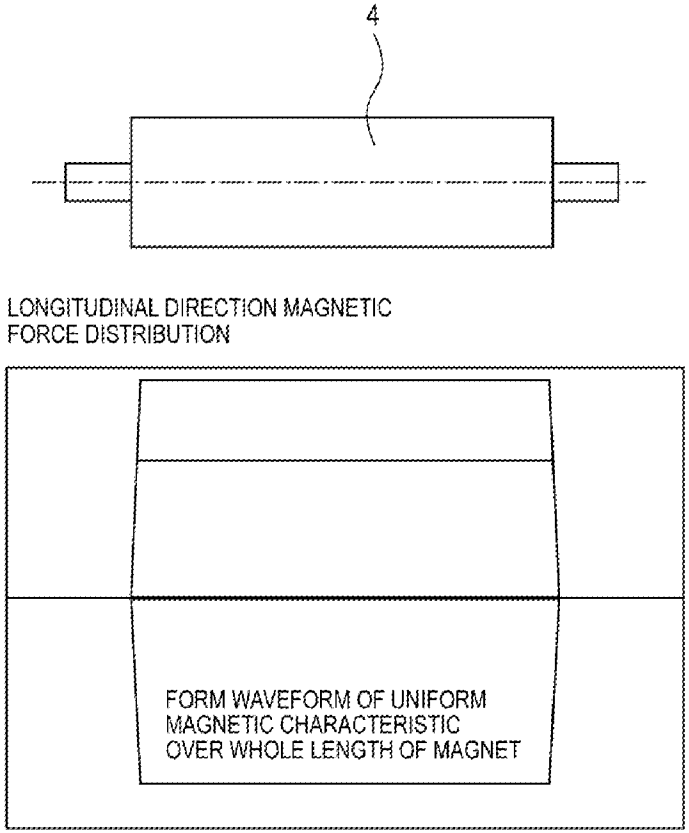
FIGS. 6A and 6B are diagrams that illustrate magnetic force distributions of the magnet roller according to the first embodiment.
Figure 6A:
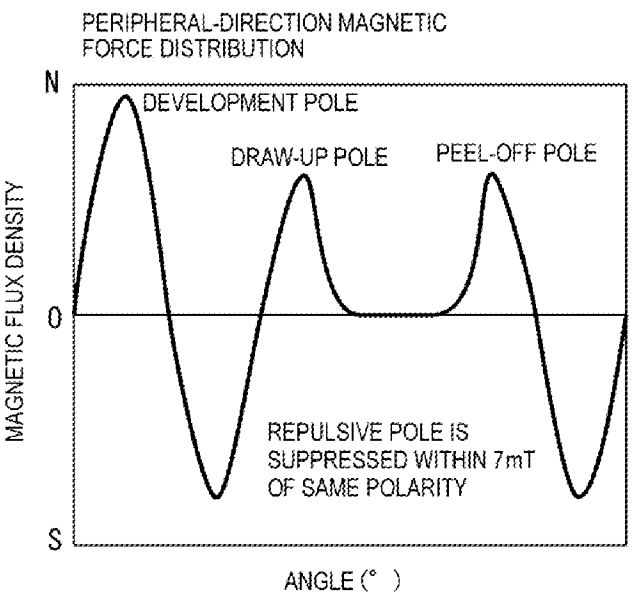

FIGS. 6A and 6B are diagrams that illustrate magnetic force distributions of the magnet roller according to the first embodiment. A magnetization pattern acquired when the surface magnetic force of the magnet roller 4 is measured along the circumferential direction, in other words, along the circumferential face corresponding to the cylindrical sleeve housing the magnet roller 4 will be described with reference to FIGS. 6A and 6B.

FIG. 6A is a magnetic force distribution of the peripheral direction (here, the surface magnetic flux density is measured in the right-handed (clockwise) direction). As illustrated in FIG. 6A, a magnetic force between the pulling pole N1 and the peel-off pole N3 can be decreased to be 10 mT or less (7 mT or less in the example illustrated in the figure) and forms a flat pattern.

FIG. 6B is a magnetic force distribution of the longitudinal direction of the magnet roller 4 in a low magnetic field area in a gap portion between the pulling pole N1 and the peel-off pole N3. As illustrated in FIG. 6B, a variation in the magnetic force characteristics in the longitudinal direction is small, and the variation can be suppressed to be 3 mT or less.

In this embodiment, while the magnet roller 4 as described above is used, the present invention is not limited thereto. Any magnet manufactured using another manufacturing method may be used, as long as the magnet suppresses an elevation of the magnetic force in the end portion of the magnet roller.

Figure 7:
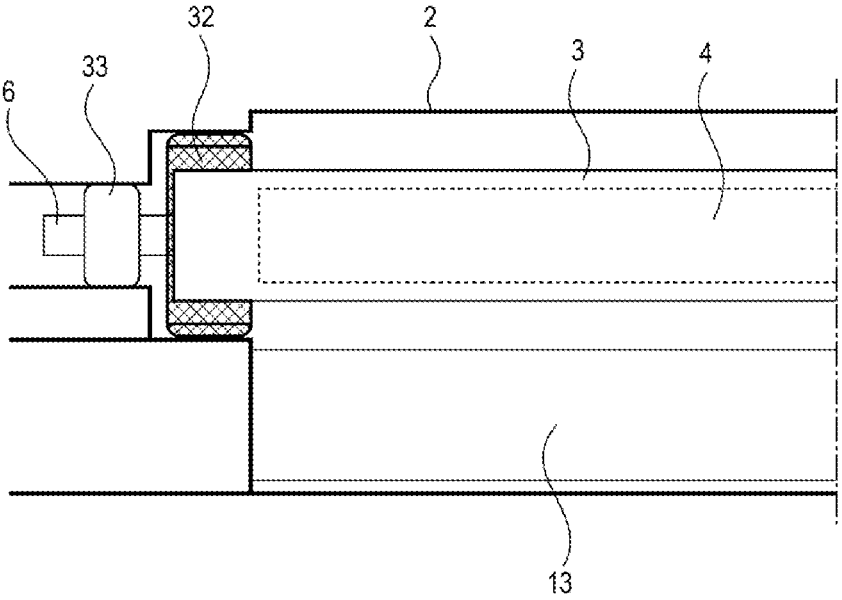
FIG. 7 is a schematic diagram of a developing sleeve peripheral structure according to the first embodiment.

FIG. 7 is a schematic diagram of a developing sleeve peripheral structure according to the first embodiment. In this embodiment, in an end-portion area of the developing container 2, as illustrated in FIGS. 2 and 7, a curvature portion 31 of the developing container 2 is arranged, and, at the position of the end portion of the developing sleeve 3, an electrostatic sealing member 32 (electric field formation member) that can form an electric field repelling the normal charged polarity of toner is arranged. It is preferable that the electrostatic sealing member 32 has a charging series charged with the same polarity as that of the toner and be a material charged with polarity higher than that of the toner. In addition, on the further outer side than the developing sleeve 3, a bearing 33 is attached to a rotation shaft 6 of the developing sleeve 3.

An attachment area of the electrostatic sealing member 32, as illustrated in FIG. 7, is an end-portion area of the developing sleeve 3 that is shifted from an area for conveying the developer. In addition, the attachment area of the electrostatic sealing member 32 does not cover the magnet roller 4 in the longitudinal direction of the developing sleeve 3.

The reason for this is as follows. In other words, in an area influenced by the magnetic force of the magnet roller 4, the developing sleeve 3 is coated with the developer. For this reason, when the electrostatic sealing member 32 and the developer are brought into contact with each other in the developer coated area, there is concern that the electrostatic sealing member 32 may be broken due to friction.

The toner used in this embodiment is negatively (negative polarity) charged. As the electrostatic sealing member 32, a tape-like member having a thickness of 100 μm is used. A gap between the developing container 2 and the developing sleeve 3 is 1 mm. For this reason, even when the tape of 100 μm is stretched, the sleeve 3 is not rubbed with the developing container 2.

When developer is put into the developing container 2, first, the toner enters also into the attachment area of the electrostatic sealing member 32. Then, since the electrostatic sealing member 32 is negatively charged immediately, between the electrostatic sealing member 32 and the developing sleeve 3, the toner receives a repulsive electric field from the electrostatic sealing member 32 having the same polarity.

Meanwhile, carriers disposed inside the developing container 2 are positively (positive polarity) charged. For this reason, the toner that is negatively charged is attracted by the carriers and is returned to the inside of the developing container 2.

As described in the description presented above, the developer that is peeled off from the developing sleeve 3 and falls into the low magnetic field area of the magnet roller 4 flies up inside the developing container 2. Thus, there is concern that the developer flying up in a space S (see FIG. 13) between the developing sleeve 3 and the developing container 2 may be spouted from the gap of the container.

In this embodiment, since the electrostatic sealing member 32 is attached to the curvature portion 31, the toner receives a repulsive electric field from the electrostatic sealing member 32 even when the time elapses. For this reason, the developer enters into the inside of the developing container 2 without being spouted from the space S between the developing sleeve 3 and the developing container 2 to the outside.

Accordingly, toner scattering from the end-portion area of the developing sleeve 3 can be suppressed, and a defect of putting scattering toner within an output image according to the elapse of time can be suppressed.

Second Embodiment

Figure 8:
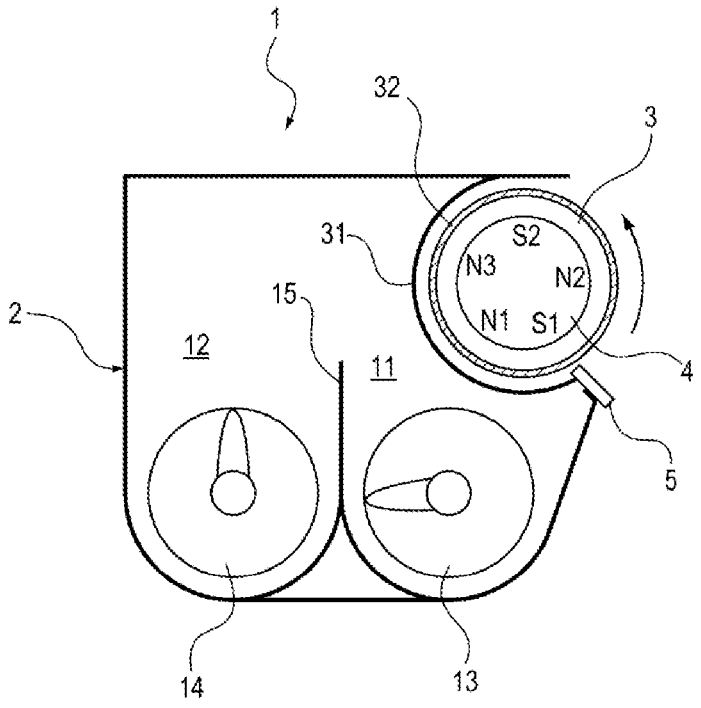
FIG. 8 is a schematic configuration diagram of a development device according to a second embodiment.

A second embodiment of the present invention will be described. The same reference numerals will be used for the same configuration as that described above, and description thereof will not be presented. FIG. 8 is a schematic configuration diagram of a development device according to a second embodiment.

In this embodiment, as illustrated in FIG. 8, in an end-portion area of a developing sleeve 3, an electrostatic sealing member 32 (electric field formation member) that can form an electric field repelling the normal charged polarity of toner is attached to the one-circulation entire face of the developing sleeve 3. Accordingly, advantages similar to those of the above-described embodiment can be acquired.

As an electrostatic sealing member 32, similar to that of the above-described embodiment, it is preferable that a member having a property of being charged with the same polarity as that of the toner and having an improved charging characteristic be used. Also in this embodiment, the electrostatic sealing member 32 that has a tape shape and has a thickness of 100 μm is used.

Figure 9:
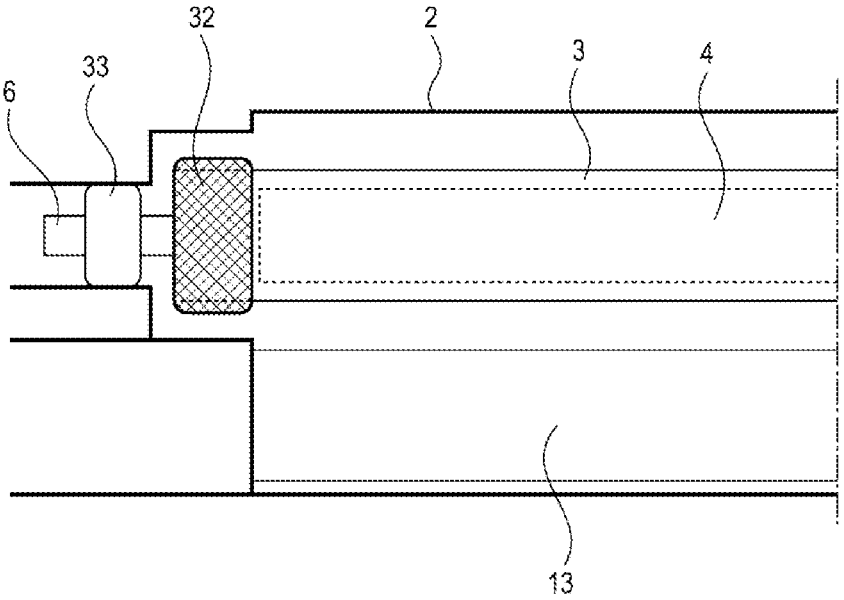
FIG. 9 is a schematic diagram of a developing sleeve peripheral structure according to the second embodiment.

FIG. 9 is a schematic diagram of a developing sleeve peripheral structure according to the second embodiment. FIG. 9 illustrates the longitudinal-direction arrangement in an end-portion area of the developing sleeve 3. Also in this embodiment, the electrostatic sealing member 32 is attached to an end-portion area of the developing sleeve 3 in which the magnet roller 4 is not present. In this embodiment, the electrostatic sealing member 32 is attached up to an area of 12 mm from the end portion of the developing sleeve 3 corresponding to one circulation of the developing sleeve 3.

According to the configuration of this embodiment, similar to the above-described embodiment, toner scattering can be suppressed.

Third Embodiment

Figure 10:
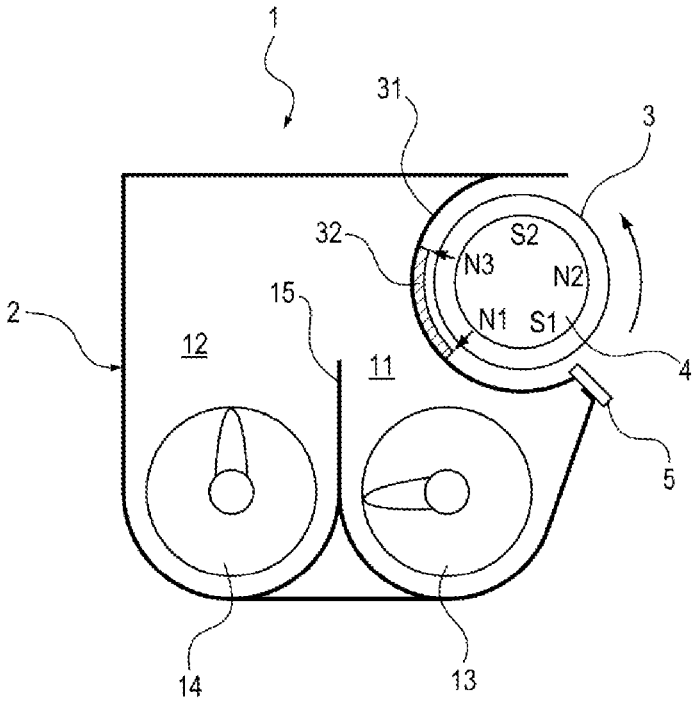
FIG. 10 is a schematic configuration diagram of a development device according to a third embodiment.

A third embodiment of the present invention will be described. The same reference numerals will be used for the same configuration as that described above, and description thereof will not be presented. FIG. 10 is a schematic configuration diagram of a development device according to the third embodiment.

In the first embodiment, the electrostatic sealing member 32 is attached to the entire face of the curvature portion 31 of the developing container 2 that faces the end-portion area of the developing sleeve 3. In contrast to this, in this embodiment, as illustrated in FIG. 10, in a low magnetic field area between a peel-off pole N3 that peels off developer from a developing sleeve 3 and a draw-up pole N1, an electrostatic sealing member 32 (electric field formation member) that can form an electric field repelling the normal charged polarity of toner is disposed. The reason for this is that toner scattering may easily occur in the low magnetic field area.

In this way, toner scattering from the end portion can be effectively suppressed. In this embodiment, while the peel-off pole N3 and the draw-up pole N1 are poles that have the same polarity and are adjacent to each other, between the peel-off pole N3 and the draw-up pole N1, an extremely small like pole may be generated. In this embodiment, it is assumed that magnetic poles having the same polarity are adjacent to each other, including such a case.

An area in which the electrostatic sealing member 32 is disposed is an area from a position at which the vertical-direction magnetic flux density of the peel-off pole N3 is maximal to a position at which the vertical-direction magnetic flux density of the draw-up pole N1 is maximal.

In this way, the tape attachment area can be narrowed, and toner scattering can be suppressed more efficiently.

Fourth Embodiment

Figure 11:
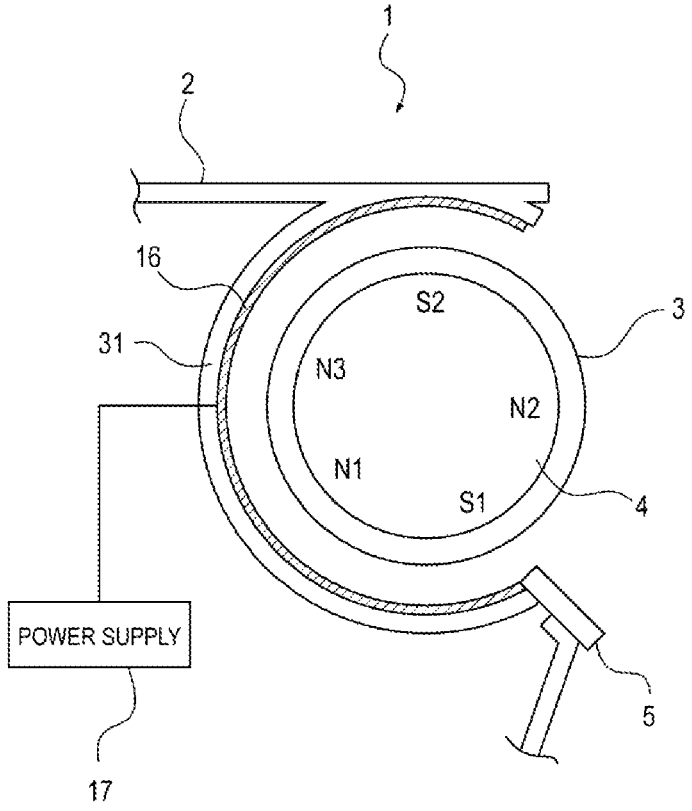
FIG. 11 is an enlarged diagram of the developing sleeve periphery of a development device according to a fourth embodiment.

A fourth embodiment of the present invention will be described. The same reference numerals will be used for the same configuration as that described above, and description thereof will not be presented. FIG. 11 is an enlarged diagram of the developing sleeve periphery of a development device according to the fourth embodiment. FIG. 11 illustrates a cross-section, which is vertical to the rotation shaft of a developing sleeve 3, of an end portion of the longer side of the development device 1.

In a curvature portion 31 of a developing container 2 that faces the developing sleeve 3, an electrode 16 (electric field formation member) that can form an electric field repelling the normal charged polarity of toner is disposed so as to cover the developing sleeve 3.

Figure 12:
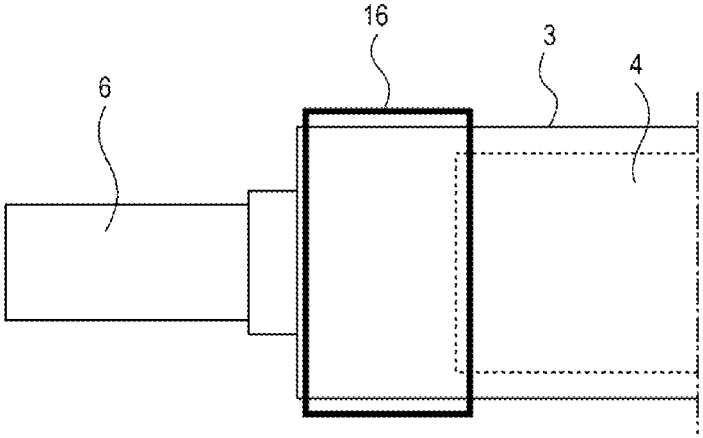
FIG. 12 is a diagram of an end portion of a longer-side of the development device according to the fourth embodiment.

An area in which the electrode 16 is disposed will now be described in detail. FIG. 12 is a diagram of an end portion of the longer-side of the development device according to the fourth embodiment. FIG. 12 illustrates a cross-section, which is parallel to the shaft of the developing sleeve 3, of the end portion of the longer side of the development device 1 viewed from a side opposite to a photosensitive drum 28. While one end portion of the longer side of the development device 1 is illustrated in FIG. 12, the other end portion not illustrated in the figure has the same configuration, and thus, description thereof will not be presented.

In this embodiment, in an area arranged in the peripheral direction, while the electrode 16 is disposed in the entire area on the side of the developing container 2 that faces the developing sleeve 3, the present invention is not limited thereto. By disposing the electrode such that at least an area in which developer is not borne near a low magnetic field area between the draw-up pole N1 and the peel-off pole N3 of the magnet roller 4 is included, advantages of this embodiment can be acquired.

As illustrated in FIG. 12, the longitudinal-direction area of the electrode 16 is disposed to include the end portion of the developing sleeve 3 to the end portion of the magnet roller 4.

In addition, the area is not limited to such an area, and, in the longitudinal direction of the electrode 16, and the area may be disposed such that at least an area overlapping an area in which developer is carried is present on the developing sleeve 3. In a range not deviating from the above-described area, since the longitudinal-direction area may be freely set, in a case where one end thereof is set to overlap the developer bearing area, the other end may extend from the end portion of the developing sleeve 3 or may be shortened.

Subsequently, a voltage applied to the electrode 16 will be described in detail. As illustrated in FIG. 12, the electrode 16 is connected to a voltage power supply 17. A voltage VA applied from the voltage power supply 17 to the electrode 16 is set such that VA=−700 V. In addition, while the development device 1 is driven, the voltage VA is configured to be applied.

The voltage VA is set such that a potential difference ΔV (=VA−VS) with respect to the voltage VS applied to the developing sleeve 3 facing the electrode 16 has the same polarity as the charged polarity of toner. Accordingly, an action of scattering toner repelling the electrode 16 is worked.

In this embodiment, toner that is charged negatively (negative polarity) is used. When the development device 1 is driven, since a voltage VS=−400 V is applied to the developing sleeve 3, ΔV=−300 V. In such a case, since the electrode 16 applies a repellent force to scattering toner, the scattering toner can be suppressed from leaking to the outside of the development device 1.

The timing at which the voltage VA is applied to the electrode 16 and the magnitude of the voltage VA are not limited to those of this embodiment. As described above, the application of the voltage VA is for the purpose of applying a repellent force to the toner. For this reason, the application of the voltage may be freely set in a range in which the advantages of this embodiment are acquired.

For example, also in a case where the potential difference ΔV is not −300 V, as the absolute value of the potential difference ΔV increases, a repellent force applied to the toner increases. In addition, in a case where the charging amount of the toner is large, an advantage of preventing the scattering is sufficiently acquired also when the potential difference ΔV is small. Thus, the potential difference ΔV may be changed each time depending on used developer and environments.

In addition, when toner that is positively charged (positive polarity) is used, it is necessary to also set the value of the potential difference ΔV to a positive value. In other words, the matching of the positive/negative polarity of the potential difference ΔV is the most important, and, when the polarity matches the charged polarity of the toner, the positive/negative matching of the values of the voltages VA and VS does not matter.

In addition, in a case where the voltage VS applied to the developing sleeve 3 is acquired by overlapping AC with DC, by using the DC component or an average value thereof as the voltage VS, the voltage VA and the potential difference ΔV may be determined.

Furthermore, regarding the timing at which the voltage VA is applied to the electrode 16, it is preferable that the voltage be applied at least while the development device 1 is driven. However, the present invention is not limited thereto, but the voltage VA may be applied in the middle of stopping of driving of the development device 1.

Figure 13A:
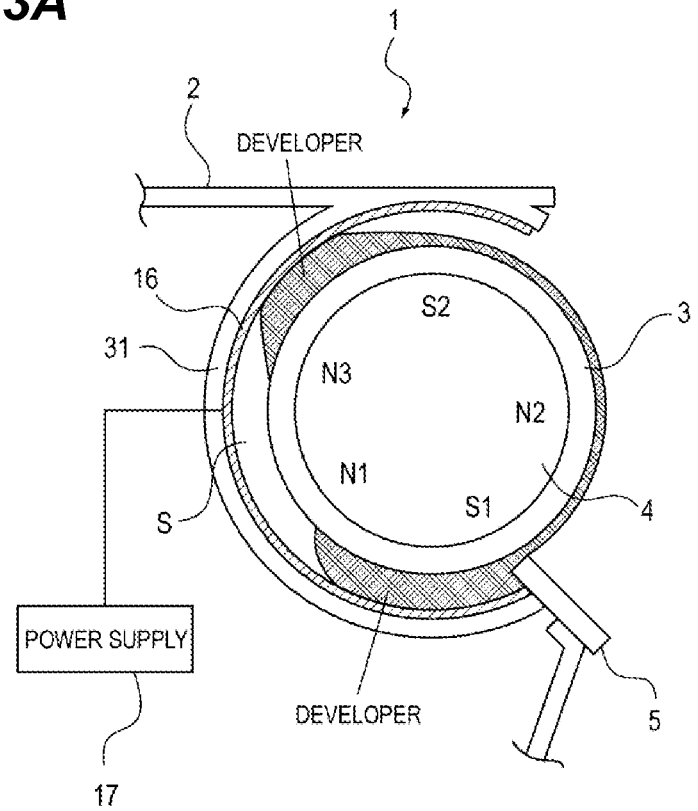
FIGS. 13A and 13B are schematic diagrams that illustrate effects of the fourth embodiment.
Figure 13B:
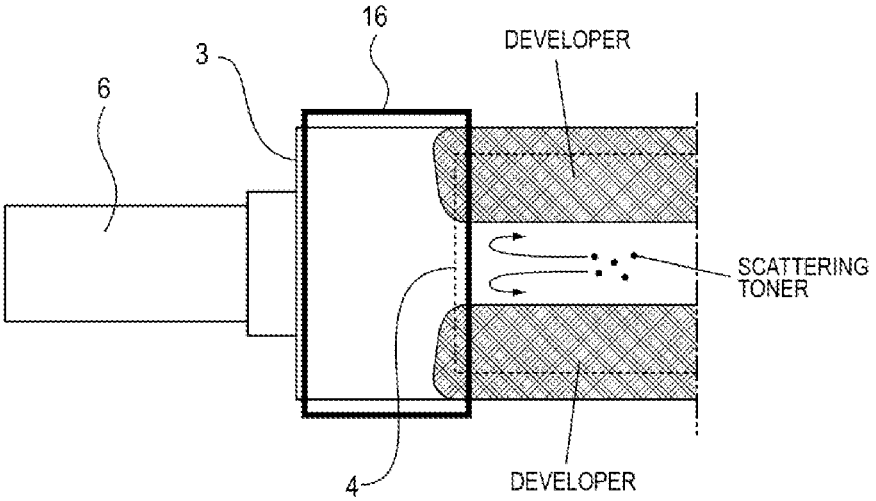

Next, the effects of the electrode 16 will be described with reference to FIGS. 13A and 13B. FIGS. 13A and 13B are schematic diagrams that illustrate the effects of the fourth embodiment, FIG. 13A is a cross-sectional view, and FIG. 13B is a bottom view. As illustrated in FIGS. 13A and 13B, a space S is generated between the developing container 2 and the developing sleeve 3.

The magnet roller 4 using this embodiment has a magnetic force of 10 mT or less in the low magnetic field area and has a variation in the magnetic characteristics of the longitudinal direction of 3 mT or less. Thus, as illustrated in FIG. 13, a space S is generated between the developing container 2 and the developing sleeve 3.

Here, near the space S, an electrode 16 is included, and a voltage having the same polarity as the charged polarity of the toner is applied from a voltage power supply 17 to the electrode 16. For this reason, an action repelling the toner is maintained. Thus, as illustrated in FIG. 13B, scattering toner is returned in a direction in which the developer is present according to the electric potential having the same polarity applied to the electrode 16.

For this reason, the scattering toner drifting about inside the developing container 2 arrives at the end portion of the developing sleeve 3, and, even when the toner comes out from the space S surrounded by the developing sleeve 3, the developing container 2, and the developer, the scattering toner can be suppressed from flying to the outside of the developing container 2.

Fifth Embodiment

Figure 14B:
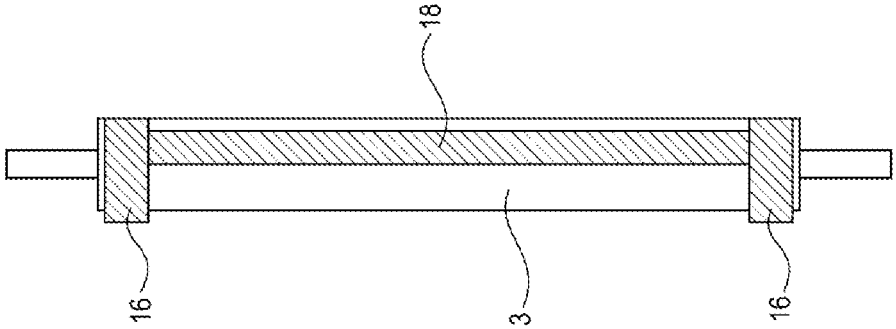
FIGS. 14A and 14B are schematic diagrams of the developing sleeve periphery of a development device according to a fifth embodiment.
Figure 14A:
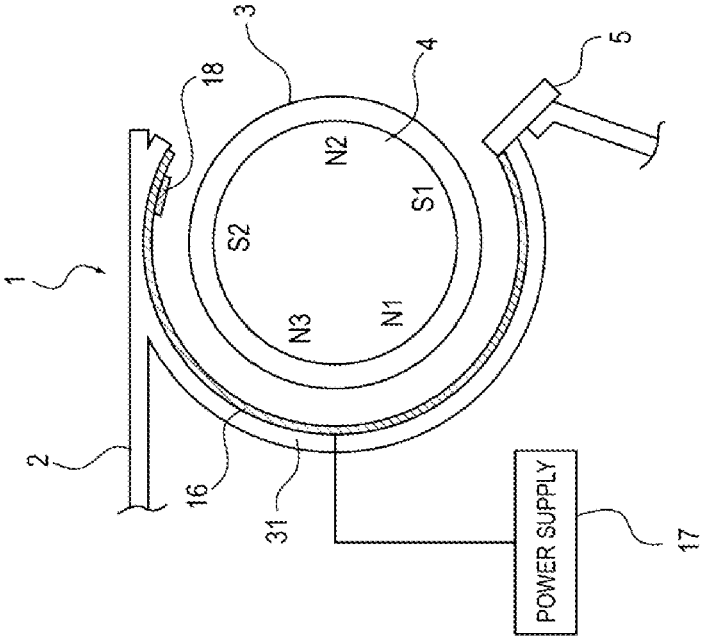

A fifth embodiment of the present invention will be described. The same reference numerals will be used for the same configuration as that described above, and description thereof will not be presented. FIGS. 14A and 14B are schematic diagrams of the developing sleeve periphery of a development device according to a fifth embodiment. FIG. 14A is a cross-sectional view of a developing sleeve 3, and FIG. 14B is a longitudinal-direction top view of the developing sleeve 3.

As illustrated in FIGS. 14A and 14B, in this embodiment, in both end portions of a developing container 2 on the curvature portion 31 side, which face end portions of the developing sleeve 3, similar to the fourth embodiment, electrodes 16 (electric field formation members) that can form electric fields repelling the normal charged polarity of toner are arranged. In addition, a voltage power supply 17 that applies a voltage to the electrodes 16 is arranged. This embodiment has a feature of connecting the electrodes 16 disposed in both end portions to a new long electrode 18.

As illustrated in FIG. 14A, the long electrode 18 is disposed to extend from the curvature portion 31 of the developing container 2 that faces the developing sleeve 3.

In this way, when the electrodes 16 disposed in both end portions are connected by using the long electrode 18, all the openings of the developing container 2 from which scattering toner may come out are covered with the electrodes. Thus, the scattering toner can be more effectively suppressed from coming out to the outside of the developing container 2.

In this way, according to each of the first to fifth embodiments, even in a case where a magnetic seal is not arranged in an end portion of the developer bearing member, there is provided a development apparatus capable of suppressing toner scattering while suppressing a developer leakage according to the stay of the developer in the end portion of the developer bearing member.

Sixth Embodiment

A schematic configuration of an image forming apparatus according to this embodiment is similar to that of the first embodiment described with reference to FIG. 1, the same reference numerals are assigned to the same configuration, and description thereof will not be presented.

Figure 15:
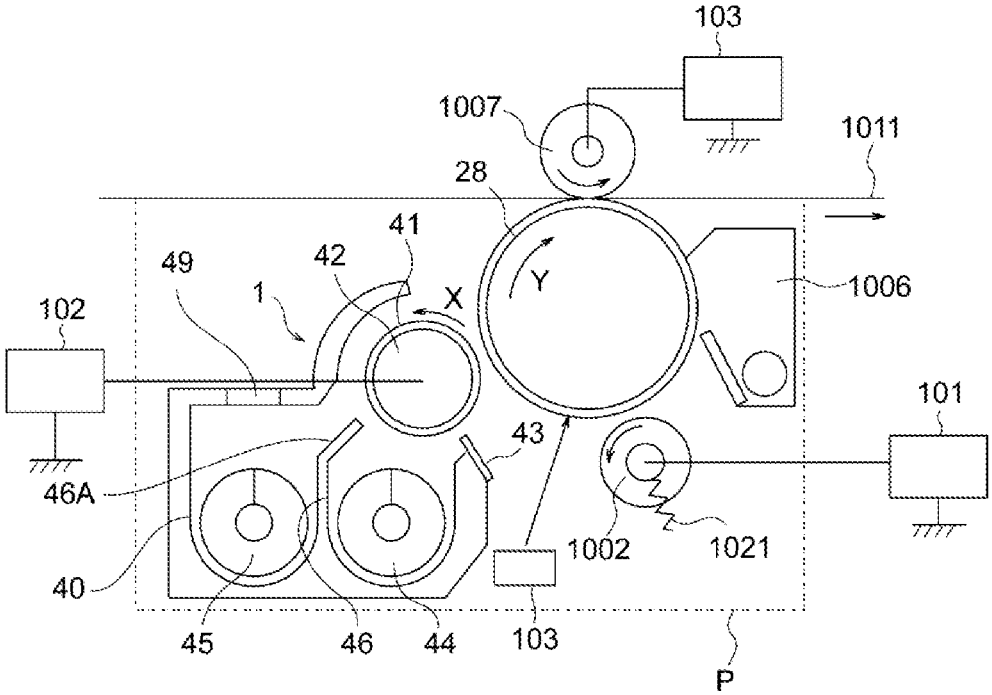
FIG. 15 is a diagram that illustrates a process cartridge according to a sixth embodiment and the peripheral configuration thereof.

FIG. 15 is a diagram that illustrates a process cartridge according to a sixth embodiment and the peripheral configuration thereof. As illustrated in FIG. 15, in each process cartridge P, a photosensitive drum 28 (image bearing member), a charging roller 1002, a development apparatus 1, and a cleaning device 1006 are included. In addition, in the image forming apparatus main body, an exposure device 1003 and a primary transfer unit 1007 are included. Furthermore, an intermediate transfer belt 1011 (intermediate transfer body) is arranged to be movable in a direction denoted by an arrow so as to pass between the photosensitive drum 28 of the process cartridge P and the primary transfer unit 1007.

The exposure device 1003 is arranged below the image forming apparatus and includes a light source device and a polygon mirror that are not illustrated in the figure. The exposure device 1003 scans a laser beam emitted from the light source device by rotating the polygon mirror, deflects luminous fluxes of the scanning light by using a plurality of reflection mirrors, and collects the luminous fluxes into a generating line of the photosensitive drum 28 by using a lens fθ so as to expose the photosensitive drum. Accordingly, an electrostatic latent image according to an image signal is formed on the photosensitive drum 28.

In the development apparatus 1, a predetermined amount of developer is filled. In the developer, non-magnetic toner corresponding to the color of an image to be formed by each process cartridge P and magnetic carriers are mixed together at a predetermined mixing ratio.

The electrostatic latent images formed on the photosensitive drum 28 are sequentially developed using toner of corresponding colors of the development apparatus 1, whereby toner images are formed. These toner images are primarily transferred onto the intermediate transfer belt 1011. In addition, a transfer material S housed in a transfer material cassette 14 illustrated in FIG. 1 is conveyed to a secondary transfer device 12, and toner images of four colors carried on the intermediate transfer belt 1011 in an overlapping manner are secondarily transferred to the transfer material S. Thereafter, the toners images are fixed to the transfer material S by receiving heating and pressing at a fixing portion 9 and then are discharged to the outside of the apparatus as recording images.

In addition, on the downstream side of the intermediate transfer belt 1011 in the traveling direction from the secondary transfer position for the transfer material S, a cleaning blade 13 is constantly brought into contact with the surface of the intermediate transfer belt 1011. Accordingly, the cleaning blade 13 cleans fog toner, residual toner after the secondary transfer, and the like attached to the surface of the intermediate transfer belt 1011. Meanwhile, residual toner after the primary transfer and the like remaining on the photosensitive drum 28 are collected by a cleaning device 1006 illustrated in FIG. 15.

As illustrated in FIG. 15, the charging roller 1002 is held such that both end portions of the cored bar are configured to be freely rotatable by using a bearing member. In addition, the charging roller 1002 is biased toward the photosensitive drum 28 by a pressing spring 1021 and is pressed to be in contact with the surface of the photosensitive drum 28 with a predetermined pressing force. Accordingly, the charging roller 1002 rotates by being moved according to the rotation of the photosensitive drum 28.

To the cored bar of the charging roller 1002, a charging bias voltage of a predetermined condition is applied from a high voltage power supply 101. Accordingly, the surface of the rotating photosensitive drum 28 is processed to be charged through a contact with predetermined electric potential of predetermined polarity.

In this embodiment, the charging bias voltage for the charging roller 1002 is an oscillation voltage acquired by overlapping a DC voltage and an AC voltage with each other. More specifically, the charging bias voltage is an oscillation voltage acquired by overlapping a DC voltage of −500 V and a sinusoidal AC voltage having a frequency of 0.92 kHz and a peak-to-peak voltage Vpp=1.5 kV. According to this charging bias voltage, the surface of the photosensitive drum 28 is uniformly charged with −500 V (dark electric potential Vd) that is the same as the DC voltage applied to the charging roller 1002.

Here, the developer housed in the developing container 40 of the development apparatus 1 is two-component developer mainly containing non-magnetic toner (toner) and magnetic carriers (carriers).

The developer will now be described. As the non-magnetic toner, for example, particles acquired by kneading a pigment into a resin binder having polyester as its main body and grinding/classifying a resultant material may be appropriately used. The average particle diameter of the non-magnetic toner according to this embodiment is set to 6 μm in consideration of an image quality and the handleability. In addition, as is necessary, for the purpose of securing the mobility and the chargeability of the toner, silica, alumina, titania, organic resin particles, or the like may be added as external additives. Meanwhile, as the magnetic carriers, particles acquired by coating a core having ferrite as its main component with a silicone resin and having a 50% particle diameter (D50) of about 40 μm may be appropriately used.

In this embodiment, inside the developing container 40, such toner and carriers are mixed at the weight ratio of about 8:92, and developer, which has a toner density (a ratio of a toner weight to a total developer weight:TD ratio) of 8%, of 250 g is housed.

In the developing container 40, an opening portion is formed in an area facing the photosensitive drum 28. The developing sleeve 41 (developer bearing member) is rotatably arranged so as to be partly exposed from the opening portion.

The developing sleeve 41 is configured using a non-magnetic material, and a roughening process is performed for the surface thereof so as to carry and convey developer. In addition, on the inside thereof, a magnet 42 (magnetic field generation member) that is fixedly disposed.

In a developing operation, the developing sleeve 41 rotates in a direction (counterclockwise) denoted by an arrow X illustrated in FIG. 15, and the photosensitive drum 28 rotates in a direction (clockwise) denoted by an arrow Y. The rotating developing sleeve 41 regulates the layer thickness of developer on the developing sleeve 41 by using a regulation blade 43 (layer thickness regulation member). Thereafter, the developing sleeve 41 carries and conveys the developer of which the layer has been decreased by the regulation blade 43. In other words, a carrier having the toner charged through friction being attached to the surface thereof is carried and conveyed on the developing sleeve 41 according to a magnetic field generated by the magnet 42.

Inside the developing container 40, there is a member that stirs and conveys the developer. More specifically, a first stirring screw 44 (first stirring member) arranged on the upper side in the gravity direction so as to face the developing sleeve 41 and a second stirring screw 45 (second stirring member) arranged to face the first stirring screw 44 are arranged. The developer disposed inside the developing container 40 is circulated and conveyed inside the developing container 40 while being stirred by the first stirring screw 44 and the second stirring screw 45.

In addition, a predetermined developing bias is applied to the developing sleeve 41 from a high-voltage power supply 102. In this embodiment, the developing bias is an oscillation voltage acquired by overlapping a DC voltage and an AC voltage with each other. More specifically, the developing bias voltage is an oscillation voltage acquired by overlapping a DC voltage of −350 V and an AC voltage of a square wave having a frequency of 8.0 kHz and a peak-to-peak voltage Vpp=1.8 kV. The electrostatic latent image is developed in an inverted manner according to the developing bias and an electric field of the electrostatic latent image formed on the surface of the photosensitive drum 28.

A transfer bias voltage of a predetermined condition is applied to the primary transfer unit 1007 by the high-voltage power supply 103. In this embodiment, the primary transfer bias voltage is a DC voltage. More specifically, the primary transfer bias voltage is a DC voltage of +800 V. The toner images formed on the photosensitive drum 28 are primarily transferred onto the intermediate transfer belt 1011 according to this primary transfer voltage.

Figure 16:
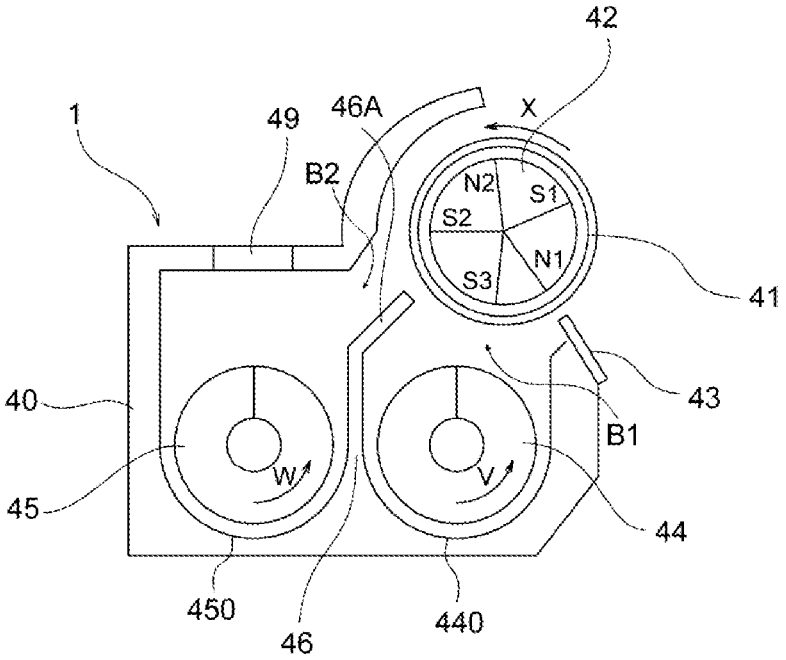
FIG. 16 is a schematic configuration diagram of a development apparatus viewed from the front side of an image forming apparatus according to the sixth embodiment.

Next, the flow of developer in the direction of the cross-section of the development apparatus 1 will be described. FIG. 16 is a schematic configuration diagram of a development apparatus viewed from the front side of an image forming apparatus according to the sixth embodiment.

As illustrated in FIG. 16, in the developing container 40, a developing chamber 440 (first chamber) and a stirring chamber 450 (second chamber) are present. In the developing chamber 440, the first stirring screw 44 is arranged and supplies the developer to the developing sleeve 41 through a first opening portion B1 disposed to face the peripheral face of the developing sleeve 41. In the stirring chamber 450, a second stirring screw 45 is arranged and collects the developer from the developing sleeve 41 through a second opening portion B2 disposed to face the peripheral face of the developing sleeve 41. The first stirring screw 44 and the second stirring screw 45 are horizontally located with respect to each other.

According to a drive input of a developing drive motor not illustrated in the figure, the developing sleeve 41 rotates in a direction X, the first stirring screw 44 rotates in a direction V, and the second stirring screw 45 rotates in a direction W.

As described above, inside the developing sleeve 41, a magnet 42 that is fixedly arranged is disposed. In this embodiment, the magnet 42 includes five peak positions of magnetic poles, and developer included inside the developing chamber 440 is carried on the developing sleeve 41 by the draw-up pole S3 of the magnet 42. The developer is carried and conveyed as the developing sleeve 41 is driven to rotate in the direction X and is formed in a thin layer by the regulation blade 43 arranged near the cutting pole N1.

After a developing operation is performed for the photosensitive drum 28, according to a low magnetic field area formed by the peel-off pole S2 and the draw-up pole S3 that are adjacent to each other, the developer is peeled off (detached) from the developing sleeve 41. Thereafter, the developer falls from an inclined face 46A (guide member) of a partition wall 46 that is arranged to face the low magnetic field area between the peel-off pole S2 and the draw-up pole S3 and is returned to the inside of the stirring chamber 450.

After the developer is carried in the developing sleeve 41 and develops the toner in the developing area, the toner density decreases. The developer of which the toner density has been lowered is sufficiently stirred in the stirring chamber 450 so as to recover the toner density. Thereafter, the developer is conveyed to the developing chamber 440 and is supplied to the developing sleeve 41 again. Accordingly, it is difficult for density non-uniformity to occur in an output object.

Figure 17:
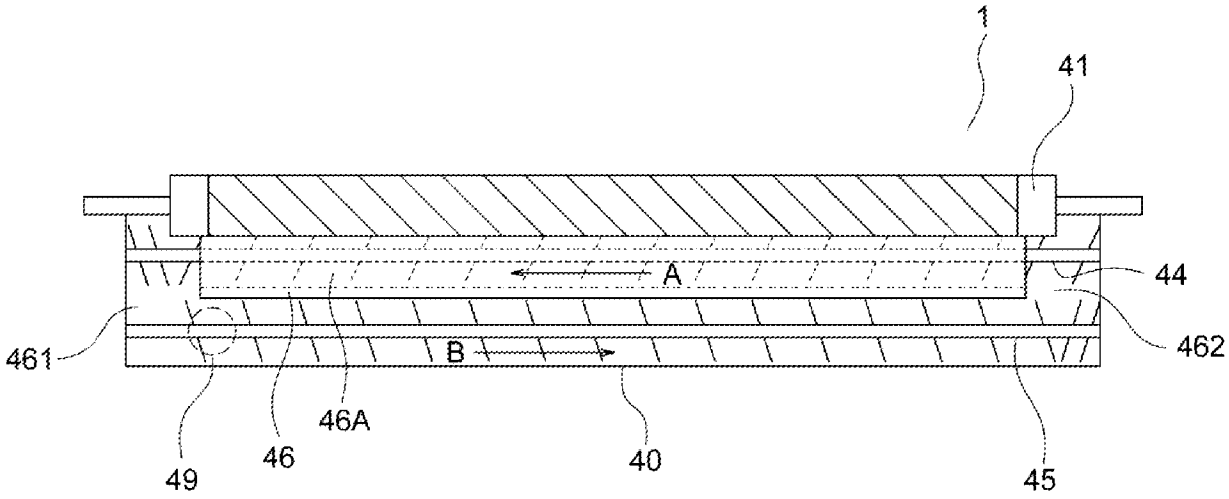
FIG. 17 is a schematic configuration diagram of the development apparatus according to the sixth embodiment viewed from the upper side of the image forming apparatus.

Next, the flow of developer in the longitudinal direction of the developing sleeve 41 of the development apparatus 1 will be described. FIG. 17 is a schematic configuration diagram of the development apparatus according to the sixth embodiment viewed from the upper side of the image forming apparatus.

As illustrated in FIGS. 16 and 17, in the developing container 40, the partition wall 46 may be provided such that the developing chamber 440 including the first stirring screw 44 that faces the developing sleeve 41 and the stirring chamber 450 including the second stirring screw 45 are partitioned. In addition, in both end portions of the first stirring screw 44 and the second stirring screw 45 in the longitudinal direction, an opening portion 461 and an opening portion 462 are disposed.

In the developing chamber 440, developer is conveyed in a conveyance direction A denoted by an arrow by a spiral-shaped blade member of the first stirring screw 44. In addition, in the stirring chamber 450, the developer is stirred and conveyed in a conveyance direction B denoted by an arrow by a spiral-shaped blade member of the second stirring screw 45.

In addition, the developer is moved from the stirring chamber 450 to the developing chamber 440 through the opening portion 461 and is moved from the developing chamber 440 to the stirring chamber 450 through the opening portion 462. In this way, the developer is transferred between the developing chamber 440 and the stirring chamber 450 so as to be circulated and conveyed.

In addition, above the developing container 40 on the upstream side of the conveyance direction B of developer of the second stirring screw 45, a toner supply port 49 is arranged so as to newly supply toner in regard to the non-magnetic toner consumed by an image output operation.

Figure 18:
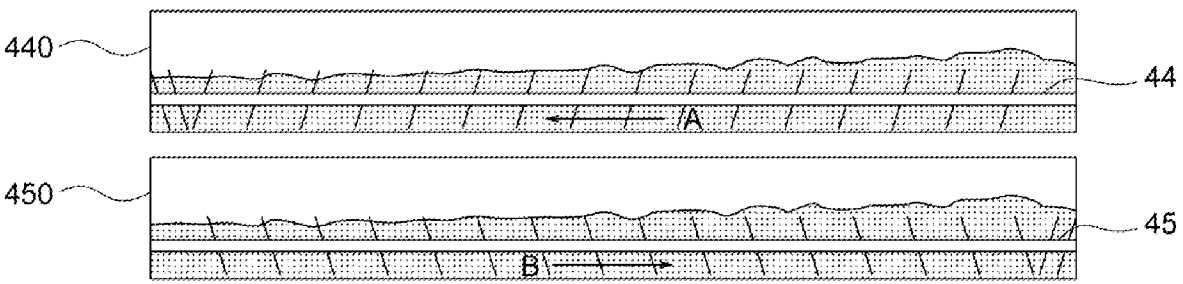
FIG. 18 is a diagram that illustrates developer distributions of a developing chamber and a stirring chamber disposed inside the development apparatus according to the sixth embodiment.

FIG. 18 is a diagram that illustrates developer distributions of the developing chamber and the stirring chamber disposed inside the development apparatus according to the sixth embodiment. As illustrated in FIG. 18, in the stirring chamber 450, the upper surface of the developer is low on the upstream side of the conveyance direction B of the second stirring screw 45 and is high on the downstream side thereof.

On the other hand, in the developing chamber 440, the upper surface of the developer is high on the upstream side of the first stirring screw 44 in the conveyance direction A and is low on the downstream side thereof. The reason for this is that, in the upstream portion of the developing chamber 440 in the developer conveyance direction, developer carried once on the developing sleeve 41 moves to the stirring chamber 450 and thus is not conveyed to the downstream portion of the developing chamber 440. For this reason, in the developing chamber 440, toward the downstream side in the developer conveyance direction, the amount of the developer decreases.

Figure 19:
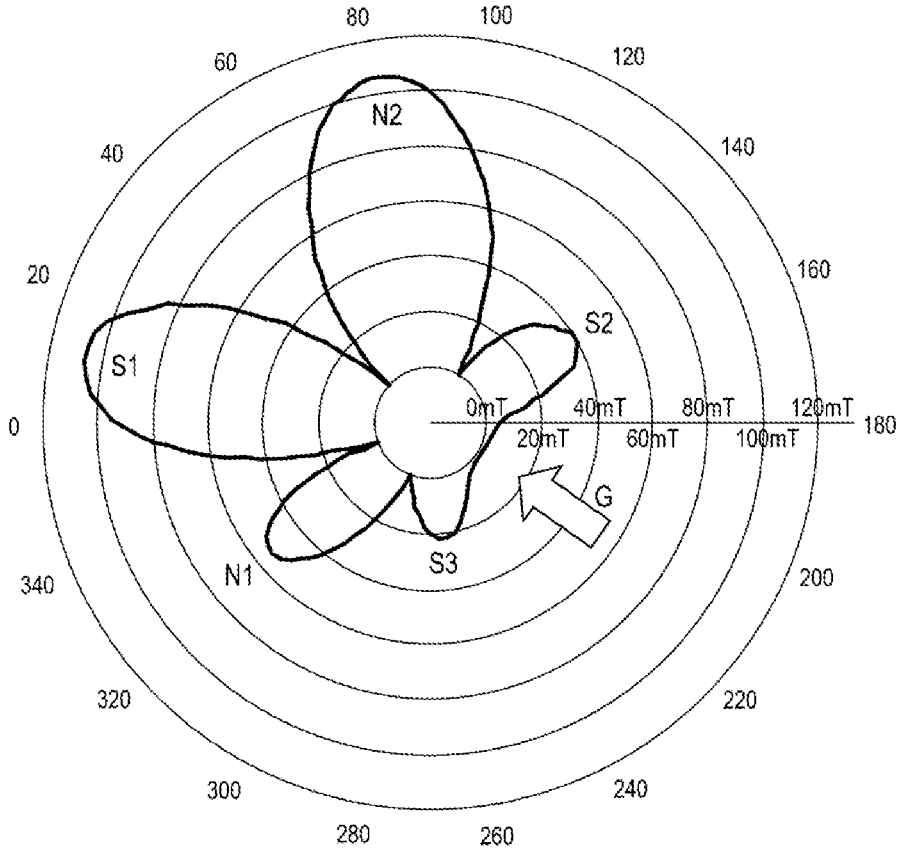
FIG. 19 is a diagram that illustrates a sectional-direction magnetic flux density of a magnetic field generation member according to the sixth embodiment.

Next, the characteristics of the magnet according to this embodiment, which form a featured part of the present invention, will be described with reference to FIGS. 19, 20A, and 20B. FIG. 19 is a diagram that illustrates a sectional-direction magnetic flux density of the magnetic field generation member according to the sixth embodiment.

Generally, in the case of a magnet roller configured by an odd number of magnetic pole peaks, since the peel-off pole S2 and the draw-up pole S3 have the same polarity, a low magnetic field area (minimum area G) of the magnetic force (magnetic flux density) is generated between these both poles. Alternatively, a repulsive magnetic field may be generated according to a repulsive force between both the poles. In addition, in this embodiment, while the peel-off pole S2 and the draw-up pole S3 are poles that have the same polarity and are adjacent to each other, there are cases where an extremely-small unlike pole is generated in a low magnetic field area between the peel-off pole S2 and the draw-up pole S3. In this embodiment, it is assumed that magnetic poles having the same polarity are adjacent to each other, including such a case.

In a case where the low magnetic field area or the magnetic force of the repulsive magnetic field is large, the peeling-off property of the developer carried on the developing sleeve after the developing process is degraded, and there is concern that an image defection such as a density decrease due to the developer that has not been peeled off from the developing sleeve may occur.

Accordingly, in the magnet 42 of this embodiment, a low magnetic field area is included in which a magnetic force measured at a circumferential face that approximately coincides with the outer peripheral face of the developing sleeve 41 is 10 mT or less. In addition, the area in which the magnetic force of the low magnetic force zone of 10 mT or less is generated is formed to be flat. Accordingly, the peeling-off property of the developer is improved.

Figure 20A:
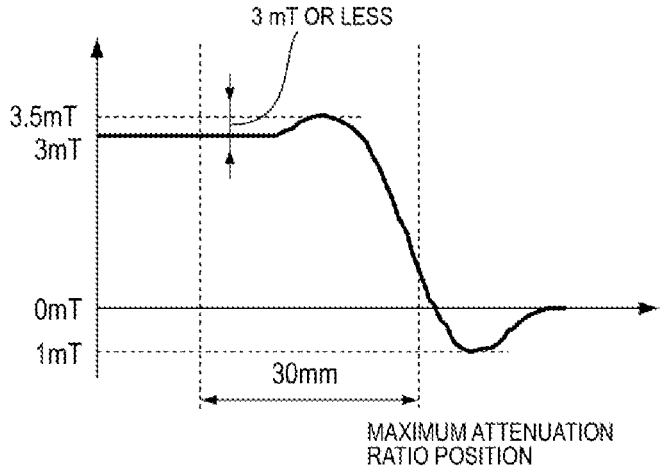
FIGS. 20A and 20B are diagrams that illustrate magnetic flux densities near longitudinal-direction end portions of minimum areas of magnetic field generation members.
Figure 20B:
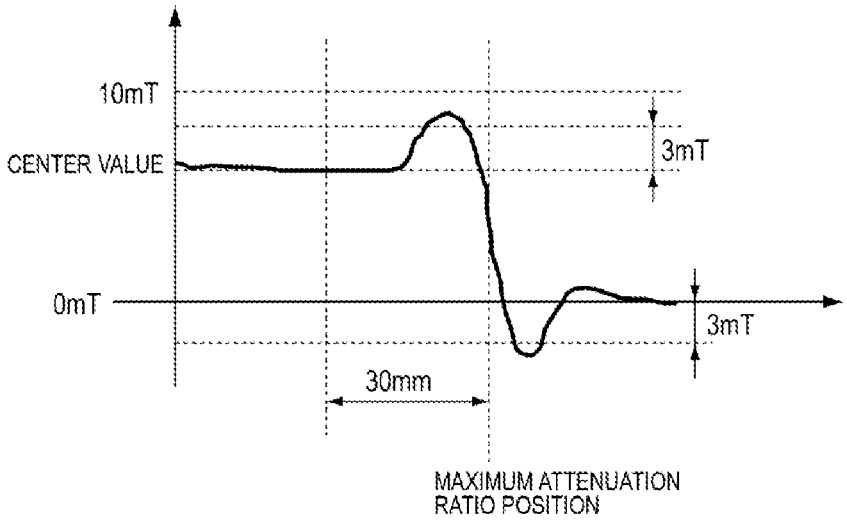

FIGS. 20A and 20B are diagrams that illustrate magnetic flux densities near longitudinal-direction end portions of minimum areas of magnetic field generation members in the low magnetic field area. FIG. 20A is a diagram that illustrates the case of the magnet according to this embodiment, and FIG. 20B is a diagram that illustrates the case of a magnet of a comparative example.

In this embodiment, at positions at which the magnetic flux density of the low magnetic field area in the peripheral direction of the developing sleeve 41 is minimal, a longitudinal-direction magnetic force distribution of the developing sleeve 41 is defined. In this way, a magnetic force elevation in the end portion of the low magnetic field area and magnetic force inversion in the end portion of the magnetic field generation member are defined.

First, the magnetic force elevation of the end portion of the minimum area of the magnet 42 is defined as follows. As illustrated in FIG. 20A, a difference between a maximal magnetic flux density in the range from a maximal position, at which the attenuation rate of the magnetic flux density is maximal, to a 30 mm distant position toward the center side of the developing sleeve 41 and a magnetic flux density of a further center-portion side of the developing sleeve 41 than the above-described range is 3 mT or less.

In addition, the magnetic force inversion in the end portion of the magnetic field generation member is defined as follows. In other words, as illustrated in FIG. 20A, from the maximum position of the attenuation ratio of the magnetic flux density of the end portion of the longer side of the magnetic field generation member, in a magnetic field generation area disposed on a side opposite to the center of the longer side, when a pole having the same polarity or the opposite polarity of the magnetic field is generated, the absolute value of the magnetic flux density is within 3 mT. Here, the magnetic flux density of the center portion of the longer side represents an average value of the magnetic flux densities of a further inner area than the above-described end portion.

In this way, in a case where the above-described magnetic characteristics are satisfied at the minimum position of the low magnetic field area, the longitudinal-direction magnetic force distribution of the low magnetic field area (repulsive magnetic field area) has the same magnetic characteristics. For this reason, unlike the conventional case, it can be suppressed that developer leaks due to the influence of the magnetic force of the longitudinal-direction end portion of the low magnetic field area. Meanwhile, in the peripheral direction of the magnet 42, at a position other than a position located between the peel-off pole and the draw-up pole, basically, the magnetic force of the center side of the sleeve is high, and accordingly, a situation is formed in which it is difficult for the developer to leak from the end portion of the sleeve.

Figure 21A:
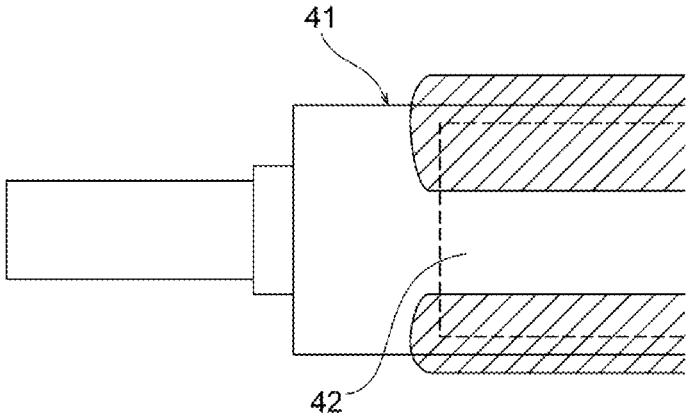
FIGS. 21A and 21B are comparative diagrams of developer bearing members viewed from the low magnetic field area sides.
Figure 21B:
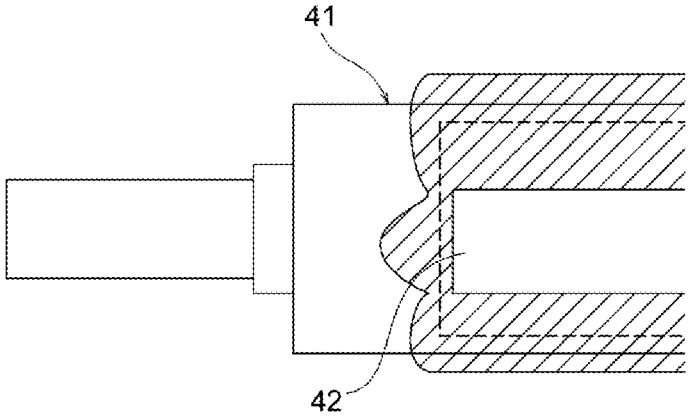

FIGS. 21A and 21B are comparative diagrams of developer bearing members viewed from the low magnetic field area sides. FIG. 21A is the magnet 42 according to the sixth embodiment illustrated in FIG. 20A, and FIG. 21B is the magnet of the comparative example illustrated in FIG. 20B.

In a case where a magnet having a magnetic force of the low magnetic field area not being 10 mT or less and having longitudinal-direction magnetic force characteristics at the minimum position of the low magnetic field area not satisfying the magnetic force characteristics of this embodiment is used, as in the comparative example illustrated in FIG. 21B, the developer wraps around the outer side of the low magnetic field area. When the developer wraps around the end portion of the developing sleeve as above, also in the low magnetic field area of the magnet, the end portion of the developing sleeve can be magnetically sealed. In a case where a configuration is employed in which a toner leakage is prevented by magnetically sealing the end portion of the developing sleeve, the developer is rubbed at a sealed portion, and there is concern that the degradation of the developer, so-called developer degradation occurs. When the developer degradation occurs, it causes various defects.

On the other hand, in this embodiment, the low magnetic field area of the magnet 42 is 10 mT or less on the surface of the developing sleeve 41, and the longitudinal-direction magnetic force characteristics are defined as above. In this case, as in the case illustrated in FIG. 21A, the developer is not carried in correspondence with the low magnetic field area, and there is no wrapping-around of the developer. For this reason, a configuration can be formed in which it is difficult for the developer to leak from the end portion also in the low magnetic field area. However, the pressure of the developer tends to be high on the downstream side in the developer conveyance direction.

Thus, in this embodiment, as will be described later, the functions are separately configured, in other words, the developing chamber 440 supplies the developer to the developing sleeve 41, and the stirring chamber 450 collects the developer of the developing sleeve 41. Accordingly, a developer leakage on the downstream side in the developer conveyance direction is suppressed, and an end portion leakage of toner can be suppressed without using magnetic sealing.

In addition, in the measurement of the magnetic flux density, a value measured at a position 100 μm distant from the surface of the developing sleeve 41 is represented as a magnetic force. In addition, for the measurement of the peripheral direction, measurement is performed for a total of three positions including the center of the longer side of the magnet 42 and positions 2 cm distant from both end portions of the longer side toward the center side, and, for the measurement of the longitudinal direction, measurement is performed for the entire area of the longer side of the developing sleeve 41.

Figure 22:
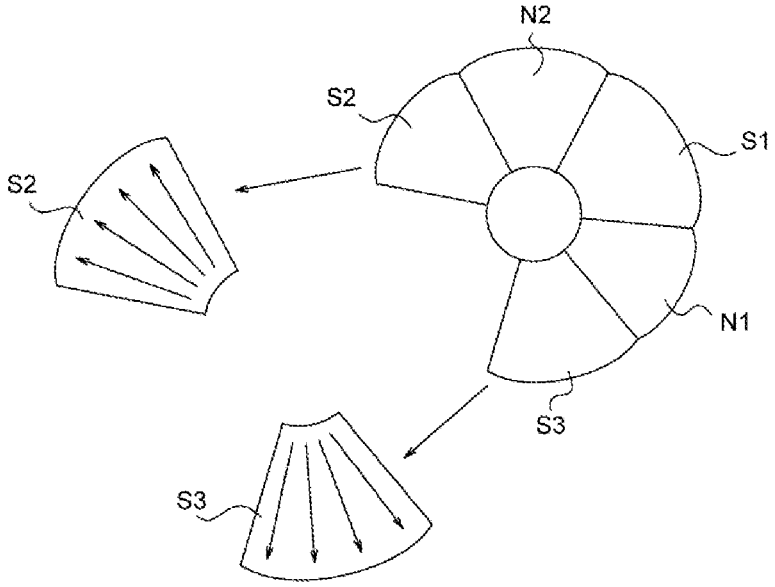
FIG. 22 is a cross-sectional view that illustrates a detailed magnet configuration according to the sixth embodiment.

As an example of a manufacturing method for acquiring the characteristics of the magnet 42 used in this embodiment, a magnet as illustrated in FIG. 22 may be considered. FIG. 22 is a cross-sectional view that illustrates a detailed magnet configuration.

In manufacturing the magnet 42, as the magnetic powders, magnetic anisotropic ferrite powders (anisotropic Sr ferrite, anisotropic Ba ferrite, or the like) are used, and rubber (nitrile rubber, chloroprene rubber, silicone rubber, or the like) as the binder are mixed therewith. The kneaded material thereof is extruded to be molded into a bar shape having an approximately fan-shaped cross-section in a magnetic field and then, is magnetized and is used as magnet pieces configuring the peel-off pole S2 and the draw-up pole S3.

In the case illustrated in FIG. 22, the orientation of the magnetization of the magnetic powders of the magnet pieces configuring the peel-off pole S2 and the draw-up pole S3 is in the directions of the diameters of the peel-off pole S2 and the draw-up pole S3, and, in an area located near a side face facing the low magnetic field area between the peel-off pole S2 and the draw-up pole S3, the magnetization direction of the magnetic powders is configured to follow the side face.

Figure 23:
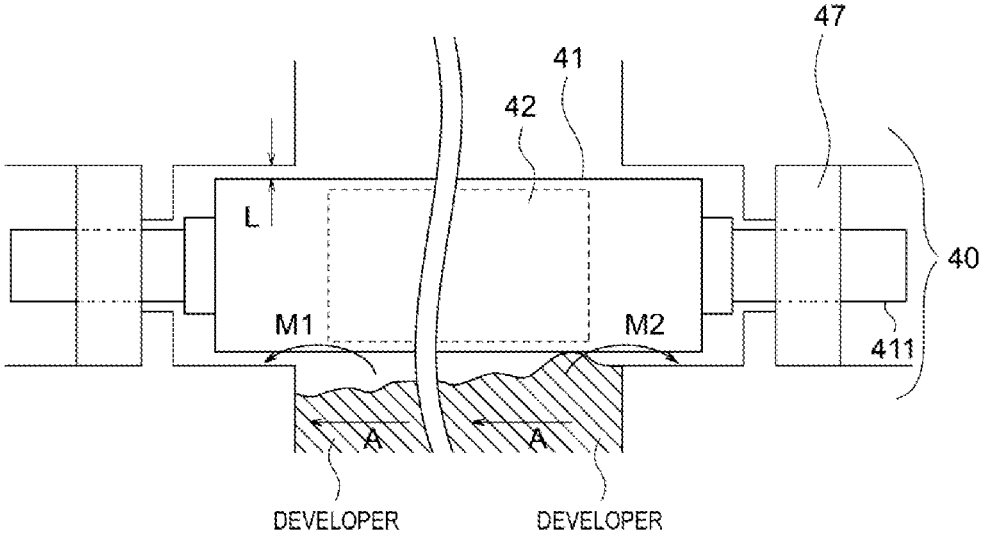
FIG. 23 is a schematic configuration diagram of end portions of a developing sleeve according to the sixth embodiment.

Next, the configuration and the effects of both longitudinal-direction end portions of the developing sleeve according to this embodiment will be described. FIG. 23 is a schematic configuration diagram of the end portions of the developing sleeve according to the sixth embodiment.

As illustrated on the left side in FIG. 23, in the downstream-side end portion of the developing sleeve 41 in the longitudinal direction with respect to the conveyance direction A of the developer according to the first stirring screw 44, a sleeve bearing 47 configured by a resin, a bearing, or the like is arranged in the developing container 40. By passing the drive shaft 411 of the developing sleeve 41 through the sleeve bearing 47, the developing sleeve 41 is supported by the developing container 40. In addition, as illustrated on the right side in FIG. 23, the upstream-side end portion of the developing sleeve 41 in the longitudinal direction with respect to the conveyance direction A of the developer has a configuration similar to that of the downstream-side end portion.

In this embodiment, the developing sleeve 41 and the developing container 40 are arranged to have a gap L therebetween, and the gap L=1.5 mm. The drive configuration of the developing sleeve 41 and the description thereof will not be presented here. In addition, in this embodiment, in both end portions of the developing sleeve 41 in the longitudinal direction, developer leakage prevention members such as magnetic plates configured by magnetic members or magnet sheets are not provided.

Generally, out of both longitudinal-direction end portions of the developing sleeve 41, a developer leakage may easily occur in the end portion disposed on the downstream side in the conveyance direction A of the developer. The reason for this is that the conveyance direction A of the developer and the developer leakage direction toward the downstream-side end portion of the developing sleeve 41 (see a direction M1 illustrated in FIG. 23) are the same.

However, in the configuration of the development apparatus 1 of this embodiment, the magnet 42 and the partition wall 46 are configured to include an inclined face 46A, the developer is drawn up from the developing chamber 440 by the developing sleeve 41, and, after the developing process, the developer is configured to be returned not to the developing chamber 440 but to the stirring chamber 450. In such a configuration, developer that is disposed on the upstream side in the conveyance direction A inside the developing chamber 440 and the developer carried once in the developing sleeve 41, basically, are not directly returned to the downstream side in the conveyance direction A inside the developing chamber 440.

For this reason, the amount of the developer disposed on the upstream side in the conveyance direction A of the developer of the developing chamber 440 increases. Then, as illustrated in FIGS. 18 and 23, the height of the upper surface of the developer disposed on the upstream side in the conveyance direction A of the developer becomes high, and the height of the upper surface of the developer disposed on the downstream side in the conveyance direction A of the developer becomes low. In this way, in a case where the upper surface of the developer is low on the downstream side in the conveyance direction A of the developer, it is difficult for the developer to enter between the developing sleeve 41 and the developing container 40.

When the amount of the developer on the downstream side in the conveyance direction A decreases, the developer pressure of the developer decreases. As the developer pressure decreases, even when the developer enters in the developer leakage direction M1 illustrated in FIG. 23, it is difficult for the leakage of the developer to occur.

Furthermore, on the upstream side in the conveyance direction A, as illustrated in FIG. 23, the upper surface of the developer is high, and the conveyance direction A of the developer having high developer pressure and the developer leakage direction M2 are opposite to each other. For this reason, it is difficult for the developer leakage of the developer to occur.

As described above, in this embodiment, the development apparatus 1 having the configuration in which developer is drawn up from the developing chamber 440 to the developing sleeve 41, and the developer peeled off from the developing sleeve 41 is returned to the stirring chamber 450 is used. In addition, as the magnet 42, a magnet having a magnetic force of the low magnetic force zone between the peel-off pole and the draw-up pole being 10 mT or less and having a variation of the magnetic force characteristics in the longitudinal direction being 3 mT or less is used.

According to such a configuration, a developer leakage in both end portions of the developing sleeve 41 in the longitudinal direction does not occur while the developer leakage prevention members are not provided in both end portions in the longitudinal direction of the developing sleeve 41 in the configuration. In addition, an image defect called image density lowering according to the rotation of the developer on the developing sleeve 41 does not occur.

Seventh Embodiment

Figure 24:
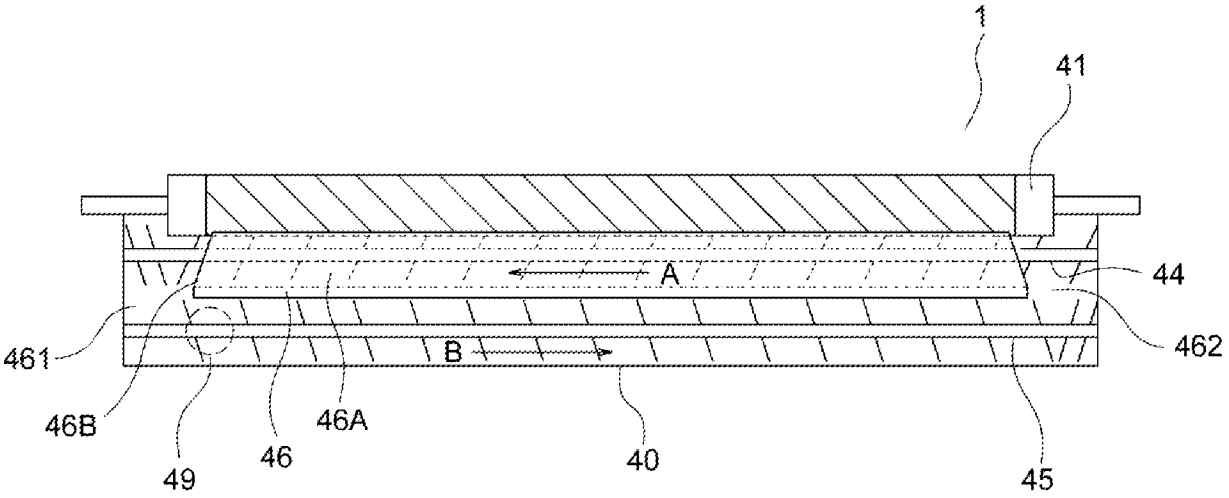
FIG. 24 is a schematic configuration diagram of a development apparatus according to a seventh embodiment viewed from the upper side of the image forming apparatus.
Figure 25:
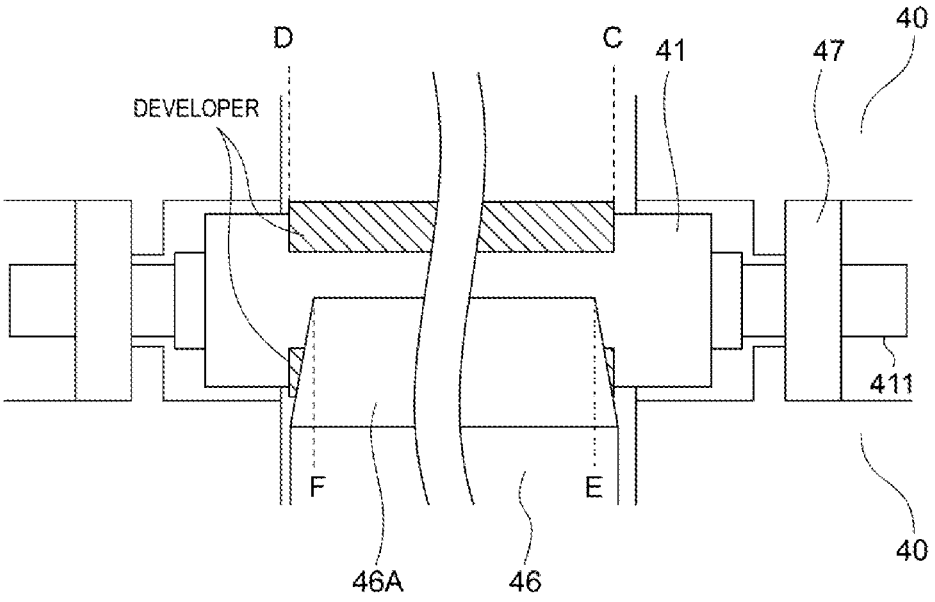
FIG. 25 is a schematic configuration diagram of an end portion of a developing sleeve according to the seventh embodiment viewed from the low magnetic field area side.

Next, an image forming apparatus according to a seventh embodiment of the present invention will be described. FIG. 24 is a schematic configuration diagram of a development apparatus according to the seventh embodiment viewed from the upper side of the image forming apparatus. FIG. 25 is a schematic configuration diagram of an end portion of a developing sleeve according to the seventh embodiment viewed from the low magnetic field area side. The same reference numerals are assigned to the same configuration as that of the sixth embodiment, and description thereof will not be presented.

As illustrated in FIGS. 24 and 25, in this embodiment, the arrangement is made such that the end position of the tip end of the inclined face 46A that is a part of the partition wall 46 arranged near between the peel-off pole S2 and the draw-up pole S3 having the same polarity is located on a further inner side than the position of the end portion of the developer carrying width of the developing sleeve 41. Next, the description will be made more specifically.

In this embodiment, as illustrated in FIG. 25, the position of the upstream-side end portion of the developer carrying area of the developing sleeve 41 in the conveyance direction A of the developer of the developing chamber 440 will be denoted as a position C, and the position of the downstream-side end portion thereof will be denoted as a position D. In other words, the width of the developer carrying area of the developing sleeve 41 is a width from the position C to the position D. On the other hand, as illustrated in FIG. 25, the position of the upstream-side end portion of the tip end portion (closest portion) of the inclined face 46A of the partition wall 46 in the conveyance direction A, which is disposed on a side located near the developing sleeve 41, will be denoted as a position E, and the position of the downstream-side end portion thereof will be denoted as a position F.

In this case, in this embodiment, the tip end portion of the inclined face 46A of the partition wall 46 is configured as follows. The tip end portions are configured such that the position E is disposed on the further inner side in the longitudinal direction of the developing sleeve 41 than the position C, and the position F is disposed on the further inner side in the longitudinal direction than the position D.

The reason for configuring as such is as follows. In a case where the end of the tip end portion of the inclined face 46A of the partition wall 46 in the longitudinal direction extends up to the outer side of the developer carrying area, there are cases where developer that is peeled off from the developing sleeve 41 and falls to the tip end of the inclined face 46A of the partition wall 46 skids on the inclined face 46A of the partition wall 46 to the outer side in the longitudinal direction. In such cases, there is concern that a developer leakage occurs from the end portion of the developing sleeve 41.

In this embodiment, a distance between the positions C and D that is the width of the developer carrying area of the developing sleeve 41 is 305 mm, and a distance between the positions E and F that is the width (partition wall tip end width) of the tip end portion of the inclined face 46A of the partition wall 46 is 299 mm.

In a case where such a partition wall 46 is provided, there is no tip end of the partition wall in the end portion of the developer carrying area of the developing sleeve 41. For this reason, the developer peeled off from the developing sleeve 41 is not sent to the stirring chamber 450 but falls to the developing chamber 440. Also in such a case, since the amount of the developer dropping to the developing chamber 440 is small, non-uniformity of the toner density of the developer supplied to the developing sleeve 41 is small, and there is a low probability of the occurrence of density non-uniformity in an output object.

In this embodiment, the partition wall 46 as described above is included, and a magnet 42 having a magnetic force of the low magnetic force zone between the peel-off pole S2 and the draw-up pole S3 being 10 mT or less and having a variation of the magnetic force characteristics in the longitudinal direction being 3 mT or less is used.

Then, an image forming operation is performed by the image forming apparatus 100 including the development apparatus 1 according to this embodiment. Even in the case of the configuration not including the developer leakage prevention members on both end portions of the developing sleeve 41 in the longitudinal direction, similar to the sixth embodiment, a developer leakage does not occur in both end portions of the developing sleeve 41 in the longitudinal direction. In addition, an image defect called image density lowering according to the rotation of the developer on the developing sleeve 41 does not occur.

Eighth Embodiment

Figure 26:
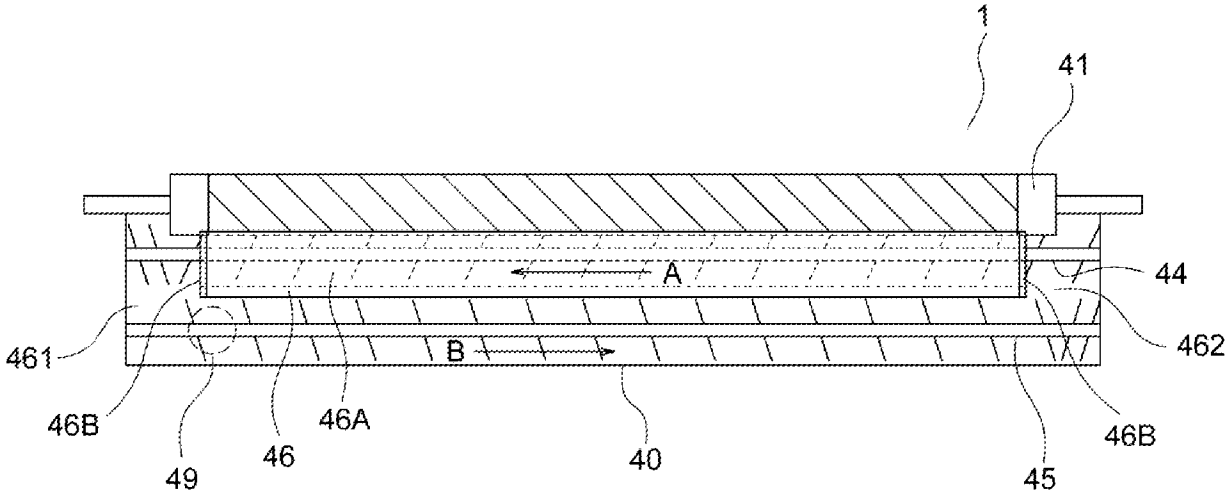
FIG. 26 is a schematic configuration diagram of a development apparatus according to an eighth embodiment viewed from the upper side of the image forming apparatus.
Figure 27:
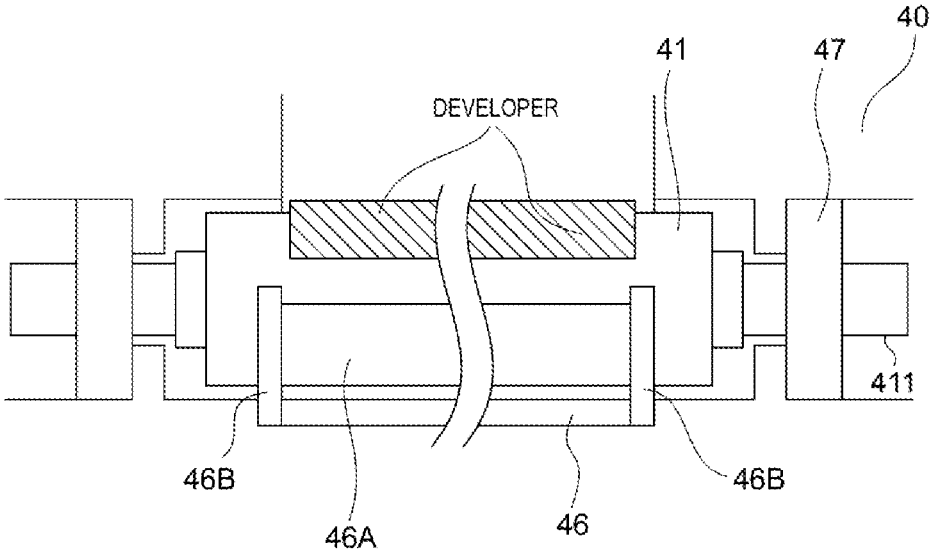
FIG. 27 is a schematic configuration diagram of an end portion of a developing sleeve according to the eighth embodiment viewed from the low magnetic field area side.
Figure 28:
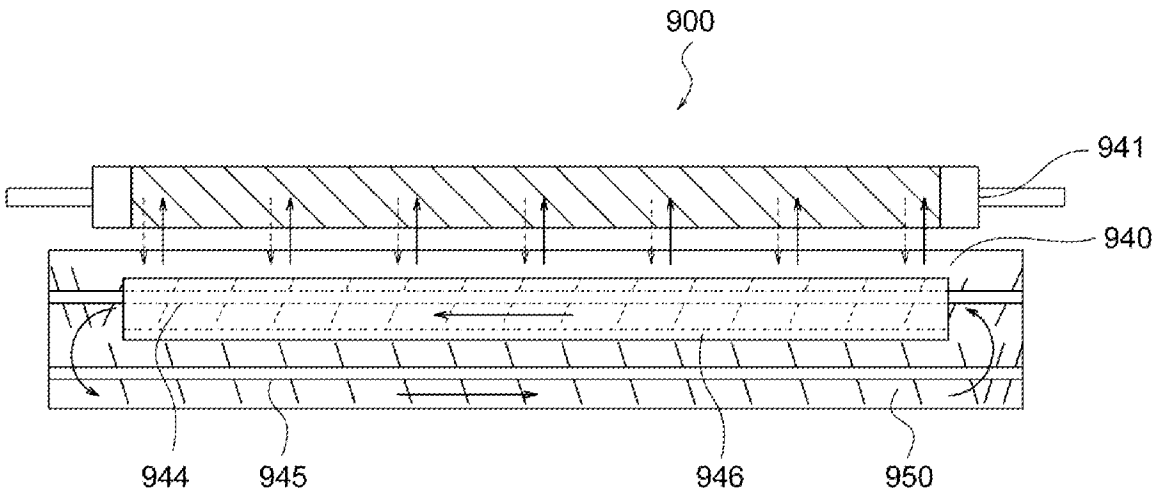
FIG. 28 is a top view of the inside of a conventional development apparatus.
Figure 29:
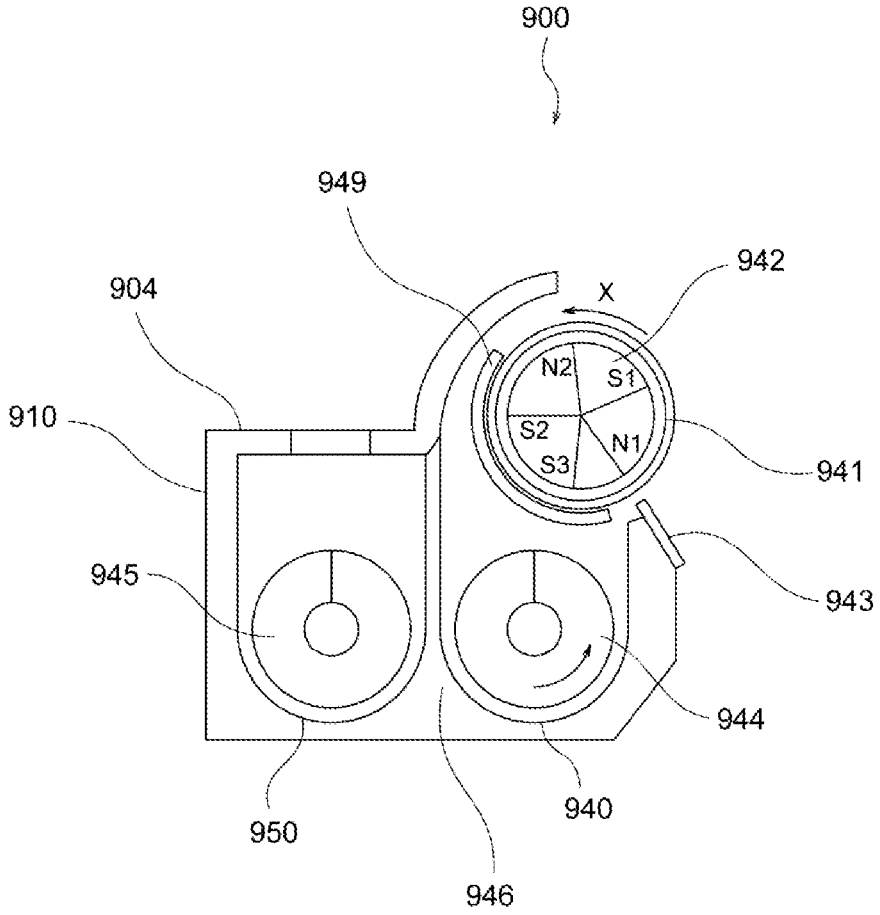
FIG. 29 is a diagram that illustrates an example of a development apparatus using two-component developer illustrating conventional problems.

An image forming apparatus according to an eighth embodiment of the present invention will be described. FIG. 26 is a schematic configuration diagram of a development apparatus according to an eighth embodiment viewed from the upper side of the image forming apparatus. FIG. 27 is a schematic configuration diagram of an end portion of a developing sleeve according to the eighth embodiment viewed from the low magnetic field area side. The same reference numerals are assigned to the same configuration as that of the sixth embodiment, and description thereof will not be presented.

As illustrated in FIGS. 26 and 27, this embodiment is an example in which ribs are provided in both end portions of an inclined face 46A of a partition wall 46 in the longitudinal direction that is arranged near a peel-off pole S2 and a draw-up pole S3 of the developing sleeve 41 having the same polarity. Next, this embodiment will be described more specifically.

In this embodiment, as illustrated in FIG. 27, ribs 46B (skidding prevention members) are included in both end portions of a tip end portion of the inclined face 46A of the partition wall 46 located near the developing sleeve 41. By including the ribs 46B on the partition wall 46 side, developer that is peeled off from the developing sleeve 41 and falls to the tip end of the inclined face 46A of the partition wall 46 is prevented from skidding on the inclined face 46A of the partition wall 46 to the outer side in the longitudinal direction. As a result, a developer leakage from the end portions of the developing sleeve 41 can be prevented.

In this embodiment, the partition wall 46 as described above is included, and a magnet 42 having a magnetic force of the low magnetic force zone between the peel-off pole S2 and the draw-up pole S3 being 10 mT or less and having a variation of the magnetic force characteristics in the longitudinal direction being 3 mT or less is used.

Then, an image forming operation is performed by the image forming apparatus 100 including the development apparatus 1 according to this embodiment. Even in the case of the configuration not including the developer leakage prevention members on both end portions of the developing sleeve 41 in the longitudinal direction, similar to the sixth embodiment, a developer leakage does not occur in both end portions of the developing sleeve 41 in the longitudinal direction. In addition, an image defect called image density lowering according to the rotation of the developer on the developing sleeve 41 does not occur.

In addition, in this embodiment, while the configuration has been described in which a magnetic seal is not provided in end portions of the developing sleeve, a configuration in which a magnetic seal is arranged may be employed. In such a case, by applying the present invention, an effect of suppressing a developer leakage can be sufficiently acquired with respect to the conventional configuration.

As above, according to the seventh embodiment or the eighth embodiment, without arranging high-priced magnetic sealing members in both end portions of the developing sleeve in the longitudinal direction or without using a magnetic sealing member, a developer leakage in both end portions of the developing sleeve in the longitudinal direction can be reduced.

Ninth Embodiment

A schematic configuration of the image forming apparatus according to this embodiment is similar to the configuration of the first embodiment described with reference to FIG. 1, and the same reference numeral is assigned to the same configuration, and description thereof will not be presented.

(Development Apparatus) In this embodiment, a two-component developing system is employed as the developing system. Next, two-component developer used for a two-component developing process will be described.

The two-component developer is formed by toner containing a pigment of each color and a toner conveying carrier having a magnetic property. By frictionally charging the toner and the carrier, the toner is negatively charged, and the carrier is positively charged. According to the charging, an electrostatic attractive force works between the toner and the carrier, and the toner and the carrier are attached to each other.

The toner is formed by a pigment, a resin, wax, and an external additive. The resin used this time is polyester, and the toner is generated by using a grinding system. The circularity is about 0.965, and the average particle diameter is 5.8 μm. In order to optimize the charging amount and the mobility, the amount of the external additive of the toner surface such as silica, alumina, titania, or organic resin particles is adjusted to be used.

The carrier used for the two-component developing process has a magnetic property. The carrier used in this embodiment has an average particle diameter of 35 μm and has a core-shell structure. The core has a magnetite powder as its main ingredient and is bound using a phenol resin. The shell is coated with fluorine acryl, and carbon block is mixed therein for adjusting the charging amount.

In the developer, the mass ratio of the toner to the developer is about 8% to 10% on the whole. However, since the output state of an image is adjusted, the mass ratio cannot be determined to be constantly the above-described value.

In a case where an image is formed, the carrier contained in the developer is not consumed, but only the toner is consumed. Accordingly, the supply of the developer is required only for the toner. Thus, when an image is formed, it is necessary to adjust the charging amount depending on the image formation situation. More specifically, in order to adjust the charging amount of the developer, the amount of toner to be supplied to the inside of the developing container is adjusted. Accordingly, the charging amount of the developer is maintained to an appropriate value, and constant developability is secured.

Figure 30:
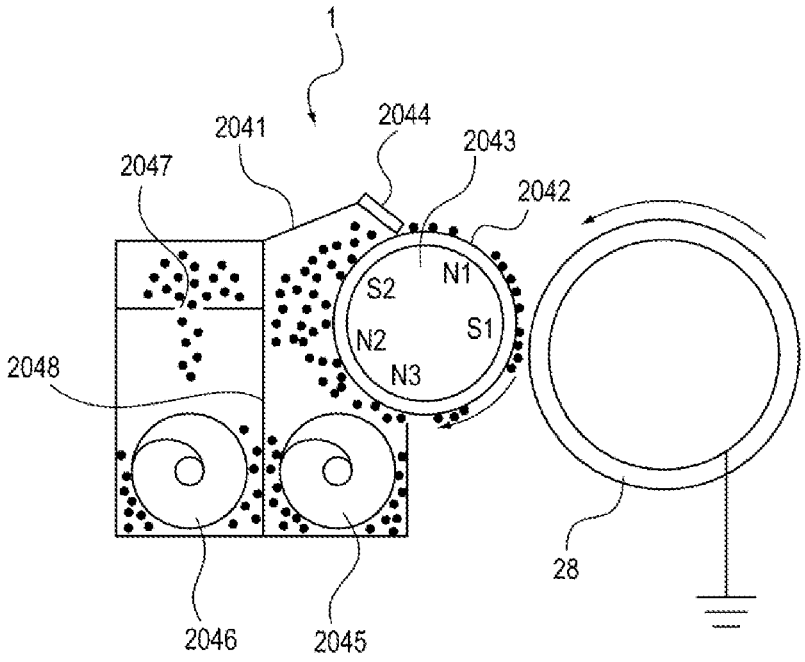
FIG. 30 is a cross-sectional view of a development apparatus according to a ninth embodiment.
Figure 31A:
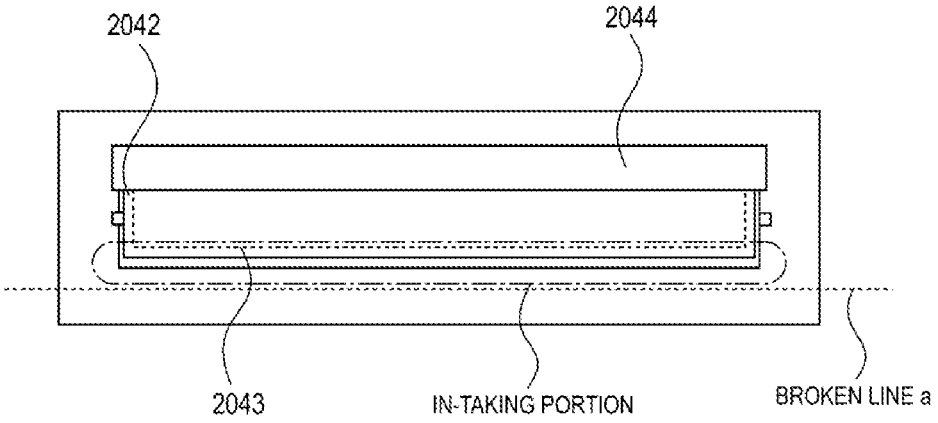
FIGS. 31A and 31B are schematic longitudinal-direction diagrams of the development apparatus according to the ninth embodiment.
Figure 31B:
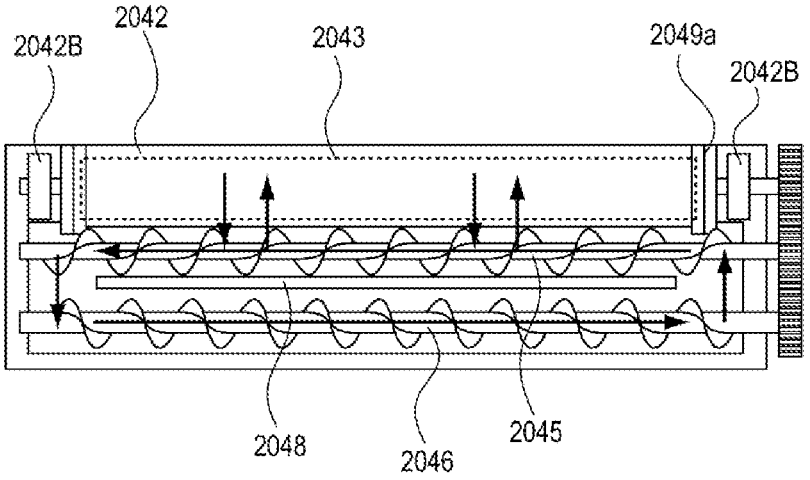

The basic configuration of the development apparatus using the two-component developing system will be described. FIG. 30 is a cross-sectional view of a development apparatus according to a ninth embodiment. FIGS. 31A and 31B are schematic longitudinal-direction diagrams of the development apparatus according to the ninth embodiment, FIG. 31A is a front view, and FIG. 31B is a cross-sectional view taken along broken line a. In addition, the development apparatus 1 used in the image forming apparatus main body of this embodiment has image forming portions P of colors yellow (Y), magenta (M), cyan (C), and black (Bk) having the same configuration.

The development apparatus 1 has a developing container 2041 that houses two-component developer on the inside thereof. The developing container 2041 serves as a casing of each component of the development apparatus. In the developing container 2041, a developing sleeve 2042 (developer bearing member), a developing magnet 2043 (magnetic field generation member), a developing blade 2044 (layer thickness regulation member), a conveyance screw 2045, a stirring screw 2046, and a partition member 2048 are disposed, and a developer supply port 2047 is formed.

The developing magnet 2043 is a non-rotating magnetic member that is positioned inside the developing sleeve 2042 and is in charge of maintaining the developer. The developing blade 2044 adjusts the carried amount of the developer in the developing sleeve 2042. The conveyance screw 2045 is disposed in a developer conveyance path, conveys the developer in a predetermined direction in the longitudinal direction of the screw, and supplies the developer to the developing sleeve 2042. The stirring screw 2046 is disposed in a developer stirring path facing the developer conveyance path described above, conveys the developer in a direction opposite to that of the conveyance screw 2045, and stirs the developer. The partition member 2048 partitions the developer conveyance path and the developer stirring path. From the developer supply port 2047 illustrated in FIG. 30, developer is supplied so as to supplement the toner consumed inside the developing container 2041.

In this embodiment, the configuration of the area of end portions of the developing sleeve 2042 and the developing magnet 2043 has a feature. These will be described in more detail. While this embodiment is targeted for a development apparatus performing a general two-component developing process, the configuration of the present invention is not limited thereto.

The developing sleeve 2042 carries and conveys developer depending on the frictional force of the surface and the magnetic force of the developing magnet 2043 that is built therein. The developing sleeve 2042 has a non-magnetic cylindrical structure that is rotatable and includes bearing portions on both ends thereof. In the end portions of the developing sleeve 2042, bearings 2042B are arranged.

In addition, in the developing sleeve 2042, on the surface of the cylindrical structure, at least for an area facing the image formation area of the photosensitive drum 28, surface processing is performed. As the surface processing of this embodiment, sand blast processing is performed for the surface of a non-magnetic aluminum alloy (A6063), and the processed aluminum alloy having Ra≈about 9.5 μm is used.

Figure 32:
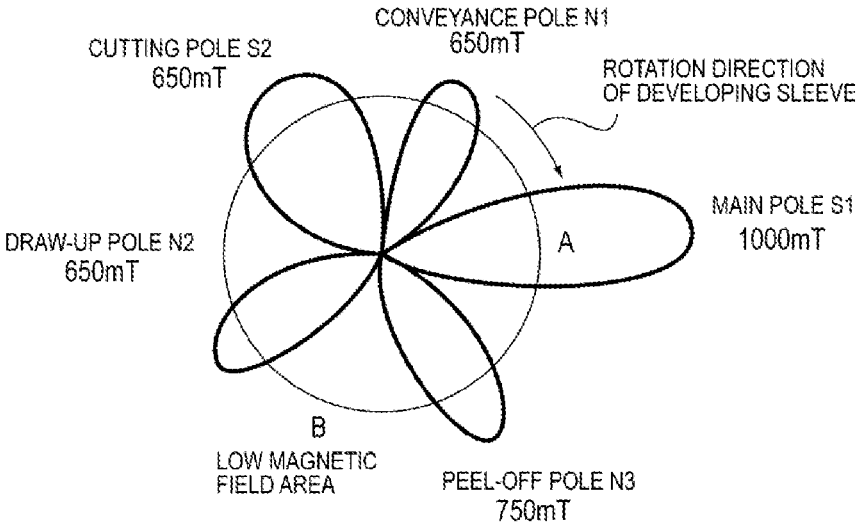
FIG. 32 is a diagram that illustrates a peripheral-direction magnetic field pattern of a magnetic field generation member according to the ninth embodiment.

Furthermore, the developing magnet 2043 is designed to have a plurality of magnetic poles and, generally, have peaks of an odd number of magnetic poles. The magnetic field pattern of the developing magnet 2043 used in this embodiment will be described with reference to FIG. 32. FIG. 32 is a diagram that illustrates a peripheral-direction magnetic field pattern of the magnetic field generation member according to the ninth embodiment.

As illustrated in FIG. 32, the developing magnet 2043 has peak positions of five magnetic poles. As magnetic forces measured on the circumferential face approximately coinciding with the outer peripheral face of the developing sleeve 2042, a main pole S1 has 1000 mT, a conveyance pole N1 has 650 mT, a draw-up pole N2 has 650 mT, a cutting pole S2 has 650 mT, and a peel-off pole N3 has 750 mT.

In addition, in the measurement of the magnetic flux density according to this embodiment, a measure value at a 100 μm distant position from the surface of the developing sleeve is represented as a magnetic force. In addition, for the measurement of the peripheral direction, a total of three positions including the center of the longer side of the developing magnet 2043 and positions 2 cm distant from both end portions of the longer side toward the center side are used for the measurement. For the measurement of the longitudinal direction, measurement is performed for the entire area of the longer side of the developing sleeve 2042.

Generally, in the case of a magnet roller configured by an odd number of magnetic pole peaks, since the peel-off pole N3 and the draw-up pole N2 have the same polarity, a low magnetic field area B of the magnetic force (magnetic flux density) is formed between these poles having the same polarity. Alternatively, a repulsive magnetic field may be generated according to a repulsive force between both the poles. In addition, in this embodiment, while the peel-off pole N3 and the draw-up pole N2 are poles that have the same polarity and are adjacent to each other, there are cases where an extremely-small unlike pole is generated between the peel-off pole N3 and the draw-up pole N2. In this embodiment, it is assumed that magnetic poles having the same polarity are adjacent to each other, including such a case.

In a case where the low magnetic field area or the magnetic force of the repulsive magnetic field is large, the peeling-off property of the developer carried on the developing sleeve 2042 after the developing process is degraded, and there is concern that an image defection such as a density decrease due to the developer that has not been peeled off from the developing sleeve 2042 may occur.

Accordingly, in the developing magnet 2043 of this embodiment, a low magnetic field area is included in which a magnetic force measured at a circumferential face that approximately coincides with the outer peripheral face of the developing sleeve 2042 is 10 mT or less. In addition, the area in which the magnetic force of the low magnetic force zone of 10 mT or less is generated is formed to be flat. Accordingly, the peeling-off property of the developer is improved.

Figure 33A:
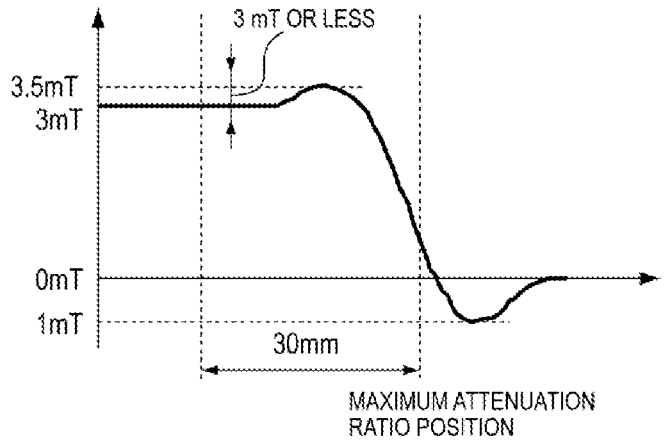
FIGS. 33A and 33B are comparative diagrams of longitudinal-direction magnetic field patterns of the magnetic field generation member according to the ninth embodiment.
Figure 33B:
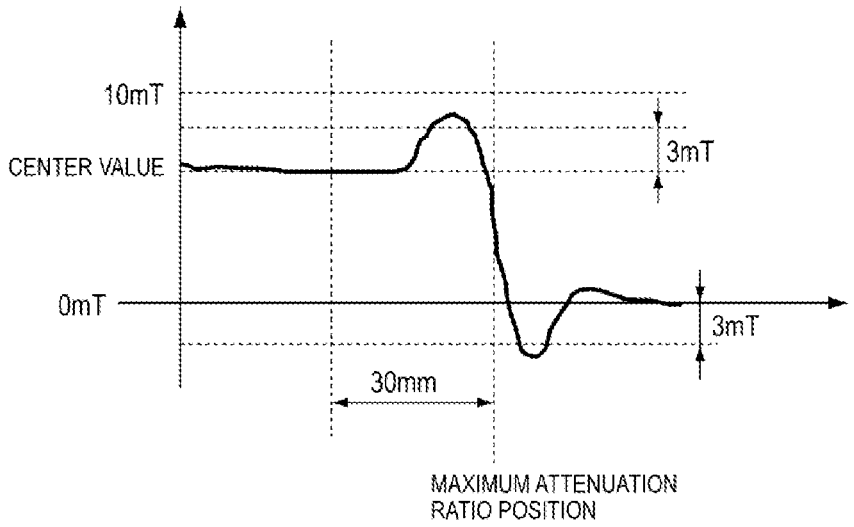

FIGS. 33A and 33B are comparative diagrams of longitudinal-direction magnetic field patterns of the magnetic field generation member according to the ninth embodiment. FIG. 33A is a diagram that illustrates the magnet according to this embodiment, and FIG. 33B is a diagram that illustrates a magnet of a comparative example.

In addition, the developing magnet 2043 defines magnetic force characteristics in the longitudinal direction as below. This will now be described. First, in the peripheral direction of the developing sleeve 2042, for a low magnetic field area in which the magnetic flux density is minimal between the peel-off pole and the draw-up pole, a magnetic flux density distribution of the longitudinal direction of the developing sleeve 2042 is defined. The elevation of the magnetic force in the end portion of the low magnetic field area of the developing magnet 2043 according to this embodiment is defined as follows.

A magnetic force distribution of the longitudinal direction of the developing sleeve 2042 at positions at which the magnetic flux density of the low magnetic field area is minimal in the peripheral direction of the developing sleeve 2042 is as follows. A difference between a maximal magnetic flux density in a range from a maximum position, at which the attenuation rate of the magnetic flux density is maximal, to a position 30 mm distant therefrom toward the center side of the developing sleeve 2042 and a magnetic flux density of the further center side of the developing sleeve 2042 than the range is 3 mT or less. In addition, the absolute value of the magnetic flux density of the further outer side than the maximum position in the longitudinal direction of the developing sleeve 2042 is 3 mT or less.

In addition, the magnetic force inversion in the end portion of the developing magnet 2043 is defined as follows. From a position at which the attenuation rate of the magnetic flux density is maximal in the end portion of the longer side of the magnetic field generation area, in the magnetic field generation area located on a side opposite to the center of the longer side, when the same polarity or the opposite polarity of the magnetic field is generated, the absolute value of the magnetic flux density is within 3 mT. Here, the magnetic flux density of the center portion of the longer side represents an average of the magnetic flux densities of an area located to the inner side than the end portion.

In this way, in a case where the above-described magnetic characteristics are satisfied, the magnetic force distribution of the low magnetic field area (repulsive magnetic field area) that is formed in the longitudinal direction has the same magnetic field characteristics. For this reason, unlike a conventional case, the developer can be suppressed from leaking due to an influence of the magnetic force of the end portion in the longitudinal direction in the low magnetic field area. Meanwhile, in the peripheral direction of the developing magnet 2043, in an area other than the area disposed between the peel-off pole and the draw-up pole, basically, the magnetic force of the center side of the developing sleeve 2042 is high, and accordingly, a situation is formed in which it is difficult for the developer to leak from the end portion of the developing sleeve 2042.

Figure 34A:
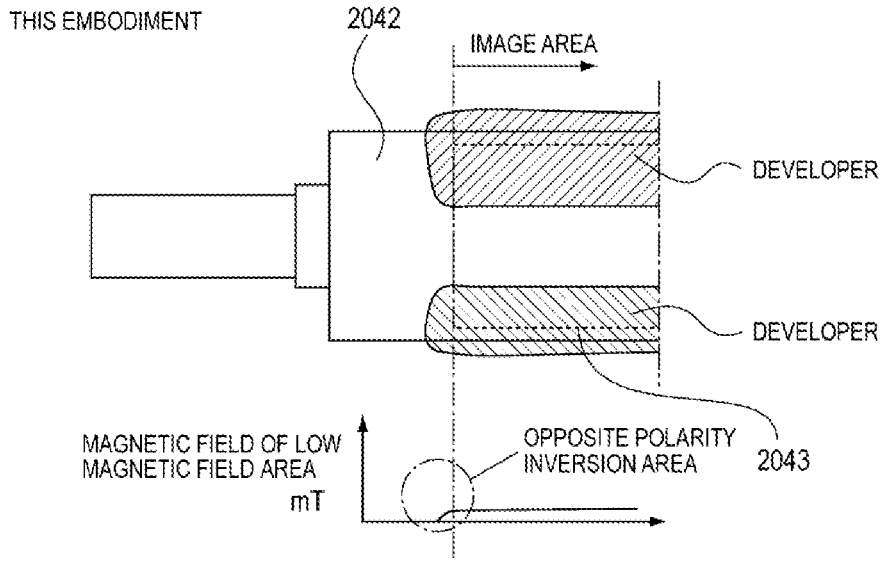
FIGS. 34A and 34B are comparative diagrams of developer bearing members viewed from the low magnetic field area sides.
Figure 34B:
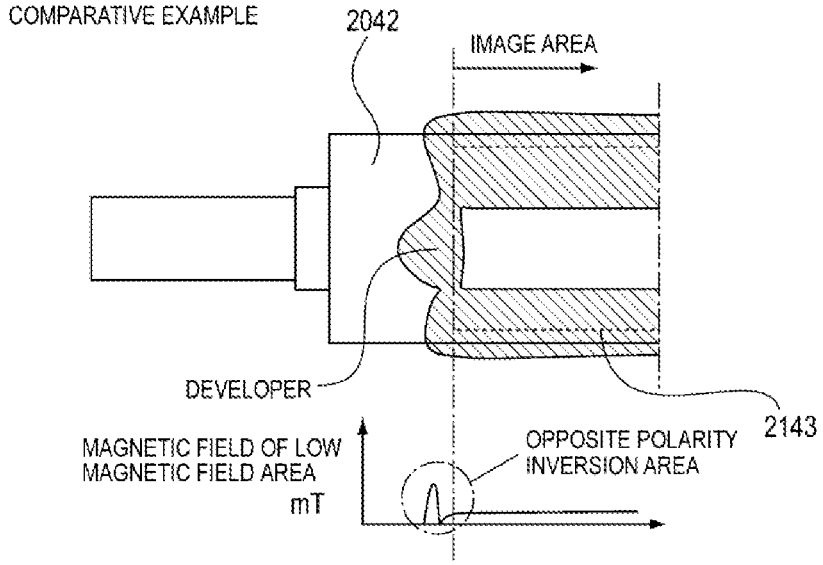

FIGS. 34A and 34B are comparative diagrams of developer bearing members viewed from the low magnetic field area sides. FIG. 34A is the magnetic field generation member according to the ninth embodiment illustrated in FIG. 33A, and FIG. 34B is the magnet of the comparative example illustrated in FIG. 33B.

In a case where a magnet having a magnetic force of the low magnetic field area not being 10 mT or less and having a variation of the longitudinal-direction magnetic force characteristics being 3 mT or more is used, as in the comparative example illustrated in FIG. 34B, the developer wraps around the outer side of the low magnetic field area. When the developer wraps around the end portion of the developing sleeve 2042 as above, also in the low magnetic field area of the magnet, the end portion of the developing sleeve 2042 can be magnetically sealed. In a case where a configuration is employed in which a toner leakage is prevented by magnetically sealing the end portion of the developing sleeve 2042, the developer is rubbed at a sealed portion, and there is concern that the degradation of the developer, so-called developer degradation occurs. When the developer degradation occurs, it causes various defects.

On the other hand, in this embodiment, the low magnetic field area of the magnetic field generation member is 10 mT or less on the surface of the developing sleeve 2042, and the variation of the longitudinal-direction magnetic force characteristics is configured to be 3 mT or less. In this case, as in the case illustrated in FIG. 34A, the developer is not carried in correspondence with the low magnetic field area, and there is no wrapping-around of the developer. For this reason, a configuration can be formed in which it is difficult for the developer to leak from the end portion also in the low magnetic field area. However, the pressure of the developer tends to be high on the downstream side in the developer conveyance direction.

Figure 35:
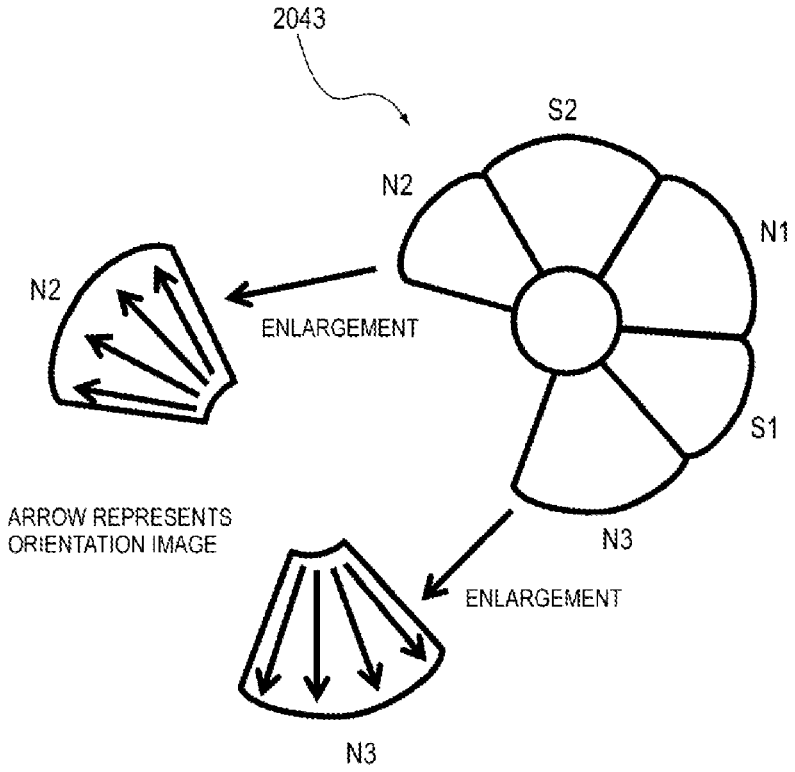
FIG. 35 is a cross-sectional view of an example of the magnetic field generation member according to the ninth embodiment.

An example of the configuration of the developing magnet 2043 for having such characteristics will be described. FIG. 35 is a cross-sectional view of an example of the developing magnet according to the ninth embodiment.

The developing magnet 2043 according to this embodiment, as the magnetic powders, uses magnetic anisotropic ferrite powders (anisotropic Sr ferrite, anisotropic Ba ferrite, or the like) and mixes rubber (nitrile rubber, chloroprene rubber, silicone rubber, or the like) as the binder therewith. The kneaded material thereof is extruded to be molded into a bar shape having an approximately fan-shaped cross-section in a magnetic field and then, is magnetized and is used as magnet pieces configuring the draw-up pole N2 and the peel-off pole N3 that are adjacent to each other with a space being interposed therebetween.

As illustrated in FIG. 35, the orientation of the magnetization of the magnetic powders of the magnetic pieces configuring the draw-up pole N2 and the peel-off pole N3 is in the directions of the diameters of the draw-up pole N2 and the peel-off pole N3. In addition, in an area located near a side face facing a gap between the draw-up pole N2 and the peel-off pole N3, the magnetization direction of the magnetic powders is configured to follow the side face.

By using the developing magnet 2043 having the above-described characteristics, particularly, in the low magnetic field area B between the peel-off pole N3 and the draw-up pole N2, the wrapping-around of the developer can be prevented. Accordingly, the developer can be prevented from leaking toward the side of the end portion of the rotation shaft of the developing sleeve 2042.

In addition, different from this embodiment, there is an apparatus having a configuration in which the developing blade is arranged below the photosensitive drum in the vertical direction, the rotation direction of an area of the opening portion of the developing container that faces the photosensitive drum of the developing sleeve is vertically upward direction, and the conveyance screw and the developing sleeve are close to each other. In such a case, since the pressure of the developer stay portion disposed on the upstream side of the developing blade decreases, a toner leakage or a toner stay in the end portion of the developing sleeve in the direction of the rotation shaft can be suppressed. The developing magnet 2043 described above can be applied also to the apparatus having such a configuration.

However, in this embodiment, as illustrated in FIG. 30, the developing blade 2044 is arranged above the photosensitive drum 28 in the vertical direction, and the conveyance screw 2045 and the developing sleeve 2042 are located far from each other. In such a configuration, the pressure of the developer stay portion disposed on the upstream side of the developing blade 2044 increases. Then, since the pressure toward the side of the end portion of the rotation shaft of the developing sleeve 2042 increases as well, there is concern that the developer cannot be prevented from leaking.

For this reason, in this embodiment, as illustrated in FIG. 31B, in addition to using the developing magnet 2043 described above, a developer seal is used together. In this embodiment, as the developer seal, a developing side seal magnetic plate 2049*a* is used.

Figure 36A:
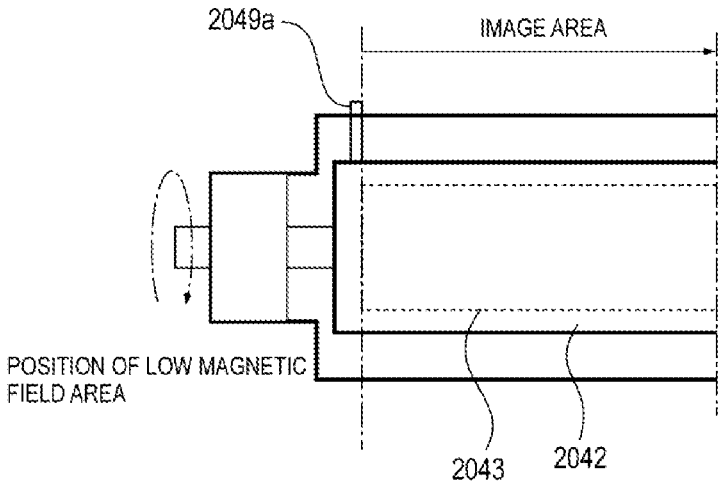
FIGS. 36A and 36B are diagrams that illustrate the end-portion structure of a developer bearing member according to the ninth embodiment.
Figure 36B:
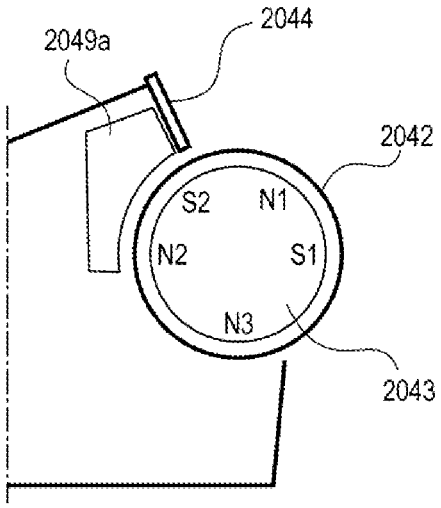

FIGS. 36A and 36B are diagrams that illustrate the end-portion structure of the developer bearing member according to the ninth embodiment. FIG. 36A is a diagram of the front side of the development apparatus, and FIG. 36B is a cross-sectional view of the end portion of the developing container.

As illustrated in FIG. 36A, the developing side seal magnetic plate 2049*a* is configured to be thin in the direction of the axial line of the developing sleeve 2042. In addition, as illustrated in FIG. 36B, the developing side seal magnetic plate 2049*a* is configured to be thick in the direction of the normal line of the developing sleeve 2042.

The developing side seal magnetic plate 2049*a* is generated using a ferromagnetic material such as an iron plate, a nickel plate, a cobalt plate, or a plate of an alloy thereof having a thickness t of about 0.2 mm to 1 mm. As the developing side seal magnetic plate 2049*a*, an iron plate having a thickness of 0.8 mm for which a zinc plating process has been performed is used, and a separation distance from the developing sleeve 2042 is configured to be 0.7 mm.

As illustrated in FIG. 36B, the developing side seal magnetic plate 2049*a* is arranged on the further downstream side than a magnetic field minimum portion that is formed in the low magnetic field area between the peel-off pole N3 and the draw-up pole N2 in the rotation direction of the developing sleeve 2042. In addition, the developing side seal magnetic plate 2049*a* is arranged up to the upstream side of the developing blade 2044 on the downstream side of the magnetic field minimum portion in the rotation direction of the developing sleeve 2042. For this reason, at least, between an intaking portion of the opening portion of the developing container and the magnetic field minimum portion of the low magnetic field area between the peel-off pole N3 and the draw-up pole N2, the developing side seal magnetic plate 2049*a* is not present.

Figure 37:
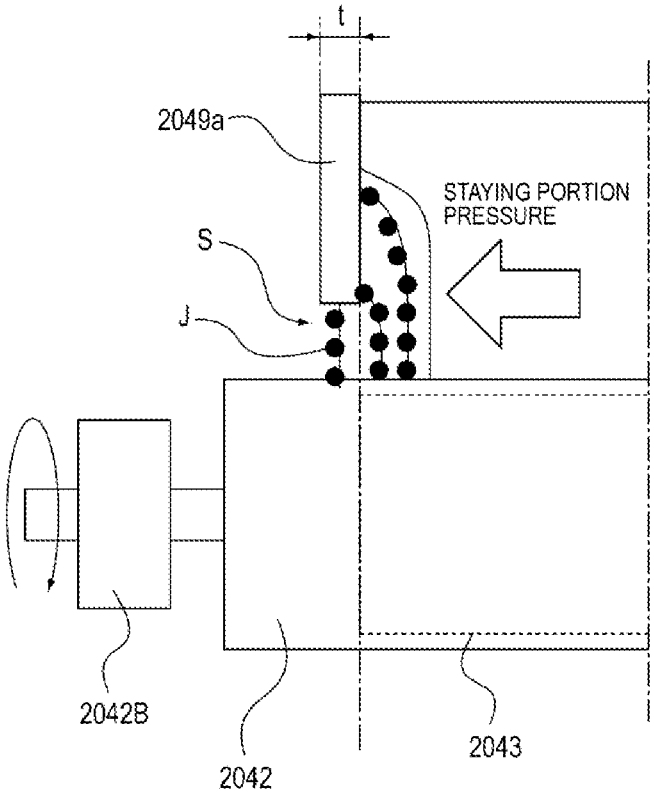
FIG. 37 is a diagram that illustrates an action according to the configuration of the ninth embodiment.

FIG. 37 is a diagram that illustrates an action according to the configuration of the ninth embodiment. As illustrated in FIG. 37, in a case where the developing side seal magnetic plate 2049*a* is arranged on the end portion side of the developing sleeve 2042, the developing side seal magnetic plate 2049*a* is magnetized by the magnetic force of the developing magnet 2043 disposed inside the developing sleeve 2042. Then, in the end portion and the space portion S between the developing side seal magnetic plate 2049*a* and the developing sleeve 2042, magnetic flux lines of the developing magnet 2043 are collected by the developing side seal magnetic plate 2049*a*.

Accordingly, in the space portion S, a magnetic brush J as illustrated in FIG. 37 is formed. As above, by forming the magnetic brush J in the space portion S, the inflow of the developer to the end portion of the developing sleeve 2042 mainly according to the developer stay portion disposed on the upstream side of the developing sleeve 2042 can be reduced.

As described above, since the generation of the stay portion of the developer in the end portion of the developing area is prevented, phenomena such as toner scattering and developer dropping can be suppressed.

Comparison Between this Embodiment and Comparative Example

Figure 38A:
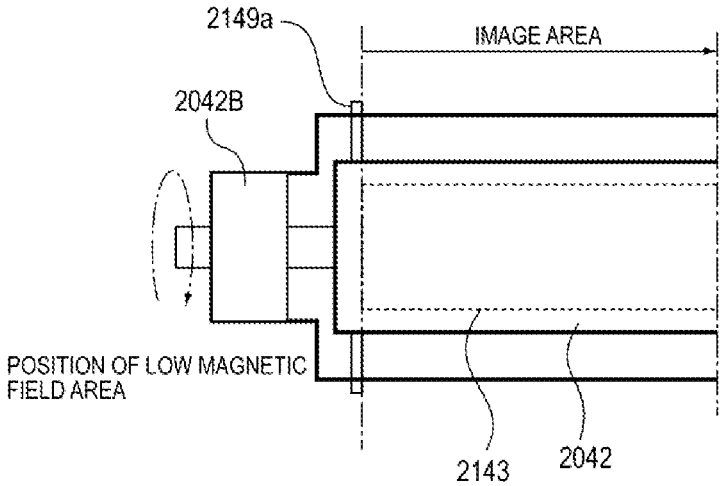
FIGS. 38A and 38B are diagrams that illustrate the arrangement position of a developing side seal magnetic plate of a comparative example.
Figure 38B:
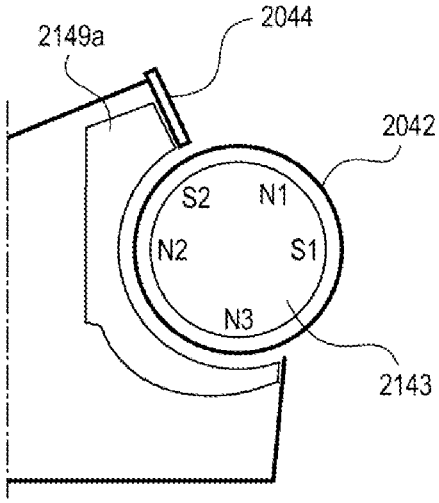

A comparison between this embodiment and a comparative example will be made with reference to FIGS. 38A and 38B. FIGS. 38A and 38B are diagrams that illustrate the arrangement position of the developing side seal magnetic plate of the comparative example. FIG. 38A is a diagram of the front side of the development apparatus, and FIG. 38B is a cross-sectional view of the end portion of the developing container. In the comparative example, a developing magnet 2143 not satisfying the characteristics of this embodiment, and a developing side seal magnetic plate 2149*a* having a shape different from this embodiment are used.

As the specific configuration of the developing side seal magnetic plate 2149*a*, as illustrated in FIGS. 38A and 38B, the developing side seal magnetic plate 2149*a* is configured to be disposed to surround the developing sleeve 2042 in an area excluding the opening portion of the developing container 2041.

In addition, the developing side seal magnetic plate 2149*a* of the comparative example is the same as that of the embodiment other than the cross-sectional shape, and an iron plate having a thickness of 0.8 mm, for which a zinc plating process has been performed, is used and a separation distance from the developing sleeve 2042 is 0.7 mm.

It is known that toner scattering and developer dropping can easily occur in a case where the degree of degradation of the developer is high. Accordingly, in a review through a comparison, by using developer that had been used corresponding to an image ratio of 1%, only the development apparatus was driven outside the image forming apparatus.

Regarding the amount of toner scattering, an OHP sheet was disposed right below the end portion of the image formation area of the developing container 2041, and, after an operation for a time corresponding to printing of 100 A4 sheets was performed, an image formed on the OHP sheet was photographed using a microscope so as to measure the occupancy area ratio of toner and was used for the comparison. In addition, regarding the developer dropping, a container is disposed right below the end portion of the image formation area of the developing container 2041, and, after an operation for a time corresponding to printing of 100 A4 sheets was performed, the amount of developer disposed inside the container was used for the comparison.

Figure 39:
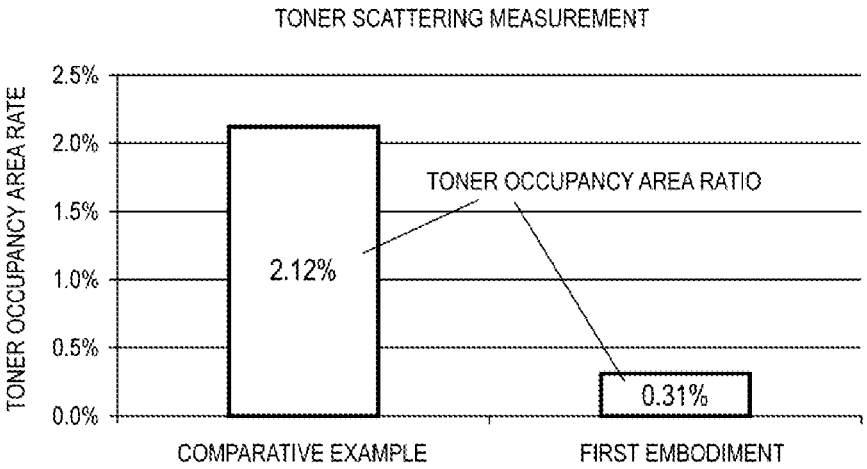
FIG. 39 is a diagram that illustrates a result of a comparative review of toner scattering according to the ninth embodiment.
Figure 40:
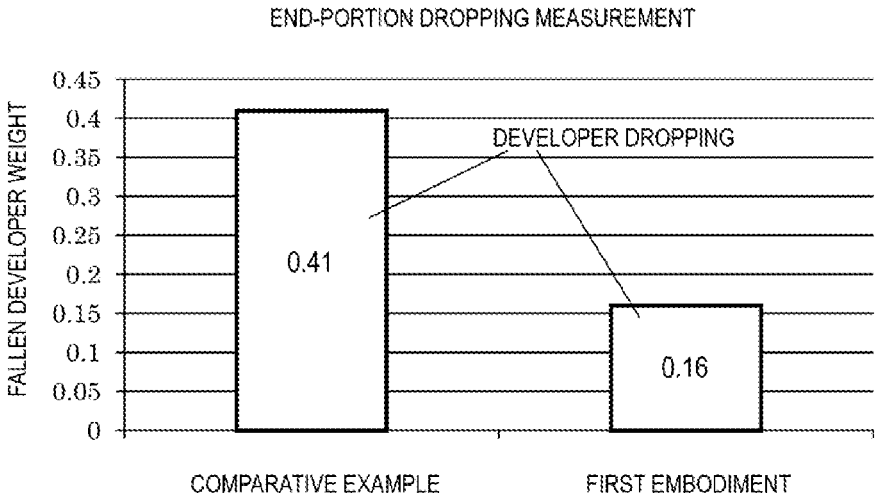
FIG. 40 is a diagram that illustrates a result of a comparative review of developer dropping according to the ninth embodiment.

By using the comparative example as described above, a comparison with this embodiment was made for the review. FIG. 39 is a diagram that illustrates a result of a comparative review of toner scattering according to the ninth embodiment. FIG. 40 is a diagram that illustrates a result of a comparative review of developer dropping according to the ninth embodiment.

As illustrated in FIG. 39, the amount of toner scattering according to this embodiment is about 15% of that of the comparative example. In addition, as illustrated in FIG. 40, the developer dropping according to this embodiment is about 39% of that of the comparative example. For this reason, it can be understood that this embodiment is effective for the problems of the toner scattering and the developer dropping.

Figure 41A:
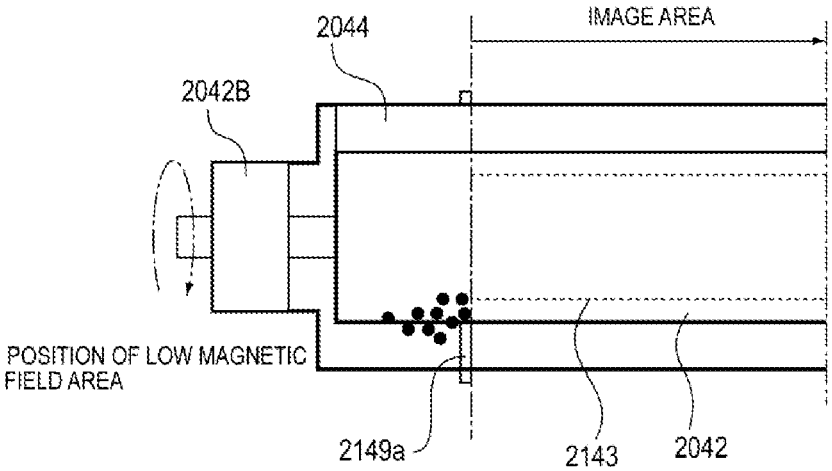
FIGS. 41A and 41B are diagrams that illustrate developing of developer in a comparative example.
Figure 41B:
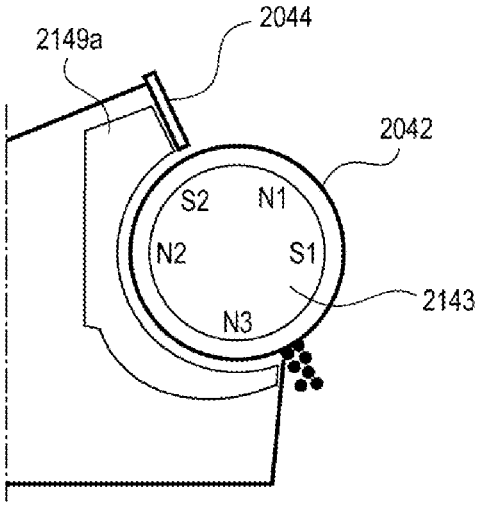

Next, the reasons for the occurrence of the toner scattering and the developer dropping in the comparative example will be described. FIGS. 41A and 41B are diagrams that illustrate developing of developer in the comparative example. FIG. 41A is a diagram of the front side of the development apparatus, and FIG. 41B is a cross-sectional view of the end portion of the developing container.

In the configuration of the comparative example, a developing side seal magnetic plate 2149*a* is disposed so as to surround the developing sleeve 2042 in an area excluding the opening portion of the developing container 2041. In this case, in an in-taking portion illustrated in FIG. 41A, a phenomenon of the developer staying in the upstream-side end portion of the developing side seal magnetic plate 2149*a* located in the end portion of the longer side of the in-taking portion occurs.

In a case where the developer stay portion described above is present, the developer constantly oscillates by receiving a frictional force from the developing sleeve 2042. For this reason, toner scattering in which toner is separated from the carrier in the developer occurs. In addition, in a case where the developer staying portion is enlarged according to the elapse of time, the limit of the carrying amount according to the magnetic field of the developer seal is exceeded at a certain time point. For this reason, the developer leaks to from the opening portion to the outside. This is the developer dropping.

As described above, it is understood that this embodiment is effective in regard to the toner scattering or the developer dropping, which are the problems, with respect to the comparative example without arranging the developing side seal magnetic plate 2049*a* in the low magnetic field area by using the developing magnet 2043 according to this embodiment.

Tenth Embodiment

In this embodiment, by changing the developer seal, the sealing property of the end portions is stronger than that of the ninth embodiment. The same reference numerals are assigned to the same configuration as that of the above-described embodiment, and description thereof will not be presented.

Figure 42A:
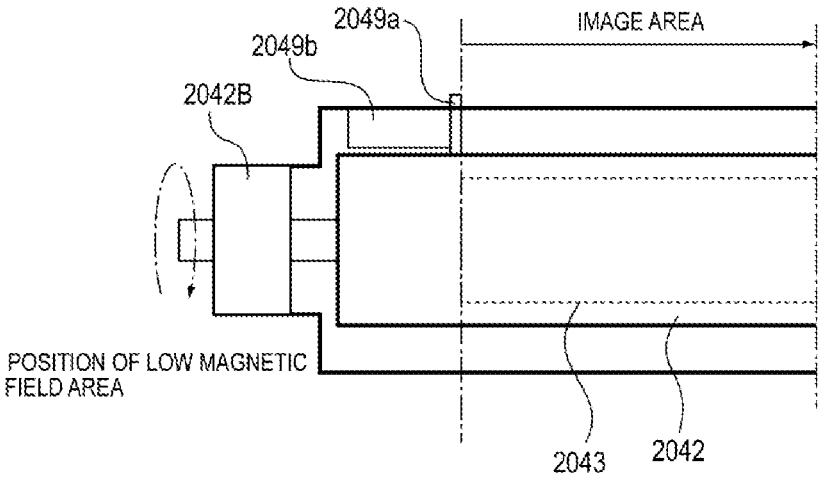
FIGS. 42A and 42B are diagrams that illustrate the end-potion structure of a developer bearing member according to a tenth embodiment.
Figure 42B:
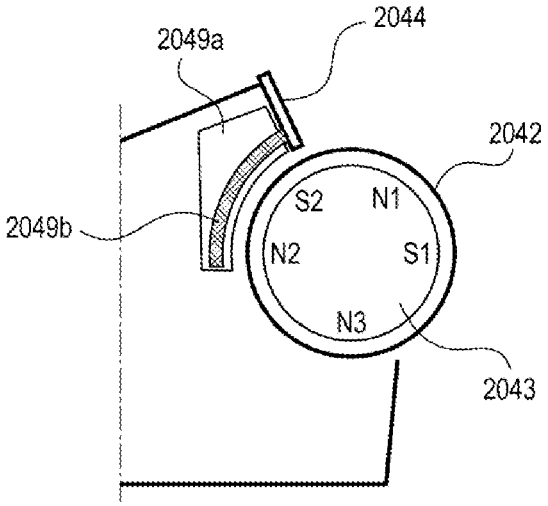

FIGS. 42A and 42B are diagrams that illustrate the end-portion structure of a developer bearing member according to a tenth embodiment. In this embodiment, as the developer seal, the developing side seal magnetic plate 2049*a* and a developing side magnet 2049*b* (magnet member) are used together. The developing side magnet 2049*b* is configured by a sheet-like rubber magnet.

Figure 43:
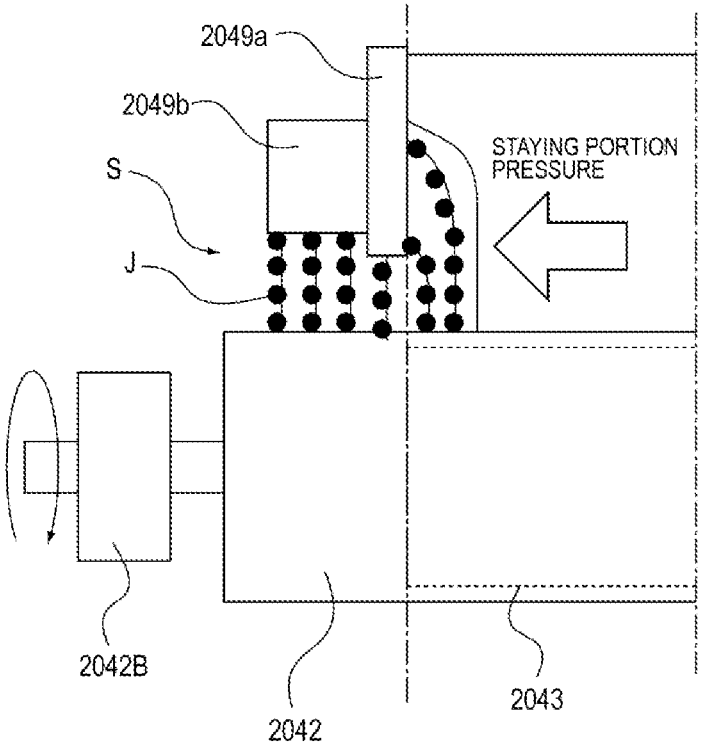
FIG. 43 is a diagram that illustrates an action according to the configuration of the tenth embodiment.

By configuring as such, the configuration of this embodiment can secure a higher degree of the sealing property than that of the ninth embodiment. Next, the reason will be described more specifically. FIG. 43 is a diagram that illustrates an action according to the configuration of the tenth embodiment.

As illustrated in FIG. 43, according to this embodiment, the developing side magnet 2049*b* forms magnetic flux lines according to the magnetic field thereof. Then, in a space portion S between the developing side magnet 2049*b* and the developing sleeve 2042, a magnetic brush J is formed. By forming such a magnetic brush J, the developer is prevented from leaking in an end portion bearing direction.

The configuration of the developing side seal magnetic plate 2049*a* is the same as that of the above-described embodiment, and a separation distance from the developing sleeve 2042 is 0.7 mm.

The developing side magnet 2049*b* is a sheet-like rubber magnet having a magnetic field of 50 mT and having the inner side being the S pole. A separation distance from the developing sleeve 2042 is 0.9 mm.

Figure 44:
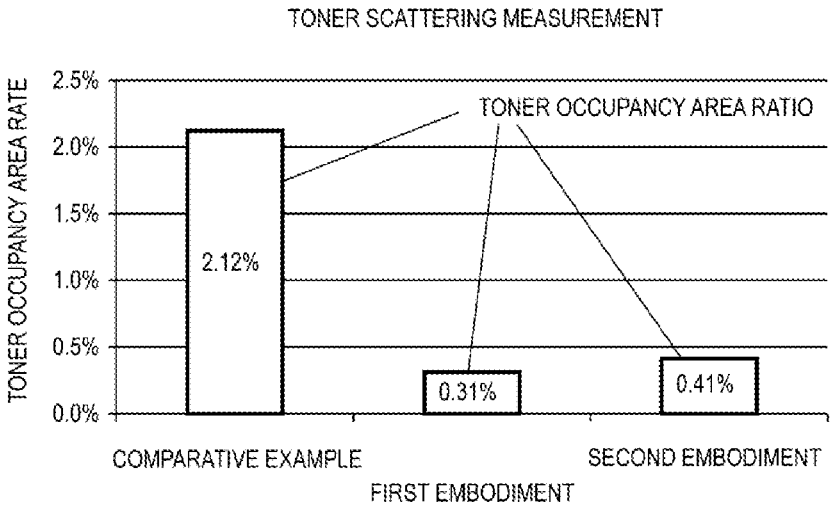
FIG. 44 is a diagram that illustrates a result of a comparative review of toner scattering according to the tenth embodiment.
Figure 45:
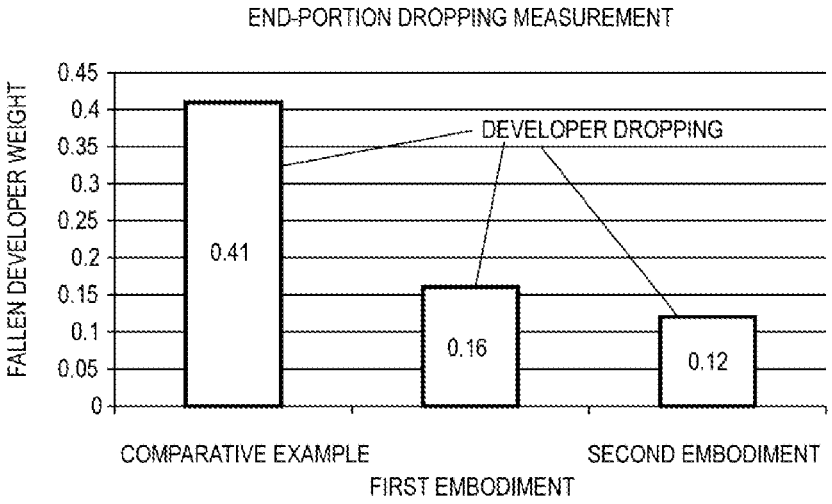
FIG. 45 is a diagram that illustrates a result of a comparative review of developer dropping according to the tenth embodiment.

By using the comparative example as described above, a comparison with this embodiment was made for the review. FIG. 44 is a diagram that illustrates a result of a comparative review of the toner scattering according to the tenth embodiment. FIG. 45 is a diagram that illustrates a result of a comparative review of the developer dropping according to the tenth embodiment.

As illustrated in FIG. 44, the amount of toner scattering according to this embodiment is about 19% of that of the comparative example, which represents a decreased numerical value. In addition, as illustrated in FIG. 45, the developer dropping according to this embodiment is about 29% of that of the comparative example. Furthermore, the developer dropping is smaller than that of the ninth embodiment. For this reason, it can be understood that this embodiment is effective for the problems of the toner scattering and the developer dropping.

As above, according to the ninth embodiment or the tenth embodiment, the stay of the developer in the end portion of the developer bearing member is suppressed, and the image quality of an output image can be maintained.

Eleventh Embodiment

A schematic configuration of an image forming apparatus according to this embodiment is similar to that of the first embodiment described with reference to FIG. 1, the same reference numeral is assigned to the same configuration, and description thereof will not be presented.

Figure 46:
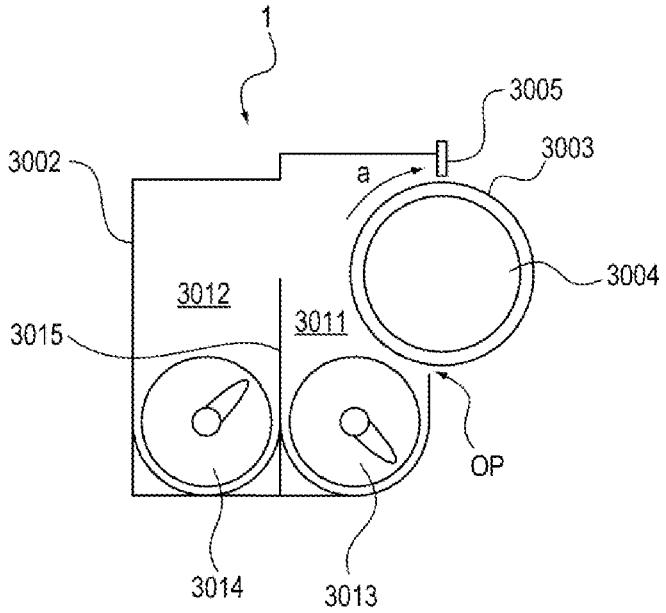
FIG. 46 is a schematic cross-sectional view of a development apparatus according to an eleventh embodiment.

The development device 1 (development apparatus) according to the eleventh embodiment will be described in detail with reference to FIG. 46. FIG. 46 is a schematic cross-sectional view of the development apparatus according to an eleventh embodiment.

As illustrated in FIG. 46, in the development device 1, a developing container 3002 housing two-component developer is arranged, and a developing sleeve 3003 is arranged in an opening portion OP of the developing container 3002.

In this embodiment, as a developing system, the two-component developing system is used. As the developer, a mixture of non-magnetic toner having negative charging polarity and a magnetic carrier is used. The non-magnetic toner is acquired by including a coloring agent, a wax component, and the like in a resin such as polyester or styrene acryl and forming a resultant resin into powders through a grinding process or a polymerization process. The magnetic carriers are acquired by applying a resin coat to the surface layer of a core formed by resin particles acquired by kneading ferrite particles or magnetic powders. In this embodiment, the toner density (the weight ratio of toner to the developer) of the developer that is in the initial state is 8%.

The opening portion OP is present in a part of the developing container 3002 that faces the photosensitive drum 28. The developing sleeve 3003 (developer bearing member) is rotatably arranged so as to be partly exposed from the opening portion OP. The developing sleeve 3003 is configured by a non-magnetic material.

Inside the developing sleeve 3003, a magnet 3004 (magnetic field generation member) configured by a plurality of magnetic poles is fixedly arranged. The developing sleeve 3003 is rotated in the direction of an arrow a illustrated in the figure and conveys developer adsorbed at the position of the N1 pole of the magnet 3004 toward the blade 3005 side. The developer napped by the pole S1 receives a shearing force from a blade 3005 and passes through a gap between the developing sleeve 3003 and the blade 3005 in the state in which the amount thereof is regulated. Accordingly, a developer layer having a predetermined layer thickness is formed on the developing sleeve 3003.

The developer layer is carried and conveyed to a developing area that faces the photosensitive drum 28. Then, the developer is conveyed to a position facing the photosensitive drum 28 in a state in which a magnetic brush is formed by the pole N2. Then, toner contained in the developer is supplied to the photosensitive drum 28, and the electrostatic latent image is developed. Accordingly, a toner image is formed on the photosensitive drum 28.

The developer remaining on the photosensitive drum 28 after being provided for the developing process is peeled off from the developing sleeve 3003 by the low magnetic field area between the poles N3 and N1 that are a pair of repulsive magnetic poles adjacent to each other having the same polarity.

As illustrated in FIG. 46, the developing container 3002 is partitioned into a developing chamber 3011 and a stirring chamber 3012 by a partition wall 3015. The developing chamber 3011 and the stirring chamber 3012 extend along the direction of the rotation shaft of the developing sleeve 3003.

Both ends of the partition wall 3015 do not arrive at side walls of longitudinal-direction both end portions inside the developing container 3002, and communication portions are formed in both the ends. For this reason, the passage of developer is allowed between the developing chamber 3011 and the stirring chamber 3012.

In the developing chamber 3011 and the stirring chamber 3012, as circulation/conveyance members circulating the developer between the developing chamber 3011 and the stirring chamber 3012, a first screw 3013 and a second screw 3014 are arranged. The developing sleeve 3003, the first screw 3013, and the second screw 3014 are connected and driven by a gear train not illustrated in the figure and rotate by receiving a driving force from a development device driving gear not illustrated in the figure. According to the rotation of the first screw 3013 and the second screw 3014, the developer is mixed and stirred while circulating the inside of the developing container 3002.

Figure 47:
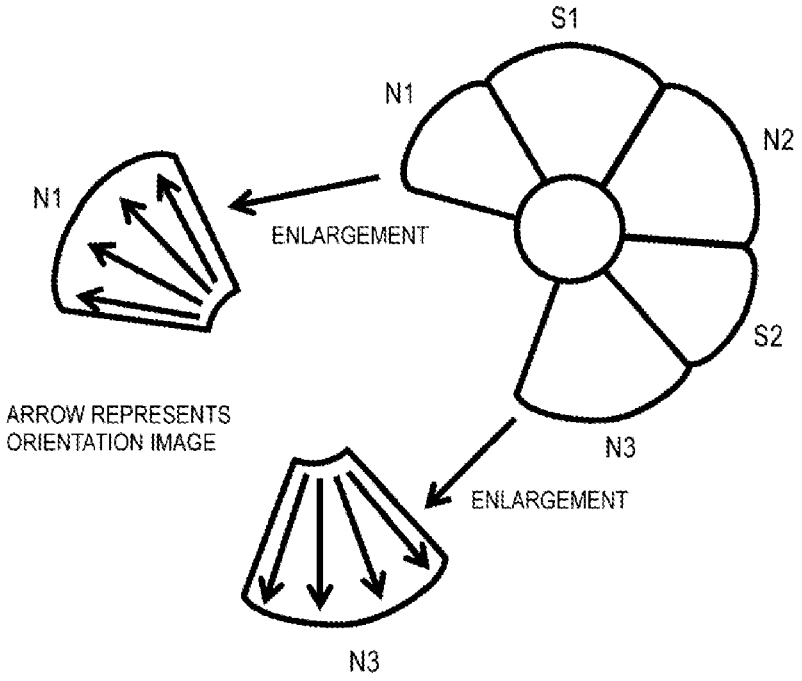
FIG. 47 is a cross-sectional view of an example of a magnet according to the eleventh embodiment.

FIG. 47 is a cross-sectional view of an example of the magnet according to the eleventh embodiment. The magnet 3004 of this embodiment is manufactured as follows. First, as the magnetic powders, magnetic anisotropic ferrite powders (anisotropic Sr ferrite, anisotropic Ba ferrite, or the like) are used, and rubber (nitrile rubber, chloroprene rubber, silicone rubber, or the like) as the binder is mixed therewith. The kneaded material thereof is extruded to be molded into a bar shape having an approximately fan-shaped cross-section in a magnetic field and then, is magnetized and is used as magnet pieces configuring the pole N1 and the pole N3.

As illustrated in FIG. 47, the orientation of the magnetization of the magnetic powders of the magnetic pieces configuring the pole N1 (draw-up pole) and the pole N3 (peel-off pole) is in the directions of the diameters of the poles N1 and N3. In addition, in an area located near a side face facing the repulsive poles of the poles N1 and N3, the magnetization direction of the magnetic powders is configured to follow the side face.

Figure 48:
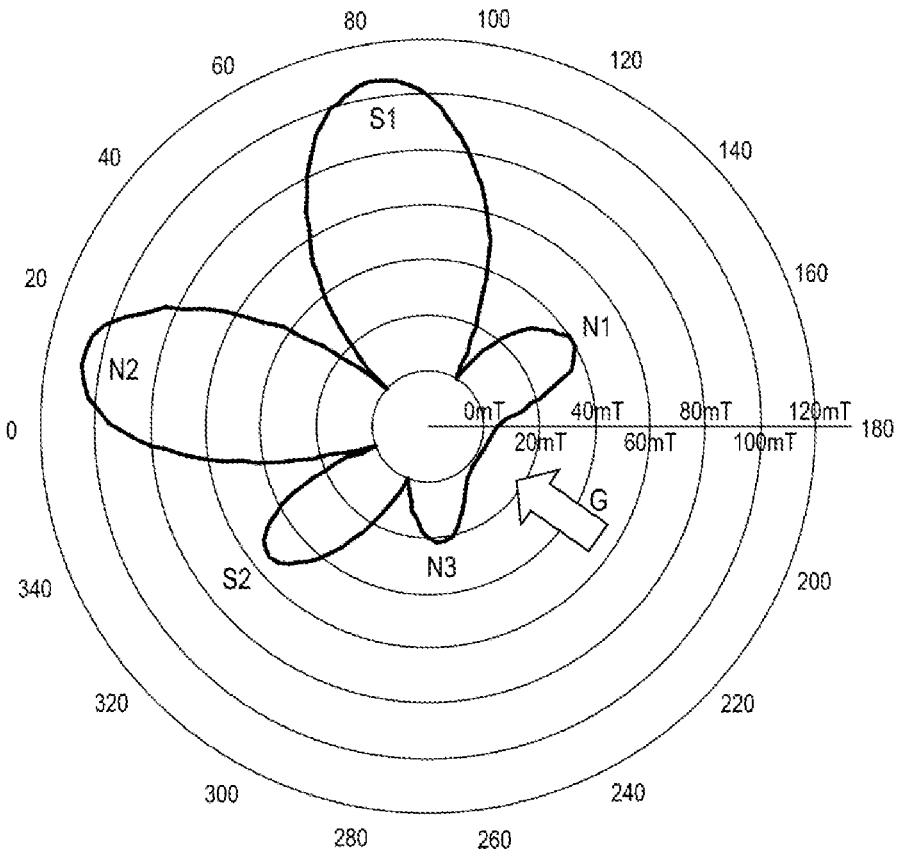
FIG. 48 is a diagram that illustrates a sectional-direction magnetic flux density of a magnetic field generation member according to the eleventh embodiment.

Next, the characteristic of the magnetic field generation member according to this embodiment, which is one of featured parts of this embodiment, will be described with reference to FIGS. 48 and 49. FIG. 48 is a diagram that illustrates a sectional-direction magnetic flux density of the magnetic field generation member according to the eleventh embodiment.

Generally, in the case of a magnet roller configured by an odd number of magnetic pole peaks, since the peel-off pole and the draw-up pole have the same polarity, a low magnetic field area (minimum area G) of the magnetic force (magnetic flux density) is generated between these both poles. Alternatively, a repulsive magnetic field may be generated according to a repulsive force between both the poles. In addition, in this embodiment, while the peel-off pole and the draw-up pole are poles that have the same polarity and are adjacent to each other, there are cases where an extremely-small unlike pole is generated between the peel-off pole and the draw-up pole. In this embodiment, it is assumed that magnetic poles having the same polarity are adjacent to each other, including such a case.

In a case where the low magnetic field area or the magnetic force of the repulsive magnetic field is large, the peeling-off property of the developer carried on the developer bearing member after the developing process is degraded, and there is concern that an image defection such as a density decrease due to the developer that has not been peeled off from the developer bearing member may occur.

Accordingly, in the magnetic field generation member of this embodiment, a low magnetic field area is included in which a magnetic force measured at a circumferential face that approximately coincides with the outer peripheral face of the developer bearing member is 10 mT or less. In addition, the area in which the magnetic force of the low magnetic force zone of 10 mT or less is generated is formed to be flat. Accordingly, the peeling-off property of the developer is improved.

Figure 49A:
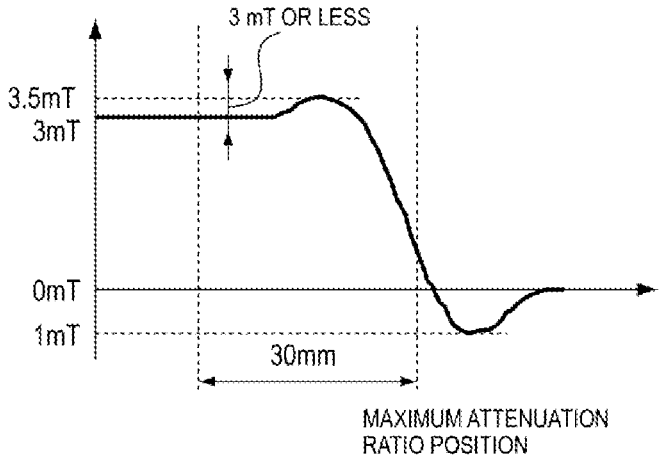
FIGS. 49A and 49B are diagrams that illustrate magnetic flux densities near longitudinal-direction end portions of a low magnetic field area of the magnetic field generation member.
Figure 49B:
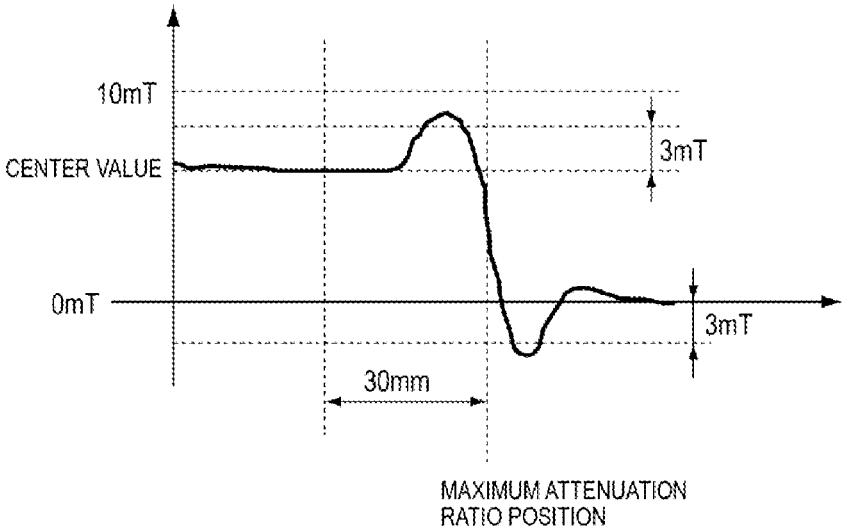

FIGS. 49A and 49B are diagrams that illustrate magnetic flux densities near longitudinal-direction end portions of low magnetic field areas of magnetic field generation members. FIG. 49A is a diagram that illustrates the case of the magnet according to this embodiment, and FIG. 49B is a diagram that illustrates the case of a magnet of a comparative example.

In this embodiment, at positions at which the magnetic flux density of the low magnetic field area in the peripheral direction of the developer bearing member is minimal, a longitudinal-direction magnetic force distribution of the developer bearing member is defined. In this way, a magnetic force elevation in the end portion of the low magnetic field area and magnetic force inversion in the end portion of the magnetic field generation member are defined. First, the magnetic force elevation of the end portion of the minimum area of the magnet 3004 is defined as follows. As illustrated in FIG. 49A, a difference between a maximal magnetic flux density in the range from a maximal position, at which the attenuation rate of the magnetic flux density is maximal, to a 30 mm distant position toward the center side of the developer bearing member and a magnetic flux density of a further center-portion side of the developer bearing member than the above-described range is 3 mT or less.

In addition, the magnetic force inversion in the end portion of the magnetic field generation member is defined as follows. In other words, as illustrated in FIG. 49A, from the maximum position of the attenuation ratio of the magnetic flux density of the end portion of the longer side of the magnetic field generation member, in a magnetic field generation area disposed on a side opposite to the center of the longer side, when a pole having the same polarity or the opposite polarity of the magnetic field is generated, the absolute value of the magnetic flux density is within 3 mT. Here, the magnetic flux density of the center portion of the longer side represents an average value of the magnetic flux densities of a further inner area than the above-described end portion.

In this way, in a case where the above-described magnetic characteristics are satisfied at the minimum position of the low magnetic field area, the longitudinal-direction magnetic force distribution of the low magnetic field area (repulsive magnetic field area) has the same magnetic characteristics. For this reason, unlike the conventional case, it can be suppressed that developer leaks due to the influence of the magnetic force of the longitudinal-direction end portion of the low magnetic field area. Meanwhile, in the peripheral direction of the magnetic field generation member, at a position other than a position located between the peel-off pole and the draw-up pole, basically, the magnetic force of the center side of the developer bearing member is high, and accordingly, a situation is formed in which it is difficult for the developer to leak from the end portion of the developer bearing member.

Figure 50A:
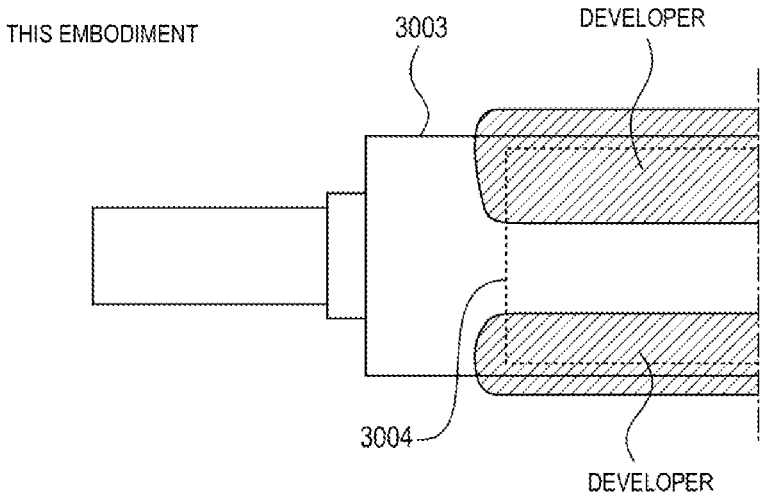
FIGS. 50A and 50B are diagrams comparing end portions of developer bearing members using magnets of the eleventh embodiment and the comparative example.
Figure 50B:
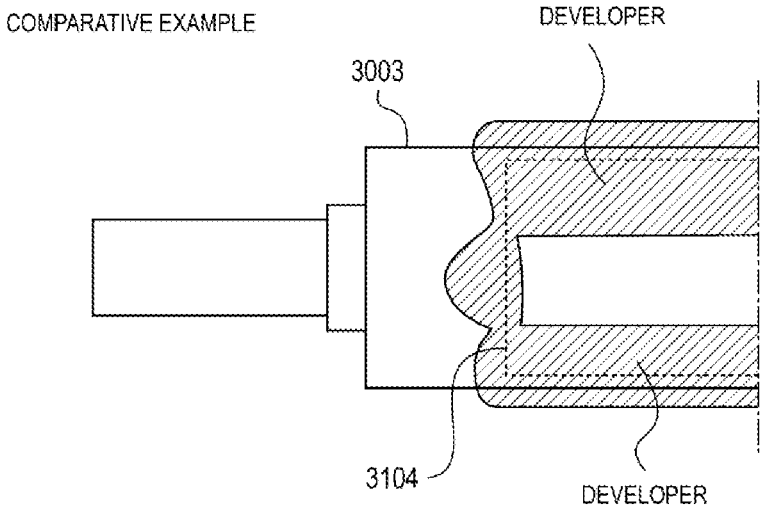

FIGS. 50A and 50B are comparative diagrams of developer bearing members viewed from the low magnetic field area sides. FIG. 50A is the magnetic field generation member according to the eleventh embodiment illustrated in FIG. 49A, and FIG. 50B is the magnet of the comparative example illustrated in FIG. 49B.

In a case where a magnet 3004 having longitudinal-direction magnetic force characteristics at the minimum position of the low magnetic field area not satisfying the magnetic force characteristics of this embodiment is used, as in the comparative example illustrated in FIG. 50B, the developer wraps around the outer side of the low magnetic field area. In a case where the developer wraps around the end portion of the developer bearing member as above, it causes the developer to leak out.

On the other hand, in this embodiment, the low magnetic field area of the magnetic field generation member is 10 mT or less on the surface of the developer bearing member, and the longitudinal-direction magnetic force characteristics are defined as above. In this case, as in the case illustrated in FIG. 50A, the developer is not carried in correspondence with the low magnetic field area, and there is no wrapping-around of the developer. For this reason, a configuration can be formed in which it is difficult for the developer to leak from the end portion also in the low magnetic field area.

Figure 51A:
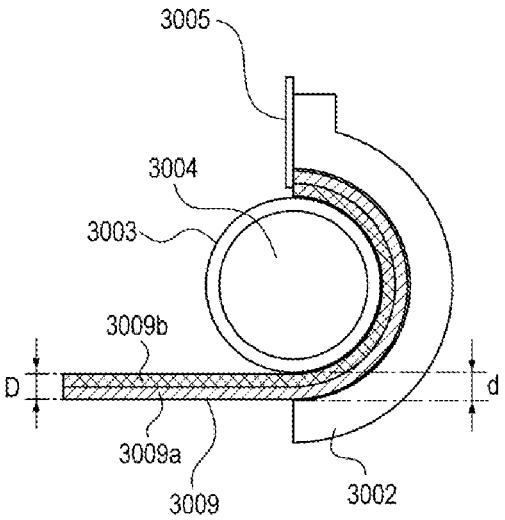
FIGS. 51A and 51B are use state diagrams of a sealing member according to the eleventh embodiment.
Figure 51B:
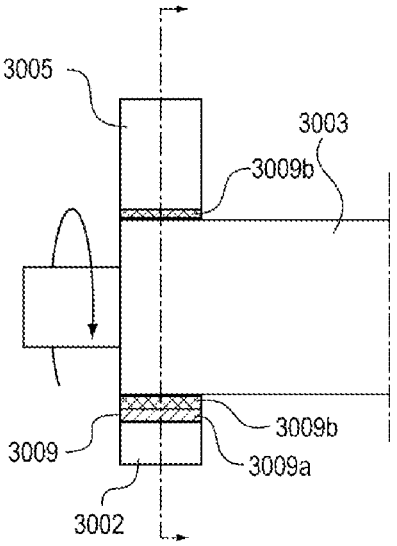

Next, a sealing member that is one of the featured parts of this embodiment will be described. FIGS. 51A and 51B are use state diagrams of the sealing member according to the eleventh embodiment. FIG. 51A is a cross-sectional view, and FIG. 51B is a side view.

As illustrated in FIG. 51A, in this embodiment, a developing sleeve 3003 formed in a concentric circle of the magnet 3004 is disposed. Between the developing sleeve 3003 and the developing container 3002, there is a gap. For this reason, in the initial period of the development device 1, which has not been used, such as at the time of transportation/conveyance, the sealing member 3009 (end portion sealing member) is inserted so as to fill in the gap.

It is preferable that the thickness D of the sealing member 3009 be slightly thicker than the gap d between the developing sleeve 3003 and the developing container 3002. The reason for this is that, by inserting the sealing member 3009, the gap between the developing sleeve 3003 and the developing container 3002 is filled up, and the developer does not leak out at the time of transportation/conveyance. In this embodiment, the gap d between the developing sleeve 3003 and the developing container 3002 is set to 0.6 mm, and the thickness D of the sealing member 3009 is set to 0.7 mm.

Figure 52:
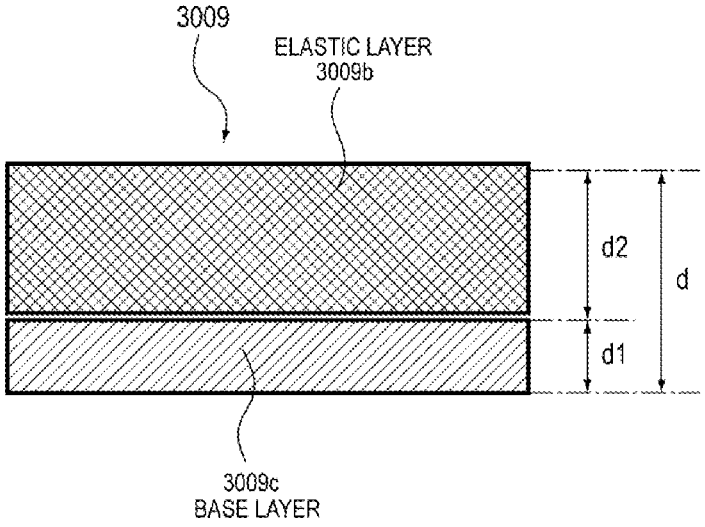
FIG. 52 is a cross-sectional view of the sealing member according to the eleventh embodiment.

FIG. 52 is a cross-sectional view of the sealing member according to the eleventh embodiment. The sealing member 3009 according to this embodiment has a two-layer configuration including a base layer 3009*a* and an elastic layer 3009*b*.

As illustrated in FIG. 52, the sealing member 3009 of this embodiment includes an elastic layer 3009*b*. In this case, it is preferable that the sealing member be configured by at least two or more layers having mutually-different degrees of hardness.

In the case of multiple layers, as the material of the base layer 3009*a*, for example, a synthetic resin such as a polyester resin, an acrylic resin, a melamine resin, an epoxy resin, a urethane resin, a silicone resin, a urea resin, or a polyamide resin may be used.

As the material of the elastic layer 3009*b*, for example, a synthetic resin such as a polyester resin, an acrylic resin, a melamine resin, an epoxy resin, a urethane resin, a polyurethane resin, a silicone resin, a urea resin, or a polyamide resin may be used. In addition, synthetic rubber such as ethylene-propylene rubber, epichlorohydrin rubber, silicone rubber, or fluororubber may be used, or a foamed body of the synthetic resin or the synthetic rubber described above may be used. Especially, a foamed body of the polyurethane resin may be relatively easily used.

As a foamed body composing the elastic layer 3009*b*, the number of cells is not particularly limited. However, the number of cells is preferably 40 to 120/25 mm and is more preferably 80 to 110/25 mm.

As the hardness of the elastic layer 3009*b*, Asker C hardness is preferably in the range of 0.5 to 50°, is more preferably in the range of 0.5 to 40°, and is further more preferably in the range of 0.5 to 30°. The reason for this is that, as the hardness decreases, the elastic layer 3009*b* is easily deformed and broken and is easily inserted between the developing sleeve 3003 and the developing container 3002.

In the case of a multi-layer structure, it is necessary to adhere the base layer and the elastic layer 3009*b* using an adhesive not illustrated in the figure. As the adhesive used at this time, for example, an adhesive having an acrylic resin, polyvinyl acetate, polyurethane, synthetic rubber, natural rubber, or the like as its main ingredient is used.

In a case where a porous elastic base material is used, an aqueous adhesive having such a resin as its main ingredient is preferable owing to a small amount of swelling of the base material, and, particularly, the acrylic resin is preferable.

The acrylic resin can be classified into nonreactive polyacrylic ester (uncrosslinked type), a reactive polyacrylic ester (mainly, methylol melamine is used as a crosslinking agent), and self-crosslinked polyacrylic ester. Here, the reactive self-crosslinked acrylic resin is frequently used owing to superior water resistance, alkali resistance, solvent resistance, and the like.

In addition, in the case of the reactive acrylic resin, in order to improve the physical property, at least one of a carboxyl group, an amide group, an amino group, an epoxy group, a hydroxyl group, and the like may be introduced as a functional group. In addition, only one of these groups may be used, or two or more of the groups may be used together. This method can simplify the manufacturing method and thus, is preferable.

In this embodiment, the sealing member 3009 is a two-layer type. The base layer 3009*a* is formed using a polyester resin and has a compressed thickness d1=0.2 mm. In addition, the elastic layer 3009*b* is formed using a foamed body of the polyurethane resin and has a compressed thickness d2=0.4 mm, the number of cells of 100/25 mm, and Asker C hardness of 10°. The whole compressed thickness of the sealing member 3009 is d=0.6 mm.

Next, a method of mounting the sealing member 3009 according to this embodiment between the developing sleeve 3003 and the developing container 3002 will be described.

On the surface of the sealing member 3009, the elastic layer 3009*b* having a high coefficient of friction is present. In addition, as described above, the sealing member 3009 is slightly larger than the gap between the developing sleeve 3003 and the developing container 3002. For this reason, as illustrated in FIGS. 51A and 51B, in a case where the sealing member 3009 is mounted in the development device 1, when the sealing member 3009 is mounted between the developing container 3002 and the developing sleeve 3003, a resistance force is generated.

Here, when the sealing member 3009 according to this embodiment is to be actually mounted, the sealing member 3009 is interposed so as to be fed from the opening portion disposed on the lower side in FIGS. 51A and 51B between the developing sleeve 3003 and the developing container 3002. At this time, as illustrated in FIGS. 51A and 51B, the elastic layer 3009*b* of the sealing member 3009 according to this embodiment is set as a face to be brought into contact with the developing sleeve 3003.

Thereafter, the developing sleeve 3003 is rotated in the counterclockwise direction in FIGS. 51A and 51B. Then, the sealing member 3009 can be smoothly inserted between the developing sleeve 3003 and the developing container 3002. In this way, the end portion of the sleeve can be sealed.

While a positional relation in which the sealing member 3009 abuts the blade 3005 is illustrated to be formed in FIGS. 51A and 51B, the positional relation is not necessarily limited thereto depending on the configuration of the blade 3005.

In addition, the method of mounting the sealing member 3009 is not necessarily limited thereto. Thus, when the developing container 3002 is manufactured, the sealing member 3009 may be assembled in the state of being wound around the end portion of the developing sleeve 3003 so as to be in a mounting-completed state.

Twelfth Embodiment

Figure 53A:
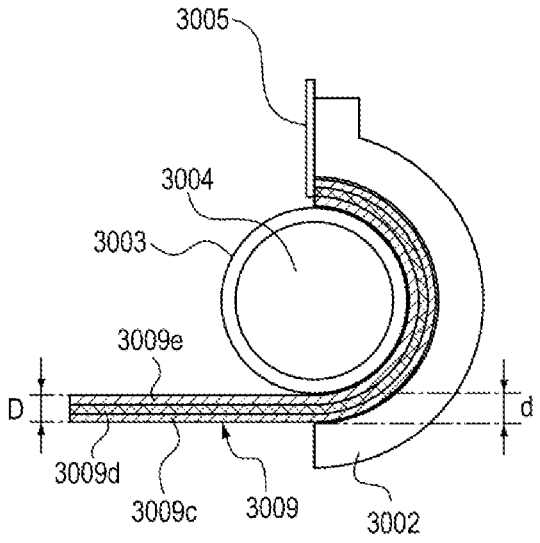
FIGS. 53A and 53B are use state diagrams of a sealing member according to a twelfth embodiment.
Figure 53B:
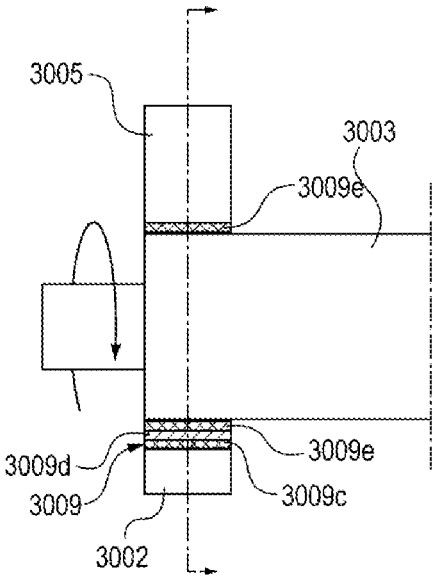
Figure 54A:
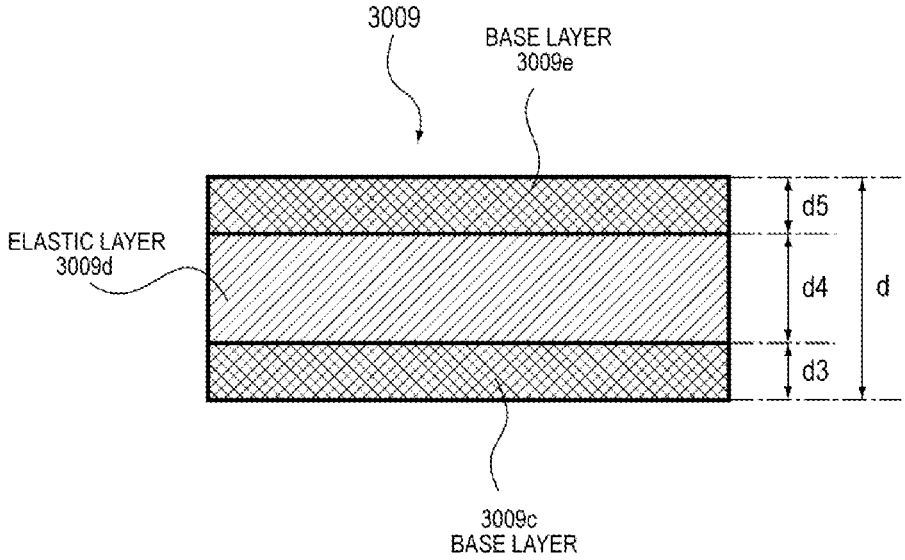
FIGS. 54A and 54B are cross-sectional views of the sealing member according to the twelfth embodiment.
Figure 54B:
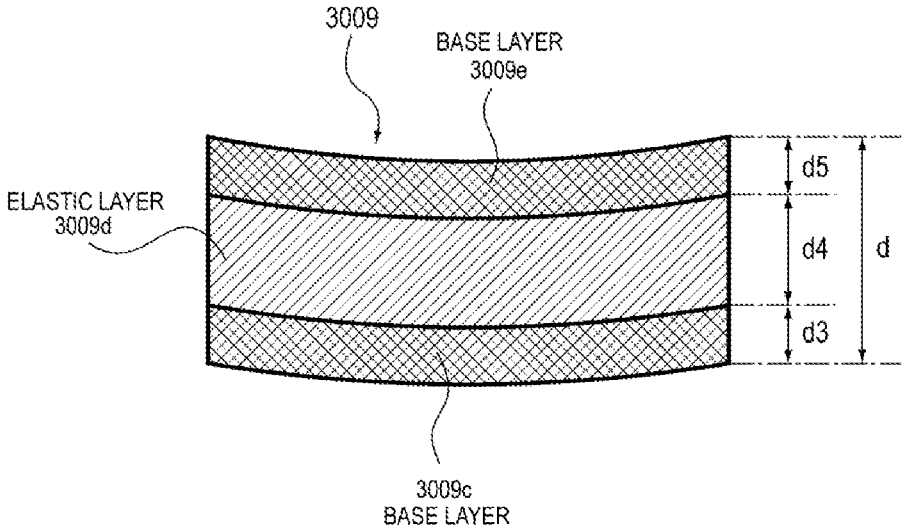

A twelfth embodiment of the present invention will be described. The same reference numerals will be assigned to the same configuration as that described above, and description thereof will not be presented. FIGS. 53A and 53B are use state diagrams of a sealing member according to the twelfth embodiment. FIG. 53A is a cross-sectional view, and FIG. 53B is a side view. FIGS. 54A and 54B are cross-sectional views of the sealing member according to the twelfth embodiment.

The sealing member 3009 according to this embodiment is a three-layer type member as illustrated in FIGS. 53A, 53B, 54A, and 54B, and an elastic layer 3009*d* is arranged between a base layer 3009*c* and a base layer 9*e*. In addition, as illustrated in FIG. 54B, the sealing member 3009 is curved in the short-side direction (a direction parallel to the axial direction of the developing sleeve 3003 when being mounted to the development device 1).

In this embodiment, the base layer 3009*c* and the base layer 9*e* are formed using a polyester resin and have a compressed thickness d3=d5=0.1 mm. In addition, the elastic layer 3009*b* is formed using a foamed body of the polyurethane resin and has a thickness d4=0.4 mm, the number of cells of 100/25 mm, and Asker C hardness of 10°. The whole compressed thickness of the sealing member 3009 is d=0.6 mm.

Generally, the coefficient of friction of the surface of the elastic layer having the foamed body tends to be high. Actually, frequently, it takes time to mount the sealing member 3009 to the development device 1. For this reason, in this embodiment, the elastic layer 3009*d* of the sealing member 3009 is configured to have a sandwich structure of being interposed between the base layer 3009*c* and the base layer 3009*e*.

As above, as the elastic layer 3009*b* is present, the elastic transformation function (crashing) is secured. Thus, it is easy to insert the sealing member 3009 between the developing sleeve 3003 and the developing container 3002. In addition, since the base layer 3009*c* and the base layer 3009*e* are present, the elastic layer 3009*d* is not directly brought into contact with the developing sleeve 3003 and the developing container 3002.

In addition, in a case where the three-layer configuration is employed like the sealing member 3009 according to this embodiment, the thickness of the base layer 3009*c* and the base layer 3009*e* decreases. For this reason, the longitudinal-direction strength (stiffness) of the sealing member 3009 is relatively insufficient.

For this reason, in this embodiment, the above-described three-layer configuration is employed, and the curved (bent) configuration for the short-side direction of the sealing member 3009 is employed. By employing the curved configuration for the short-side direction, the stiffness of the sealing member 3009 can be secured according to the effect of the bending. Thus, when the sealing member 3009 is inserted between the developing sleeve 3003 and the developing container 3002, it can be avoided that the sealing member 3009 is bent in the middle.

According to this embodiment, by employing the configuration as described above, the sealing process of the end portion of the developing sleeve 3003 can be performed in a very simplified manner. In addition, when the development device 1 is used, in a case where the user removes the sealing member 3009, the operability of the removing operation is markedly improved.

Next, a method of mounting the sealing member 3009 according to this embodiment between the developing sleeve 3003 and the developing container 3002 will be described.

When the sealing member 3009 according to this embodiment is to be actually mounted, the sealing member 3009 is interposed so as to be fed from the opening portion disposed on the lower side in FIG. 53 between the developing sleeve 3003 and the developing container 3002. At that time, since the base layers are arranged on both the front face and the rear face of the sealing member 3009 according to this embodiment, any one of the faces may be brought into contact with the developing sleeve 3003. Thereafter, by directly inserting the sealing member 3009 between the developing sleeve 3003 and the developing container 3002 at once, the sealing member is mounted.

However, the mounting method is not limited thereto. For example, similar to the above-described embodiment, the developing sleeve 3003 is rotated in the counterclockwise direction in FIGS. 53A and 53B. Accordingly, the end portion of the developing sleeve 3003 may be sealed by mounting the sealing member 3009 between the developing sleeve 3003 and the developing container 3002.

In addition, when the developing container 3002 is manufactured, the sealing member 3009 may be assembled in the state of being wound around the end portion of the developing sleeve 3003 so as to be in a mounting-completed state.

While a positional relation in which the sealing member 3009 abuts the blade 3005 is illustrated to be formed in FIGS. 53A and 53B, the positional relation is not necessarily limited thereto depending on the configuration of the blade 3005.

The development device according to this embodiment may be shipped in a state in which the developer is sealed in the developing container. As above, also in a situation in which a slight amount of the developer is present in the end portion of the developing sleeve 3003 as above, according to this embodiment, the end portion of the developing sleeve can be sealed in the transportation/conveyance in a simplified manner.

As above, according to the eleventh embodiment or the twelfth embodiment, a leakage of the developer in the development apparatus can be decreased.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-099428, filed May 13, 2014, No. 2014-099429, filed May 13, 2014, No. 2014-099430, filed May 13, 2014, No. 2014-099432, filed May 13, 2014, which are hereby incorporated by reference herein in their entirety.

What is claimed is:

1. A development device comprising:

a developing container which houses two-component developer including toner and a magnetic carrier;

a developer bearing member which bears the two-component developer; and a magnetic field generation member which includes a plurality of magnetic poles including first and second magnetic poles having the same polarity and being adjacent to each other in a peripheral direction of the developer bearing member, the magnetic field generation member being arranged inside the developer bearing member, wherein the magnetic field generation member, between the first magnetic pole and the second magnetic pole, includes a low magnetic field area in which a magnetic force measured on a circumferential face approximately coinciding with an outer peripheral face of the developer bearing member is 10 mT or less, and a magnetic force distribution of the developer bearing member in a longitudinal direction at positions at which a magnetic flux density of the low magnetic field area is minimal in the peripheral direction of the developer bearing member is set such that a difference between a maximum magnetic flux density in a range from a maximum position at which an attenuation rate of the magnetic flux density is maximal to a 30 mm distant position toward the center of the developer bearing member and a magnetic flux density on a further center side of the developer bearing member than the range is 3 mT or less, and an absolute value of the magnetic flux density of a further outer side in the longitudinal direction of the developer bearing member than the maximum position is set to 3 mT or less, and wherein, in a space between the developing container and the developer bearing member, an electric field formation member which is arranged in a peripheral area of an end portion of the developer bearing member and can form an electric field repelling normal charged polarity of the toner is included.

2. The development device according to claim 1, wherein the electric field formation member is a sealing member having a charged series of the same polarity as that of the toner and is arranged in the developing container at a position facing the end portion of the developer bearing member.

3. The development device according to claim 2, wherein the sealing member is arranged in the developing container at a position facing the low magnetic field area.

4. The development device according to claim 1, wherein the electric field formation member is a sealing member having a charged series of the same polarity as that of the toner and is arranged in the end portion of the developer bearing member.

5. The development device according to claim 1, wherein the electric field formation member is an electrode to which a voltage is applied by a voltage power supply and is arranged in the developing container at a position facing the end portion of the developer bearing member.

6. The development device according to claim 5, wherein the voltage power supply applies a voltage to the electrode such that an electric potential difference between a voltage applied to the developer bearing member and the voltage applied to the electrode has the same polarity as charged polarity of the toner.

7. The development device according to claim 5, wherein the electrode has a plurality of sub-electrodes, and the sub-electrodes are arranged in the developing container at positions facing both end portions of the developer bearing member, and wherein the sub-electrodes are connected together by using a longitudinal electrode disposed to extend in the longitudinal direction of the developer bearing member.

8. An image forming apparatus comprising:

an image bearing member; and the development device according to claim 1 which supplies toner to the image bearing member.

9. A development device comprising:

a developer bearing member which bears and conveys two-component developer including toner and a carrier and supplies the developer to a developing area;

a magnetic field generation member which is fixedly arranged inside the developer bearing member;

a layer-thickness regulation member which is arranged to face the developer bearing member and regulates a developer layer thickness of the developer bearing member;

a first chamber which includes a first opening portion disposed to face a peripheral face of the developer bearing member and supplies the developer to the developer bearing member through the first opening portion;

a first stirring member which is arranged inside the first chamber;

a second chamber which includes a second opening portion disposed to face the peripheral face of the developer bearing member, collects the developer from the developer bearing member through the second opening portion, and circulates the developer between the first chamber and the second chamber; and a second stirring member which is arranged inside the second chamber;

wherein the magnetic field generation member includes magnetic poles of the same polarity adjacent to each other in a peripheral direction of the developer bearing member, and between the magnetic poles is a low magnetic field area in which a magnetic force measured on a circumferential face approximately coinciding with an outer peripheral face of the developer bearing member is 10 mT or less, and a magnetic force distribution of the developer bearing member in a longitudinal direction at positions at which a magnetic flux density of the low magnetic field area is minimal in the peripheral direction of the developer bearing member is set such that a difference between a maximum magnetic flux density in a range from a maximum position at which an attenuation rate of the magnetic flux density is maximal to a 30 mm distant position toward the center of the developer bearing member and a magnetic flux density on a further center side of the developer bearing member than the range is 3 mT or less, and an absolute value of the magnetic flux density of a further outer side in the longitudinal direction of the developer bearing member than the maximum position is set to 3 mT or less.

10. The development device according to claim 9, wherein a guide member conveying the developer peeled off from the developer bearing member to the second chamber is included.

11. The development device according to claim 10, wherein, in a portion at which the developer bearing member and the guide member are closest to each other, a position of a longitudinal-direction end portion of the guide member is located on a further inner side than a position of an end portion of a developer bearing area of the developer bearing member in the longitudinal direction of the developer bearing member.

12. The development device according to claim 10, wherein, in a portion at which the developer bearing member and the guide member are closest to each other, a lateral slip preventing member for preventing movement of the developer to a longitudinal-direction outer side is provided at a position of a longitudinal-direction end portion of the guide member.

13. The development device according to claim 9, wherein the developer bearing member is arranged above the first stirring member in the gravity direction.

14. An image forming apparatus comprising:

an image bearing member; and the development device according to claim 9 which supplies toner to the image bearing member.

15. A development device comprising:

a developing container which houses two-component developer including toner and a carrier;

a developer bearing member which bears the two-component developer; and a magnetic field generation member which forms a low magnetic field area of a magnetic force by using magnetic poles having the same polarity adjacent to each other among a plurality of magnetic poles arranged inside the developer bearing member;

a layer-thickness regulation member which is arranged to face the developer bearing member and regulates a thickness of the developer of the developer bearing member; and a developer seal which is arranged in an end portion of the developer bearing member, wherein the magnetic field generation member includes magnetic poles of the same polarity adjacent to each other in a peripheral direction of the developer bearing member, and between the magnetic poles is a low magnetic field area in which a magnetic force measured on a circumferential face approximately coinciding with an outer peripheral face of the developer bearing member is 10 mT or less, and a magnetic force distribution of the developer bearing member in a longitudinal direction at positions at which a magnetic flux density of the low magnetic field area is minimal in the peripheral direction of the developer bearing member is set such that a difference between a maximum magnetic flux density in a range from a maximum position at which an attenuation rate of the magnetic flux density is maximal to a 30 mm distant position toward the center of the developer bearing member and a magnetic flux density on a further center side of the developer bearing member than the range is 3 mT or less, and an absolute value of the magnetic flux density of a further outer side in the longitudinal direction of the developer bearing member than the maximum position is set to 3 mT or less, and wherein the developer seal is arranged to enclose the developer bearing member on a further downstream side than the low magnetic field area on a further upstream side than the layer-thickness regulation member in a rotation direction of the developer bearing member.

16. The development device according to claim 15, wherein the developer seal is a magnetic plate made from ferromagnetic material.

17. The development device according to claim 15, wherein the developer seal is disposed along the peripheral direction of the developer bearing member such that a space portion is formed between a surface of the developer bearing member and the developer seal.

18. The development device according to claim 15, wherein a magnet member is arranged at a position adjacent to the developer seal of the developer bearing member.

19. The development device according to claim 18, wherein the magnet member is disposed along the peripheral direction of the developer bearing member such that a space portion is formed between a surface of the developer bearing member and the magnet member.

20. An image forming apparatus comprising:

an image bearing member; and the development device according to claim 15 which supplies toner to an electrostatic latent image formed on the image bearing member.

21. A development device comprising:

a developing container which houses developer;

a developer bearing member which bears the developer;

a magnetic field generation member which is fixedly arranged inside the developer bearing member; and a pair of repulsive magnetic poles having the same polarity adjacent to each other among a plurality of magnetic poles generated by the magnetic field generation member, wherein the magnetic field generation member, between the magnetic poles having the same polarity adjacent to each other, includes a low magnetic field area in which a magnetic force measured on a circumferential face approximately coinciding with an outer peripheral face of the developer bearing member is 10 mT or less, and a magnetic force distribution of the developer bearing member in a longitudinal direction at positions at which a magnetic flux density of the low magnetic field area is minimal in the peripheral direction of the developer bearing member is set such that a difference between a maximum magnetic flux density in a range from a maximum position at which an attenuation rate of the magnetic flux density is maximal to a 30 mm distant position toward the center of the developer bearing member and a magnetic flux density on a further center side of the developer bearing member than the range is 3 mT or less, and an absolute value of the magnetic flux density of a further outer side in the longitudinal direction of the developer bearing member than the maximum position is 3 mT or less, and wherein the development device includes an end-portion sealing member which is arranged to be detachably attachable so as to fill in a gap between the developing container and the developer bearing member in an end portion of the developer bearing member.

22. The development device according to claim 21, wherein the end-portion sealing member has a multi-layer structure, and the multi-layer structure has an elastic layer.

23. The development device according to claim 22, wherein the elastic layer is configured using a material of which Asker C hardness is in the range of 0.5 to 50°.

24. The development device according to claim 22, wherein the elastic layer is configured by a foamed body.

25. The development device according to claim 21, wherein a thickness of the end-portion sealing member is thicker than the gap between the developer bearing member and the developing container.

26. The development device according to claim 21, wherein the end-portion sealing member is bent in parallel with an axial direction of the developer bearing member.

27. An image forming apparatus comprising:

an image bearing member; and the development device according to claim 21 which supplies toner to the image bearing member.

* * * * *